US006336756B1

(12) United States Patent
Toyama et al.

(10) Patent No.: US 6,336,756 B1
(45) Date of Patent: Jan. 8, 2002

(54) INK JET PRINTER THAT CARRIES OUT PRINTING WITH STRUT MOVING ALONG ARC

(75) Inventors: Tetsuya Toyama; Nobuya Kishi; Yoshiaki Tomaru, all of Yamatokoriyama; Nobuyoshi Miyao, Sakurai; Toshihiro Asaka, Higashiosaka; Takeshi Arai; Seiji Takeda, both of Yamatokoriyama; Masatsugu Hatanaka, Kashiwara, all of (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/488,542

(22) Filed: Jan. 21, 2000

(30) Foreign Application Priority Data

Feb. 1, 1999 (JP) ..... 11-023919
Oct. 1, 1999 (JP) ..... 11-281394

(51) Int. Cl.[7] ..... B41J 5/40; B41J 19/00; B41J 21/16

(52) U.S. Cl. ..... 400/61; 400/283; 400/279

(58) Field of Search ..... 400/61, 283, 70, 400/76, 279

(56) References Cited

U.S. PATENT DOCUMENTS 3,949,851 A * 4/1976 Phelan ..... 197/1
5,831,655 A 11/1998 Asawa et al.
6,187,537 B1 * 2/2001 Zinn, Jr. et al. ..... 435/6
6,202,550 B1 * 3/2001 Lee et al. ..... 101/38.1

* cited by examiner

*Primary Examiner*—John S. Hilten
*Assistant Examiner*—Charles H. Nolan, Jr.

(57) ABSTRACT

A compact ink jet printer having a small amplitude width in the horizontal direction of an ink carriage includes: a shaft provided rotatably about a predetermined axis; a strut fixed to the shaft so as to move along an arc about the axis with rotation of the shaft; an ink carriage having a plurality of ink heads provided at a predetermined direction from the shaft of the strut; and a control device controlling forwarding of a recording sheet, rotational motion of the shaft, and ink jetting from the plurality of ink heads.

41 Claims, 50 Drawing Sheets

INK JET PRINTER THAT CARRIES OUT PRINTING WITH STRUT MOVING ALONG ARC

BACKGROUND OF THE INVENTION

1. Field of the Invention

The present invention relates to ink jet printers, and particularly to a small ink jet printer that has a narrow lateral width for the runway portion and the overrun portion of the ink carriage.

2. Description of the Background Art

Referring to FIG. 1, a conventional ink jet printer 261 includes a scan guide 264 formed of a linear metal rod, and an ink carriage 263 that moves linearly along scan guide 264 to eject ink onto a recording sheet 62 for printing. At both sides of the printing region by ink carriage 263 are provided a region called the runway portion provided to bring ink carriage 263 from a stop state to a certain speed and a region called the overrun portion provided to stop ink carriage 263 moving at a constant speed. More specifically, ink carriage 263 runs over the runway portion to prepare for printing from position A to position B in the drawing along scan guide 264. Then, printing is carried out at a constant rate in the printing region. When ink carriage 263 moves passed the printing region to arrive at the overrun portion, ink carriage 263 decelerates and then stops. The change in speed of ink carriage 263 during this travel is as shown in FIG. 1.

Referring to FIG. 2, an ink jet printer 271 disclosed in U.S. Pat. No. 5,831,655 includes a heat roller 274 to transport and apply heat to recording sheet 62 for drying the ink jetted out on recording sheet 62, a recording head 275 located opposite to heat roller 274 to spray out ink on recording sheet 62 for printing, and an exhaust fan 276 for discharging the heat accumulated in ink jet printer 271 outside. Recording sheet 62 is heated by heat roller 274 while ink is sprayed on recording sheet 62 by recording head 275 for printing. Recording sheet 62 continues to be heated by a similar method even after printing. Accordingly, the ink jetted out on recording sheet 62 is dried.

According to ink jet printer 261, a runway portion and an overrun portion are required in addition to the printing region. A region besides the region required for printing must be provided in ink jet printer 261. This accounts for preventing reduction of the size of ink jet printer 261. Ink jet printer 271 has a similar problem since printing is effected in a similar manner.

In ink jet printer 271, the entire heat roller 274 discharges heat. Heat is provided to elements other than recording sheet 62. Heat roller 274 dries one horizontal line at a time on recording sheet 62. Therefore, the size of heat roller 274 per se is great and the heat generated from heat roller 274 is increased. Thus, ink jet printer 271 is increased in size and power consumption. There is also the problem of modification in the quality of the ink caused by recording head 275 being heated since the distance between heat roller 274 and recording head 275 is small. Although cooling is effected by exhaust fan 276 to reduce the heat effect, space and power are required to install and drive, respectively, exhaust fan 276. This also leads to increase in the size and power consumption of ink jet printer 271.

SUMMARY OF THE INVENTION

In view of the foregoing, an object of the present invention is to provide a small-size ink jet printer.

Another object of the present invention is to provide a compact ink jet printer that has many and high density of ink heads arranged in the ink carriage.

A further object of the present invention is to provide a compact ink jet printer without deviation between dots in printing.

Still another object of the present invention is to provide a compact ink jet printer without deviation between dots in printing and capable of printing without arc-like distortion.

A still further object of the present invention is to provide a compact ink jet printer without deviation between dots in printing and capable of printing without arc-like distortion, and that can dry printed out ink with lower power.

Yet a further object of the present invention is to provide an ink jet printer that can dry printed out ink without quality modification or coagulation of ink in the ink carriage.

Yet another object of the present invention is to provide an ink jet printer that can dry printed out ink without quality modification of ink sprayed out onto a recording sheet and without deformation of the recording sheet.

Yet a still further object of the present invention is to provide an ink jet printer that can dry printed out ink without quality modification or coagulation of ink in the ink carriage caused by heated air flow generated from a heat generator and that does not deform the spray out of ink droplets jetted out from the ink carriage caused by air blow.

An additional object of the present invention is to provide an ink jet printer that can dry printed out ink without erroneous spray out of ink from the ink carriage and without disturbance in the printed out image or text due to vibration of a heat generator.

Yet an additional object of the present invention is to provide a compact ink jet printer that can carry out printing at high speed.

According to an aspect of the present invention, an ink jet printer includes a shaft provided rotatably about a predetermined axis, a strut fixed to the shaft so as to move along an arc about the axis with rotation of the shaft, an ink carriage having a plurality of ink heads provided at a predetermined position from the shaft of the strut, and a control device controlling forwarding of a recording sheet, rotational motion of the shaft, and ink jetting from the plurality of ink heads.

The scanning operation of the ink carriage is effected by a reciprocating arc motion about the shaft. Therefore, even if the runway portion and the overrun portion of the same running distance as the conventional case are provided along the circular segment, the lateral widths of the runway portion and the overrun portion can be made smaller than those of the conventional ink jet printer. Thus, the travel width in the lateral direction of the ink carriage can be reduced to allow a smaller ink jet printer.

Preferably, the control device controls forwarding of a recording sheet, the rotational motion of the shaft, and ink jetting from a plurality of ink heads by defining the reciprocating motion width of printing for the ink carriage on the basis of the relationship between the width of the reciprocating motion of the ink head out of the plurality of ink heads located farthest away from the shaft and the width of the recording sheet.

The width of the reciprocating motion of printing for the ink carriage is defined on the basis of the relationship between the width of the reciprocating motion of the ink head located farthest away from the shaft and the width of the recording sheet. Therefore, by setting the width of the reciprocating motion of printing for the ink head located farthest from the shaft equal to the width of the recording sheet, printing can be carried out by the ink carriage at the minimum width of the reciprocating motion. Accordingly, the travel width of the ink carriage in the lateral direction can be reduced to allow a more compact ink jet printer.

Further preferably, a maintenance mechanism of the ink carriage is provided outside the printing motion range of the ink carriage, located opposite to the ink carriage.

The maintenance mechanism is provided on the extension of the reciprocating arc motion of the ink carriage. Therefore, the travel width of the ink carriage in the lateral direction can be suppressed to approximately the diameter of the circle at most, i.e., two times the length from the shaft to the leading edge of the ink carriage. Therefore, the ink jet printer can be reduced in size.

Further preferably, the ink carriage includes a plurality of ink heads fixed at the other end of the strut in a radial arrangement.

Since the ink heads are arranged radially, the ink heads can be arranged in an honeycomb manner. The number and density of the ink heads arranged at the ink carriage can be increased.

Further preferably, the control device defines the ink spray out timing from the plurality of ink heads corresponding to the distance between the shaft and each of the plurality of ink heads to control forwarding of a recording sheet, rotational motion of the shaft, and ink jetting from the plurality of ink heads.

Since the ink head moves along an arc, the scanning speed differs depending upon the distance from the strut. The ink spray out timing from the ink head is defined according to the distance from the strut. Therefore, the problem of deviation between dots during printing caused by difference in the scanning speed between ink heads can be eliminated.

According to another aspect of the present invention, an ink jet printer includes two shafts provided rotatably about two predetermined axes arranged at a predetermined distance, two struts fixed to the two shafts, respectively, to move along an arc about two axes with the rotation of the two shafts, an ink carriage having a plurality of ink heads provided at a predetermined position from the shaft of the two struts, and a control device controlling forwarding of a recording sheet, rotational motion of the two shafts, and ink jetting from the plurality of ink heads.

The two shafts, the ink carriage, and the two struts form a link mechanism. Accordingly, the ink carriage can move back and forth along arc. Therefore, even if the runway portion and the overrun portion of the same running distance as the conventional case are provided along the circular segment, the lateral widths of the runway portion and the overrun portion can be made smaller than those of the conventional ink jet printer. Thus, the ink jet printer can be reduced in size. Furthermore, the scanning speed of all the ink heads is identical since the ink carriage moves while maintaining the same posture. Therefore, the problem of deviation between dots during printing caused by difference in the scanning speed between ink heads is eliminated.

Preferably, the control device converts image data according to the curvature of the trajectory of the ink carriage moving back and forth along an arc to control forwarding of a recording sheet, rotational motion of the two shafts, and ink jetting from the plurality of ink heads according to the converted image data.

Therefore, there is the advantage that printing without arc-like distortion is allowed even if the ink carriage moves along an arc.

Further preferably, the control device sequentially prepares data of a predetermined number of lines corresponding to division of image data of one page. The control device converts the prepared data of a predetermined number of the lines according to the curvature of the trajectory of the ink carriage moving back and forth along an arc to control forwarding of a recording sheet, rotational motion of the two shafts and ink jetting from the plurality of ink heads according to the converted data.

Therefore, printing without arc-like distortion is allowed even in the case where image data can be obtained only for every one or plurality of lines such as image data obtained by facsimile and the like.

Further preferably, the ink jet printer includes a heat generator provided at the two struts.

The heat generator carries out a reciprocating arc motion in synchronization with the reciprocating arc motion of the ink carriage. By the heat output from the heat generator, the ink sprayed out on a recording sheet conveyed from the direction of the ink carriage towards the shaft can be dried in parallel to the printing operation. Since the heat generator per se carries out the motion, the entire recording sheet can be dried even if the heat generator is reduced in size. Therefore, power consumption and the amount of heat induced by the heat generator are reduced. An exhaust fan to discharge the heat outside is no longer required. Thus, a smaller ink jet printer can be provided.

Further preferably, the ink jet printer includes a heat generator provided at the leading end of the ink carriage.

The heat generator carries out a reciprocating arc motion in synchronization with the reciprocating arc motion of the ink carriage. Therefore, by the heat discharged from the heat generator, the ink sprayed out on a recording sheet conveyed from the direction of the shaft towards the ink carriage can be dried in parallel to the printing operation. Therefore, the heat generator can be reduced in size, which in turn allows the ink jet printer to be reduced in size. Since the heat generator per se carries out the motion, the entire recording sheet can be dried even if the heat generator is smaller in size. Thus, the power consumed by the heat generator and the amount of heat output from the heat generator can be reduced.

According to another aspect of the present invention, an ink jet printer includes a shaft provided rotatably about a predetermined axis, a strut fixed to the shaft to move along an arc about the axis with the rotation of the shaft, two parallel guide rails, an ink carriage including a plurality of ink heads and that can run along the two guide rails, and that has an opening with the longitudinal direction corresponding to the direction orthogonal to the running direction, and having the end of the strut fitted to allow movement in the opening, and a control device controlling forwarding of a recording sheet, arc motion of the strut, and ink jetting from the plurality of ink heads.

The ink carriage moves along the two guide rails to carry out printing while moving linearly. The scanning operation of the ink carriage is carried out by the strut moving back and forth along an arc. The reciprocating arc motion of the strut is divided into a vertical linear motion in which the strut moves along the opening of the ink carriage and a horizontal linear motion in which the ink carriage runs along the guide rail. Therefore, even if the runway portion and the overrun portion of the same running distance as the conventional case are provided along the circular segment, the lateral widths of the runway portion and the overrun portion can be made smaller than those of the conventional ink jet printer. Thus, the travel width of the ink carriage in the horizontal direction can be set smaller to allow reduction in the size of the ink jet printer.

Preferably, the control device controls forwarding of a recording sheet, arc motion of the strut, and ink jetting from the plurality of ink heads according to image data.

The ink carriage is controlled according to the image data. Therefore, by providing control so that the ink carriage is moved only along the region where printing is carried out and suppressing travel of the ink carriage where printing is not carried out, extra motion of the ink carriage is eliminated to allow high speed printing.

Further preferably, the control device controls forwarding of a recording sheet, the arc motion of the strut, and ink jetting from the plurality of ink heads according to the size of the recording sheet.

Therefore, the operation range of the ink carriage for printing can be limited to that within the recording sheet to eliminate extra motion of the ink carriage. Therefore, printing can be carried out at a high speed.

Further preferably, the portion of the two guide rails coupled with the ink carriage is formed of a ball bearing. The portion of the strut coupled with the ink carriage is formed of a ball bearing.

The junction of the two guide rails and the ink carriage and also the junction of the strut and the ink carriage are respectively formed of ball bearings. Accordingly, abrasion of these junctions is prevented to allow smooth travel of the ink carriage.

According to still another aspect of the present invention, an ink jet printer includes a shaft provided rotatably about a predetermined axis, a strut fixed to the shaft so as to move along an arc about the axis with the rotation of the shaft, an ink carriage having a plurality of ink nozzles spaying out ink in a direction parallel to the plane including the strut, and provided at a predetermined position from the shaft of the strut, and a sheet holding unit holding a sheet at the curvature defined by the relationship with the motion curvature of the ink carriage at a position opposite to the ink carriage.

Printing is carried out by the ink carriage moving along an arc. Therefore, the length of printing required in the horizontal direction can be reduced to allow reduction in the size of the ink jet printer. Also, complicated readout of image data is not required. Therefore, high-speed printout is allowed.

Preferably, the axial direction of the axis is in parallel with the direction of transportation of a sheet.

By this parallel arrangement, the direction of the motion of the ink carriage can be made orthogonal to the direction of transportation of a sheet. It is therefore not necessary to read out image data according to a complicated procedure to generate print data. Therefore, the printout speed can be improved.

Further preferably, the ink carriage has an ink eject plane where a plurality of ink nozzles are formed. The curvature of the ink eject plane is not more than the curvature of the sheet held by the sheet holding unit.

By such a curvature, the contact between the ink carriage and the sheet can be reduced. This provides the advantage that sheet jamming is relatively suppressed.

Further preferably, each of the plurality of ink nozzles ejects ink in the direction of the line connecting the center of the shaft and each ink nozzle.

This provides the advantage that the output direction of ink ejection and the direction of the centrifugal force is in coincidence. Therefore, control of the direction of ink ejection becomes easier. Additionally, the centrifugal force can be utilized in ink ejection to improve the ink ejection speed.

Further preferably, the ink carriage ejects ink by moving back and forth on the same line of a sheet.

By spraying out ink according to a reciprocation motion on the same line, a resolution two times that of ejecting ink at either the forward drive or the backward drive can be obtained.

The ink ejection timing of each of the plurality of ink nozzles is defined according to the distance from the center of the shaft to the ink nozzle, the distance between the ink carriage and the sheet, the position of the ink nozzle, and the speed of ink.

The ink hit position can be calculated according to various parameters. Accordingly, the ink ejection timing can be defined correctly.

Further preferably, the plurality of ink nozzles are arranged on a crossing line between the plane orthogonal to the direction of motion of the ink carriage and the ink eject plane.

By providing the ink nozzles in one row in a direction perpendicular to the direction of motion of the ink carriage, the printing resolution is defined depending on only the travel angle of the ink head.

Further preferably, a sheet size sensor that senses the size of a sheet is further provided. The swing angle of the strut is defined according to the output of the sheet size sensor. Therefore, unnecessary overrunning of the ink carriage can be prevented to allow efficient printout.

Further preferably, the sheet holding unit includes a transportation guide having a cross section of an arc with a concave plane opposite to the ink carriage, and a plurality of transportation rollers arranged to sandwich a sheet with a plane of the transportation guide opposite to the ink carriage.

The sheet is transported by a plurality of transportation rollers arranged circularly along the inner side of the transportation guide. Therefore, the sheet can be transported properly without meander.

Further preferably, the plurality of transportation rollers are jointly driven in the direction of motion of the ink carriage. This provides the advantage that the sheet can be transported uniformly. Therefore, sheet meander and delay in transportation to a certain position can be prevented.

Further preferably, each of the plurality of transportation rollers has a fusiform shape with a curvature smaller than the curvature of the sheet.

This provides the advantage that buckling of the sheet caused by contact with the end of a transportation roller can be prevented.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

An ink jet printer which is an embodiment of the present invention will be described hereinafter with reference to the drawings.

First Embodiment

Figure 1:
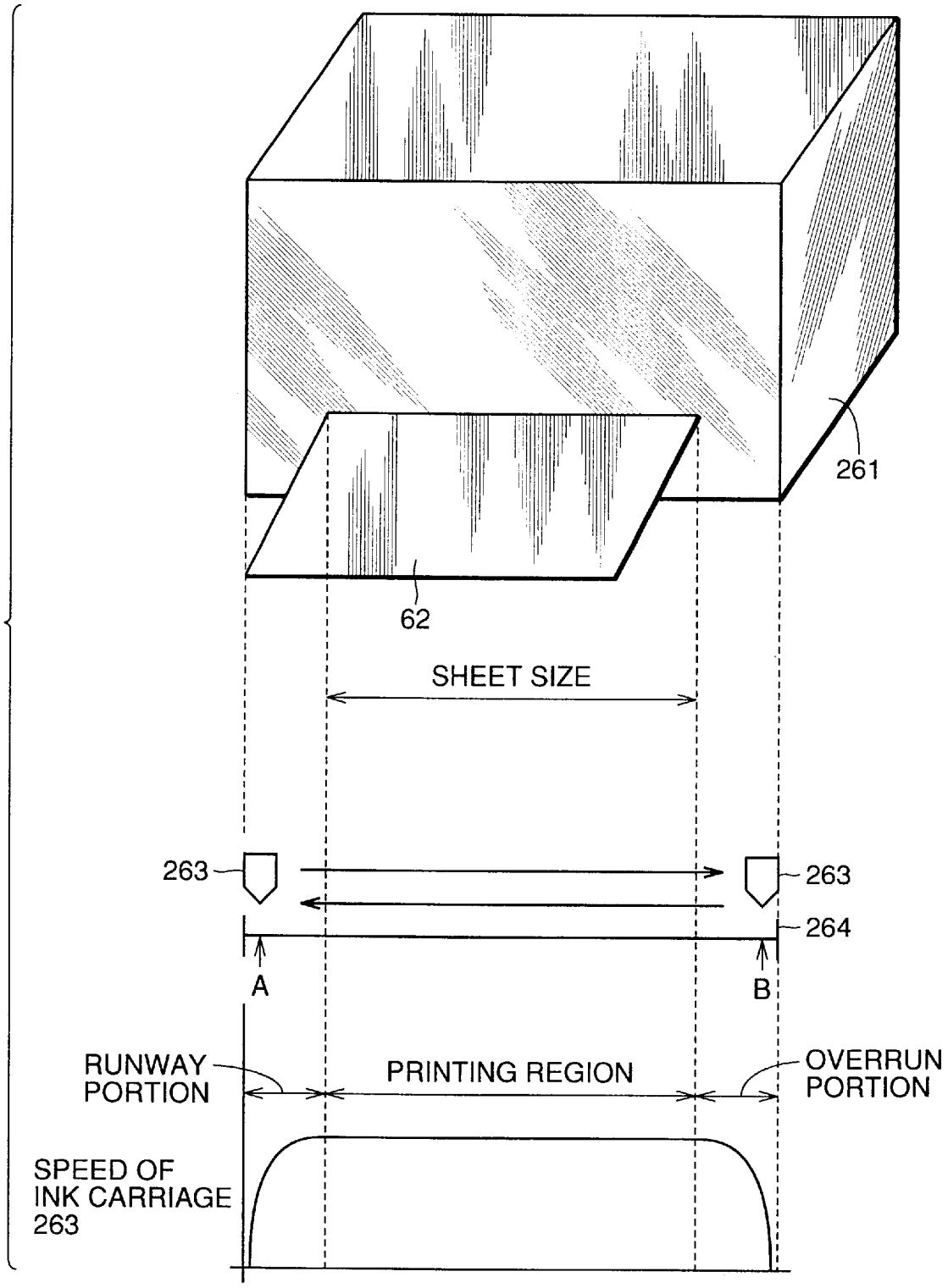
FIG. 1 PRIOR ART
FIG. 1 is a diagram to describe a runway portion, a printing region, and an overrun portion of a conventional ink jet printer.
Figure 2:
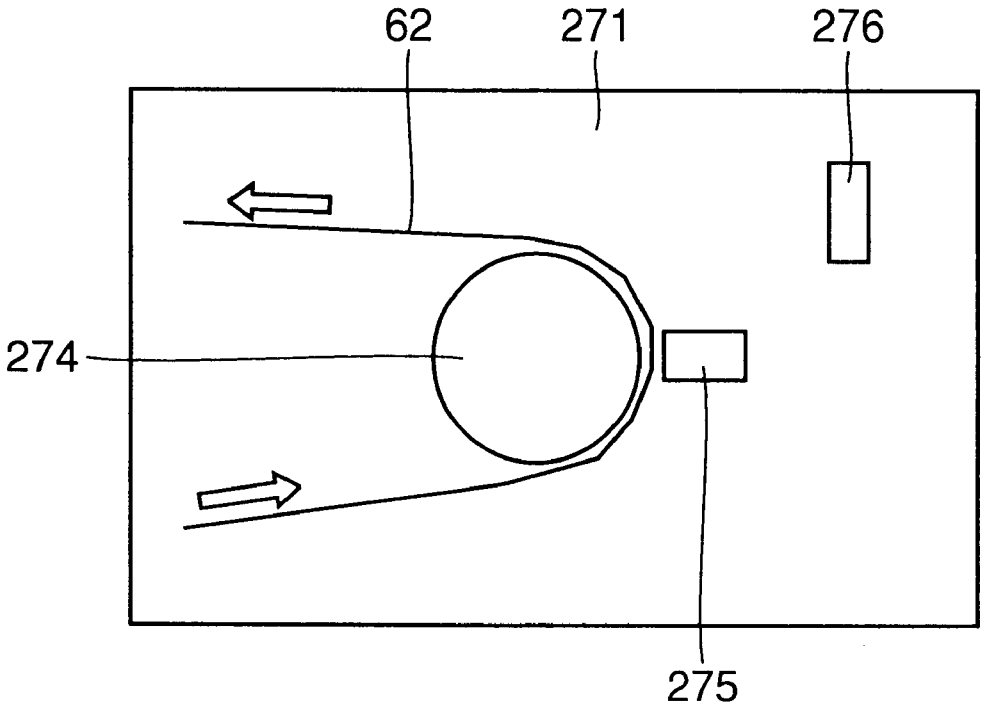
FIG.2 PRIOR ART
FIG. 2 is a side view of the interior of a conventional ink jet printer.
Figure 3:
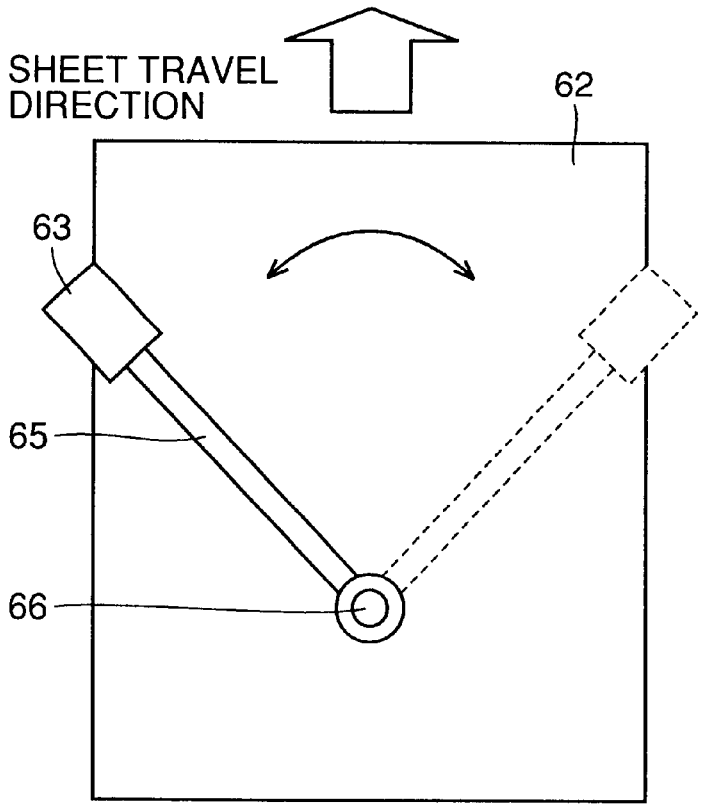
FIG. 3 is a top view of the interior of an ink jet printer according to a first embodiment of the present invention.
Figure 4:
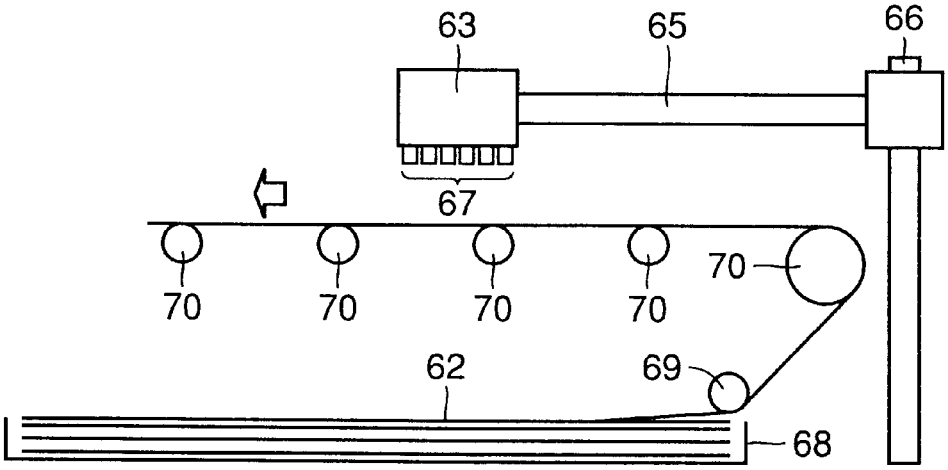
FIG. 4 is a side view of the interior of the ink jet printer of the first embodiment.

Referring to FIGS. 3 and 4, an ink jet printer according to a first embodiment of the present invention includes a shaft 66, an ink carriage 63 having a plurality of ink heads 67, a strut 65 having one end rotatably connected to shaft 66 and the other end fixed to ink carriage 63, a sheet tray 68 to store recording sheets 62, a pickup roller 69 to take out a recording sheet 62 from sheet tray 68 one at a time, a transportation roller 70 to sequentially convey recording sheet 63 taken out by pickup roller 69, and a control device (not shown) to control forwarding of recording sheet 62, the motion of ink carriage 63, and ink jetting from ink head 67.

Ink carriage 63 includes an ink bottle and the like to store ink in addition to ink head 67.

Figure 5:
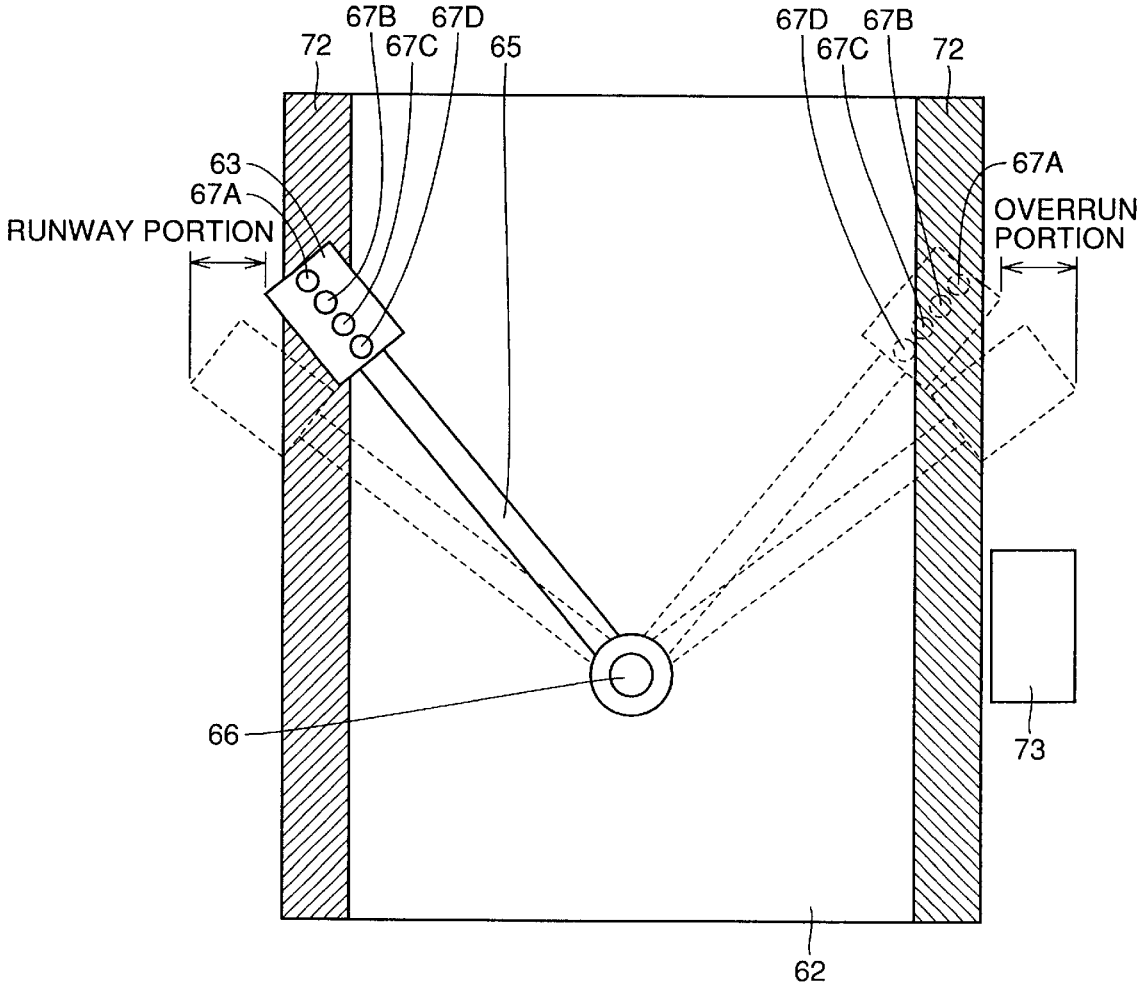
FIG. 5 is a diagram to describe the printing region of an ink head 67.

The printing region by ink head 67 will be described with reference to FIG. 5. The reciprocating arc motion, i.e., back and forth swing, of strut 65 about shaft 66, causes ink carriage 63 mounted at the leading end of strut 65 to move back and forth along an arc. By this reciprocating arc motion, an image is sequentially printed on recording sheet 62. The motion range of ink carriage 63 in a printing operation is defined so that ink head 67A located farthest from shaft 66 covers recording sheet 63. The runway portion and overrun portion of ink carriage 63 are provided outside the printing motion range of ink carriage 63. When ink head 67A is located corresponding to the runway portion or the overrun portion, ink heads 67B–67D located closer to shaft 66 than ink head 67A do not spray out ink. For example, the region where ink head 67D does not spray out ink on a recording sheet 62 is depicted as the hatched region 72 in FIG. 5. A maintenance mechanism 73 to clean ink head 67 and the like are provided on the overrun portion in the ink jet printer.

According to the ink jet printer of the present embodiment, the scanning trajectory of ink carriage 63 represents an arc, i.e., a circular segment. Therefore, the scanning speed differs for each ink head 67. If the ink ejection cycle from all ink heads 67 is identical, deviation between printed dots will occur due to difference in the scanning speed. Therefore, the control device provides control to alter the ink ejection cycle for each of ink heads 67A–67D. More specifically, the ink ejection cycle is delayed as towards ink head 67A from ink head 67D to solve the problem of deviation between printed out dots.

Figure 6:
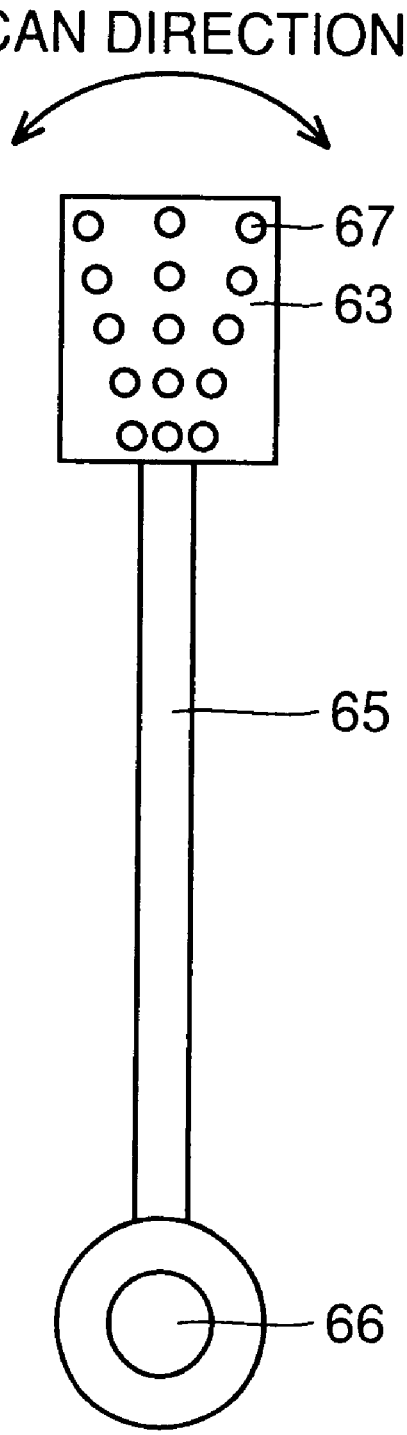
FIG. 6 is a diagram to describe the arrangement of ink heads 67.

Referring to FIG. 6, ink heads 67 are arranged radially from shaft 66. This arrangement allows ink heads 67 to be arranged in a honeycomb manner. Accordingly, the number and density of ink heads 67 arranged in ink carriage 63 can be increased.

In the above-described ink jet printer, ink carriage 63 carries out an arc motion. Therefore, even if the runway portion and the overrun portion of the same running distance as the conventional case are provided along the circular segment, the lateral widths of the runway portion and the overrun portion can be made smaller than those of the conventional ink jet printer. Therefore, the ink jet printer can be reduced in size.

Maintenance mechanism 73 is provided on a line of extension of the scanning trajectory of ink carriage 63 that carries out an arc motion. However, the motion width of ink carriage 63 in the horizontal direction can be defined by the radius of the arc motion, i.e., the length from shaft 66 to the leading end of ink carriage 63. Therefore, the motion width of ink carriage 63 in the horizontal direction can be suppressed to approximately two time the length from shaft 66 to the leading end of ink carriage 63 even if maintenance mechanism 73 is provided. Therefore, a compact ink jet printer can be provided.

Second Embodiment

Figure 7:
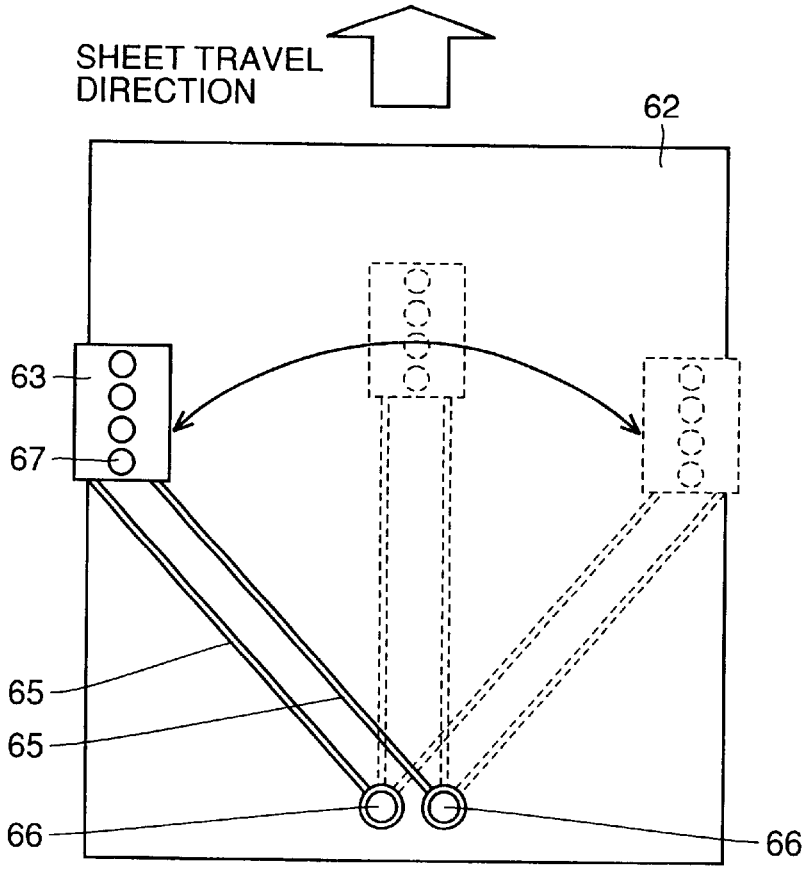
FIG. 7 is a top view of the interior of an ink jet printer according to a second embodiment of the present invention.
Figure 8:
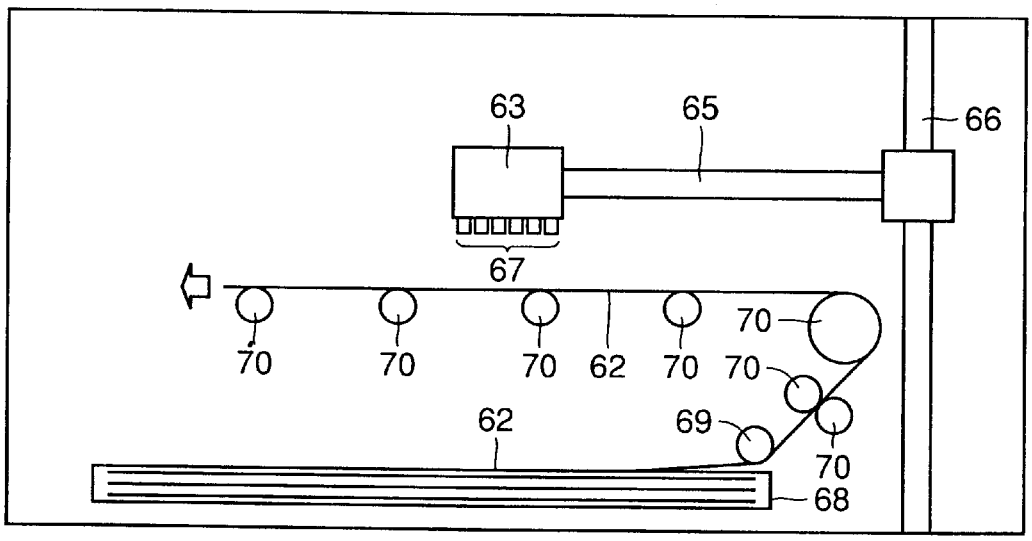
FIG. 8 is a side view of the interior of the ink jet printer of the second embodiment.

Referring to FIGS. 7 and 8, an ink jet printer according to a second embodiment of the present invention includes two shafts 66 arranged at a predetermined distance, an ink carriage 63 having a plurality of ink heads 67, two struts 65 having one ends rotatably attached to respective shafts 66 and the other ends rotatably connected to ink carriage 63 with a predetermined distance therebetween, a sheet tray 68 for storing recording sheets 62, a pickup roller 69 to take out a recording sheet 62 from recording tray 68 one at a time, a transportation roller 70 to sequentially transport recording sheet 62 taken out from pickup roller 69, a control device (not shown) to control forwarding of recording sheet 62, the motion of ink carriage 63 and ink jetting from ink head 67, and a reception device (not shown) to receive image data.

Ink carriage 63 includes an ink bottle and the like to store ink in addition to ink head 67.

Figure 9:
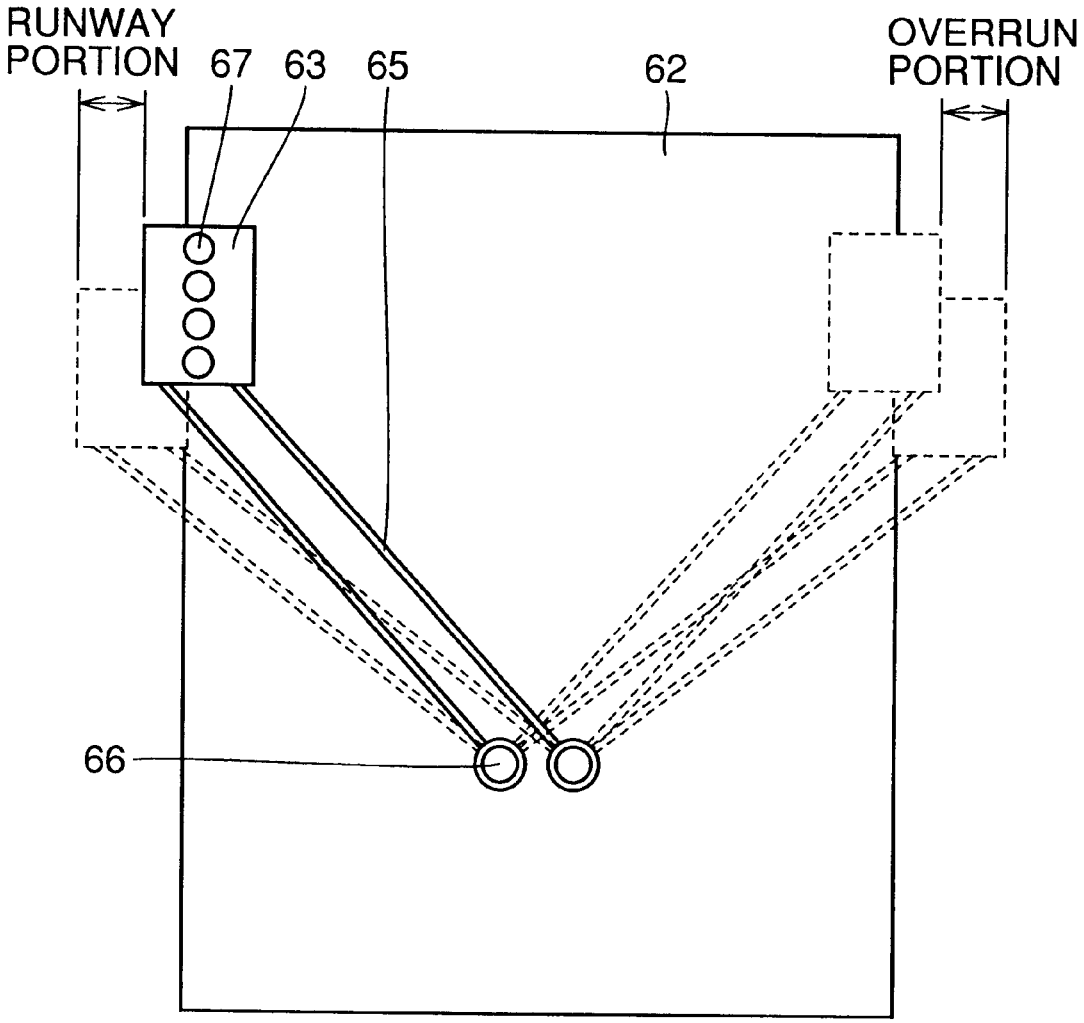
FIG. 9 is a diagram to describe the runway portion and the overrun portion of ink carriage 63.

The two shafts 66, the two struts 65 and ink head 67 form a link mechanism. By respective reciprocating arc motions of the two struts 65 about the two shafts 66, ink carriage 63 can carry out a reciprocating arc motion while maintaining the same posture as shown in FIG. 7. Also, a runway portion and overrun portion of ink carriage 63 are provided outside the range of the printing motion of ink carriage 63, as shown in FIG. 9.

Figure 10A:
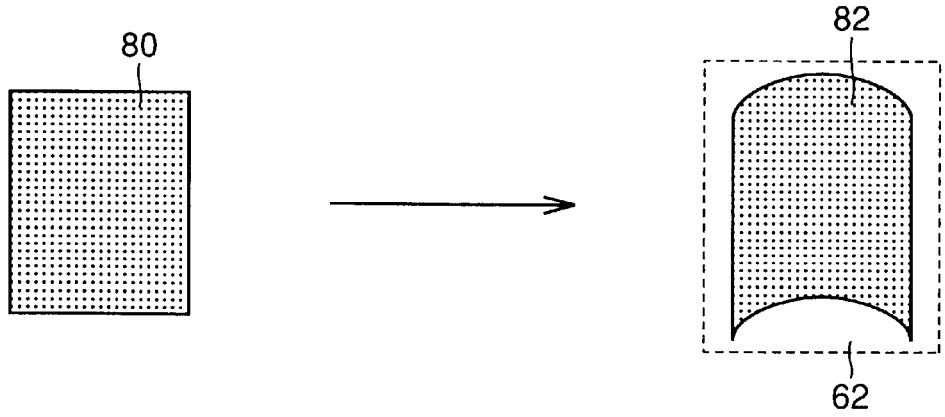
FIGS. 10A and 10B are diagrams to describe conversion of image data.
Figure 10B:
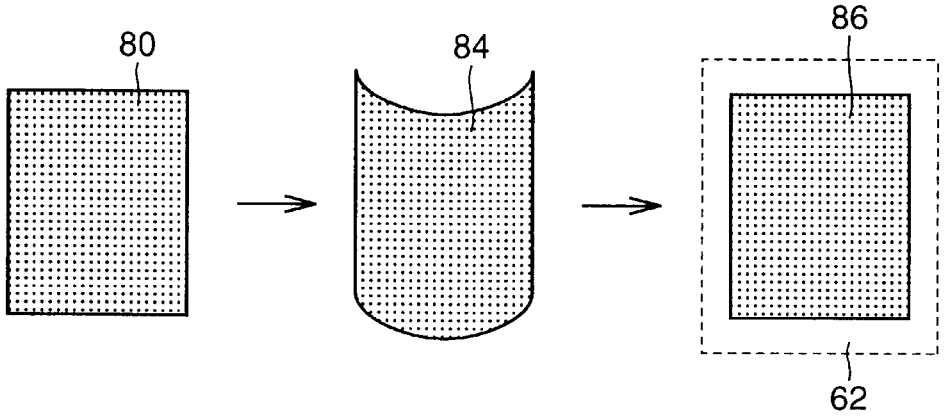

Referring to FIG. 10A, when image data 80 received by the reception device is used intact to printout onto recording sheet 62 by the ink jet printer of the present embodiment, an image with arc-like distortion as indicated by printing result 82 will be formed since the scanning trajectory of ink carriage 63 represents an arc. Therefore, referring to FIG. 10B the control device corrects image data 80 to produce print image data 84 from which printing is carried out on recording sheet 62. Accordingly, a printed result 86 eliminated of distortion is formed on recording sheet 62.

Figure 11A:
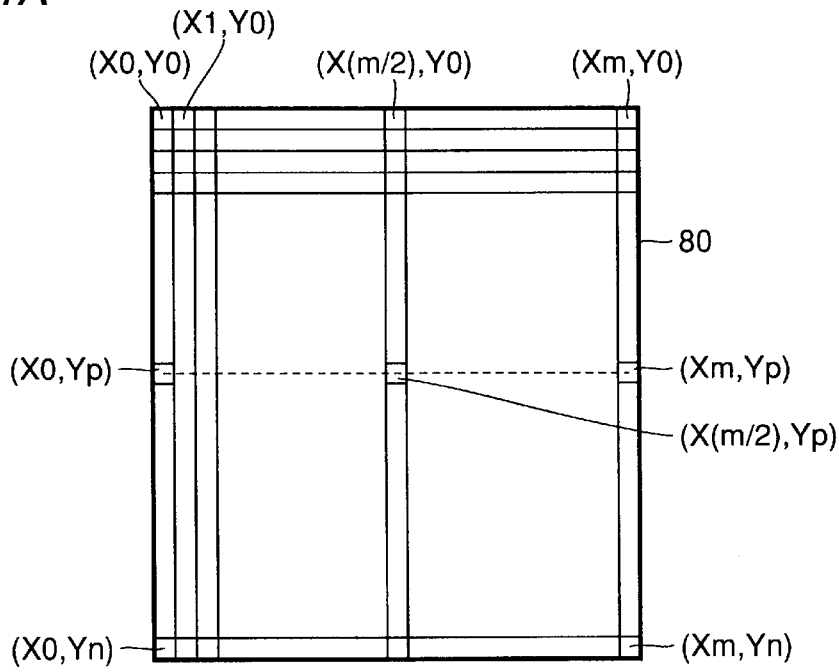
FIGS. 11A and 11B are diagrams to describe the method of producing print image data.
Figure 11B:
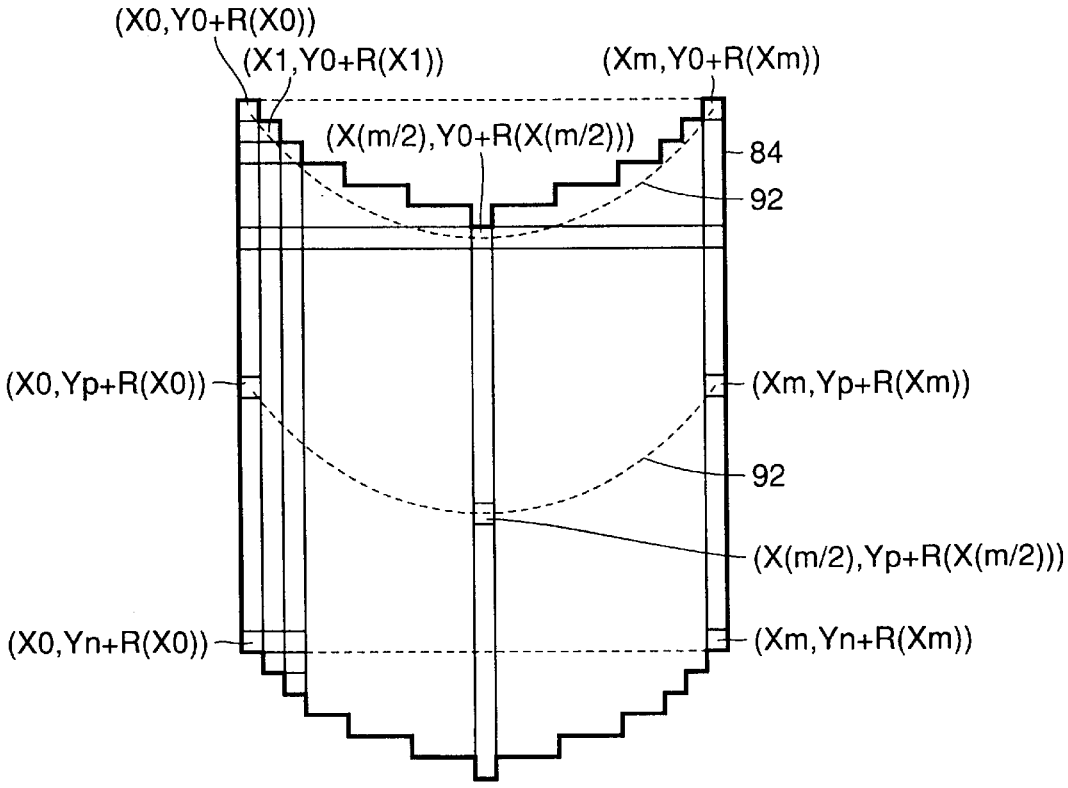

The method of producing print image data 84 will be described with reference to FIGS. 11A and 11B. Image data 80 received by the reception device corresponds to image data of a rectangle with (X0, Y0)–(Xm, Yn) as a diagonal. The coordinates on print image data 84 corresponding to coordinates (Xp, Yp) in image data 80 can be represented as (Xp, Yp+R(Xp)). In other words, the Y coordinates is altered by a value R(Xp) defined by a coordinate value Xp whereas the X coordinate does not change. The line passing through (X0, Y0), (X(m/2), Y0) and (Xm, Y0) on image data 80 is converted into a concave arc curved line passing through (X0, Yp+R(X0)), (X(m/2), Yp+(R (X(m/2)))) and (Xm, Yp+R(Xm)) on print image data 84. The curvature of this concave arc curved line is identical to the curvature of the convex arc curved line corresponding to the scanning trajectory of ink carriage 63.

By carrying out printing based on print image data 84 obtained as described above, an image absent of arc-like distortion can be formed on recording sheet 62 transported in the direction from shaft 66 towards ink carriage 63.

The printing operation of the ink jet printer will be described with reference to FIG. 12. The control device clears the memory for reception (not shown) provided in the ink jet printer to receive image data 80 and the memory for printing (not shown) in which print image data 84 is stored (S1).

The reception device receives and stores image data 80 of one page in the reception memory (S2). When the received image data 80 does not correspond to bit map data, a process for conversion into bit map data is applied.

The control device converts image data 80 of one page into print image data 84 according to the above-described method, and then stores print image data 84 in the print memory (S3).

The control device sets the value of a counter (not shown) to 1 (S4). The control device reads out print image data D(t) required for one scan of ink carriage 63 from the print memory, and printing is carried out according to print image data D(t) (S5). This print image data D(t) will be described afterwards.

The control device determines whether printing of one page has been completed or not (S6). When printing of one page has ended (YES at S6), the printing process ends. When the printing of one page has not yet ended (NO at S6), the counter is incremented by one (S7), and the process of S4 onward is repeated.

Print image data D(t) will be described with reference to FIG. 13. Assuming that the number of pixels required in one scanning operation of ink carriage 63 is h in the Y direction (the transportation direction of recording sheet 62), print image data D(t) required at the t-th scanning operation of ink carriage 63 corresponds to data of a rectangular region with (x0, y(h×(t−1)))−(xm, y(h×t−1)) in print image data 84 as the diagonal.

When the reception device is connected to a scanner, a facsimile, or the like, image data is received for every one line or every several lines. In this case, the printing speed can be improved since a printing operation can be carried out while receiving image data. Since it is no longer necessary to wait for the reception and storage of image data of one complete page, the running cost of the ink jet printer can be reduced.

The operation of carrying out printing while receiving data will be described with reference to FIG. 14. The control device clears the print memory (S11), and then clears the reception memory (S12). The control device determines whether reception of image data 80 of one page has ended or not (S13). When reception of image data 80 of one page is not yet ended (NO at S13), the reception device receives and stores image data 80 of one line into the reception memory (S14). When the received image data 80 is not bit map data, a process for conversion into bit map data is applied.

The control device converts image data 80 of one line according to the above-described method, and then additionally stores the converted data into the print memory (S15).

The control device determines whether print image data 84 required for one scanning operation of ink carriage 63 has been accumulated in the print memory (S16). When print image data 84 required for one scanning operation has not yet been stored (NO at S16), control returns to S12 to repeat the process of S12 onward until print image data 84 required for one scanning operation has been accumulated.

When print image data 84 required for one scanning operation has been accumulated (YES at S16), the control device reads out print image data D(1) from the print memory to carry out printing according to print image data D(1) (S17).

For the next printout, the control device sequentially stores print image data D(t) as print image data D(t−1) until there is no more print image data D(t) (t≧2) stored in the print memory (S18). In other words, the data to be printed next is stored as print image data D(1). Then, the process of S12 is repeated.

When reception of image data 80 of one page has ended (YES at S19), the control device determines whether there is print image data D(1) remaining(S19). When there is no more print image data D(1) (NO at S19), the control device ends the process. When there is more print image data D(1) (YES at S19), the control device reads out print image data D(1) from the print memory to carry out printing (S20). Then, the process ends.

In the above-described ink jet printer, ink carriage 63, two struts 65 and shafts 66 form a link mechanism. Therefore, ink carriage 63 can carry out a reciprocating arc motion under the same posture. Therefore, even if the runway portion and the overrun portion of the same running distance as the conventional case are provided along the circular segment, the lateral widths of the runway portion and the overrun portion can be made smaller than those of the conventional ink jet printer. Therefore, the size of the ink jet printer can be reduced. Furthermore, the scanning speed of all ink heads 67 is identical since ink carriage 63 moves while maintaining the same posture. Therefore, the problem of deviation between dots during printing caused by difference in the scanning speed between ink heads 67 is eliminated.

The printing process is carried out after the image data is converted according to an arc on the basis of the curvature of the trajectory of the reciprocating arc motion of ink carriage 63. Therefore, printing with no arc-like distortion is allowed even when ink carriage 63 moves along an arc.

When image data can be obtained only for every one line or every several lines such as image data obtained via facsimile and the like, image data is received and subjected to the conversion process for every one line or a plurality of lines, followed by a print process. Accordingly, the capacity of the reception memory can be reduced.

Third Embodiment

Figure 15:
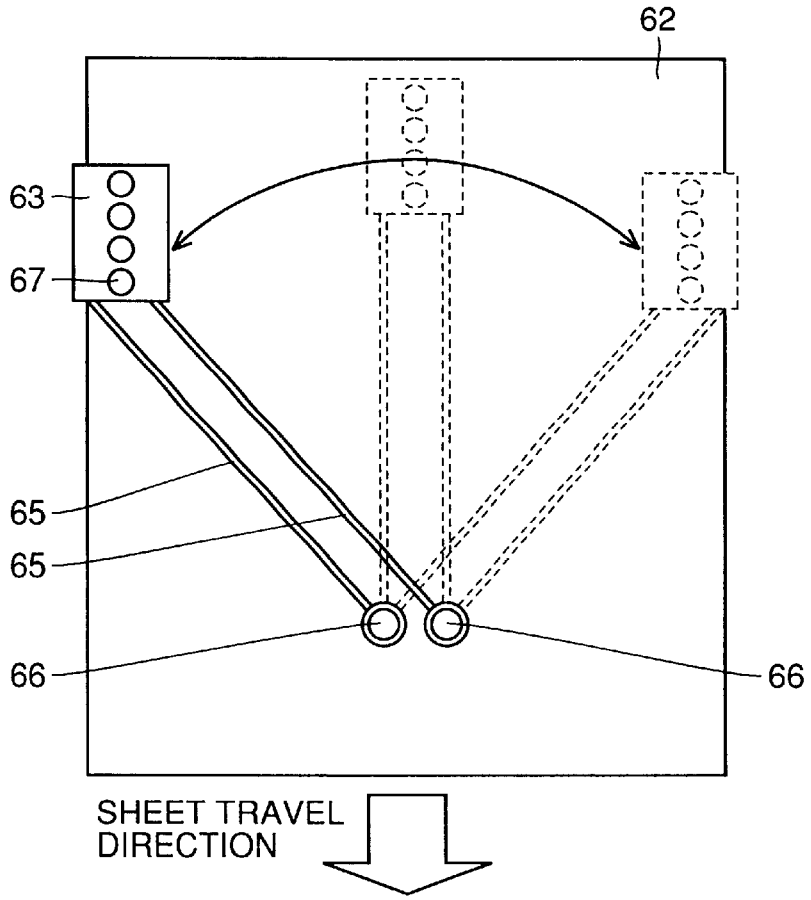
FIG. 15 is a top view of the interior of an ink jet printer according to a third embodiment of the present invention.
Figure 16:
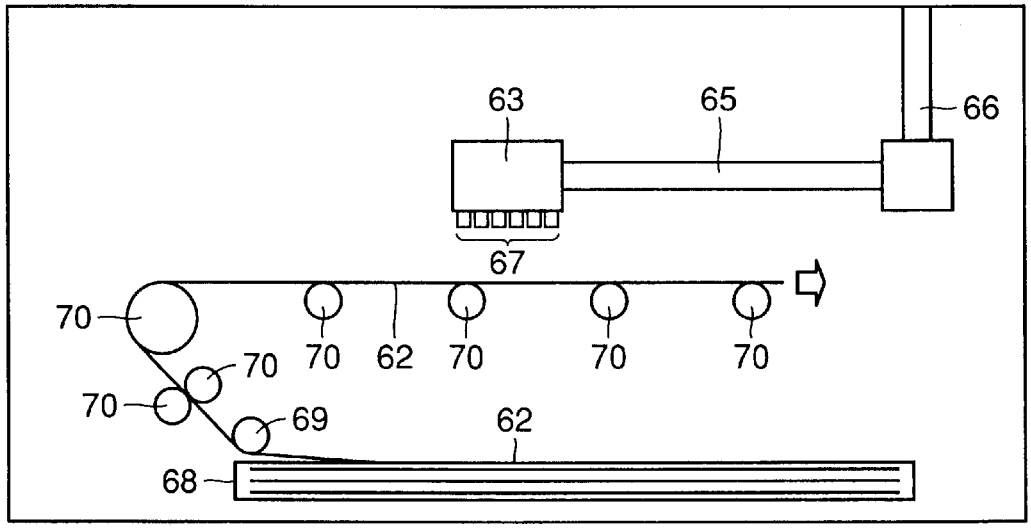
FIG. 16 is a side view of the interior of an ink jet printer according to the third embodiment.

Referring to FIGS. 15 and 16, an ink jet printer according to a third embodiment of the present invention includes two shafts 66 arranged at a predetermined distance, an ink carriage 63 having a plurality of ink heads 67, two struts 65 having one ends respectively coupled rotatably to two shafts 66 and the other ends rotatably coupled to ink carriage 63 with a predetermined distance, a sheet tray 68 to store recording sheets 62, a pickup roller 69 to take out a recording sheet 62 one at a time from sheet tray 68, a transportation roller 70 to sequentially convey recording sheet 62 output from pickup roller 69, a control device (not shown) to control forwarding of recording sheet 62, the motion of ink carriage 63, and ink jetting from ink head 67, and a reception device (not shown) to receive image data.

Ink carriage 63 includes an ink bottle and the like to store the ink in addition to ink head 67.

The ink jet printer of the present embodiment differs in the travel direction of printing sheet 62 from that of the ink jet printer of the second embodiment. More specifically, recording sheet 62 is shifted in the direction from shaft 66 to ink carriage 63 in the ink jet printer of the second embodiment whereas recording sheet 62 is shifted in the direction from ink carriage 63 to shaft 66 in the ink jet printer of the third embodiment.

Figure 17A:
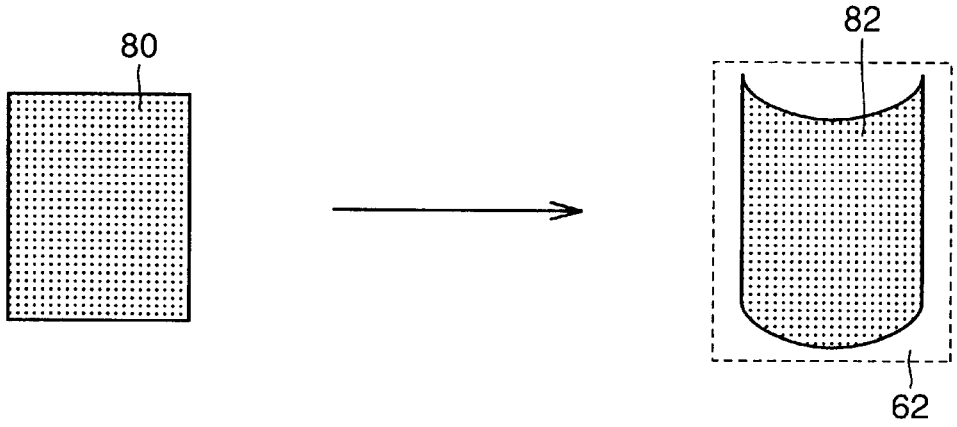
FIGS. 17A and 17B are diagrams to describe image data conversion.
Figure 17B:
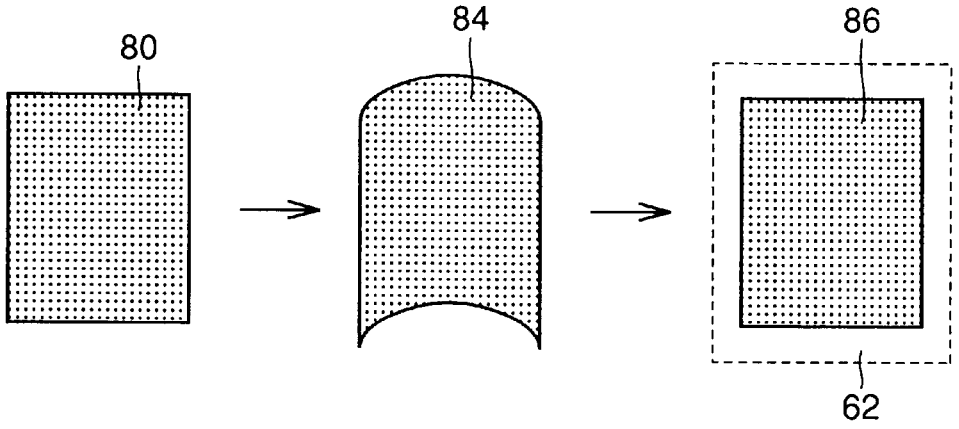

Referring to FIG. 17A, an image with arc-like distortion will be formed as shown by print result 82 if printing is carried out by the ink jet printer of the present embodiment using intact image data 80 received at the reception device since the scanning trajectory of ink carriage 63 corresponds to an arc. Therefore, the control device corrects image data 80 to generate print image data 84 from which printing is carried out on recording sheet 62. As a result, a print result 86 absent of distortion is formed on recording sheet 62, as shown in FIG. 17B.

Figure 18A:
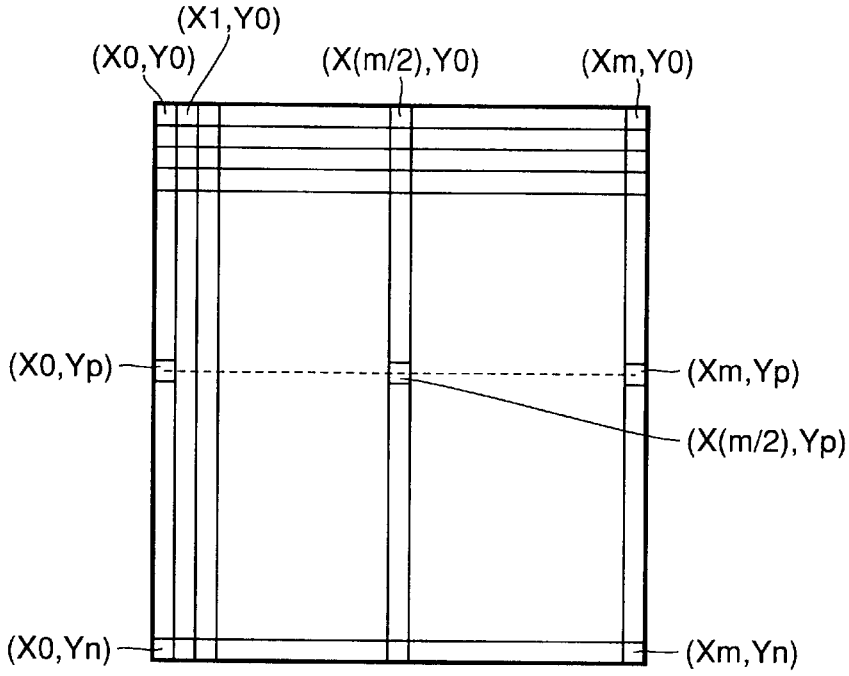
FIGS. 18A and 18B are diagrams to describe a method of producing print image data.
Figure 18B:
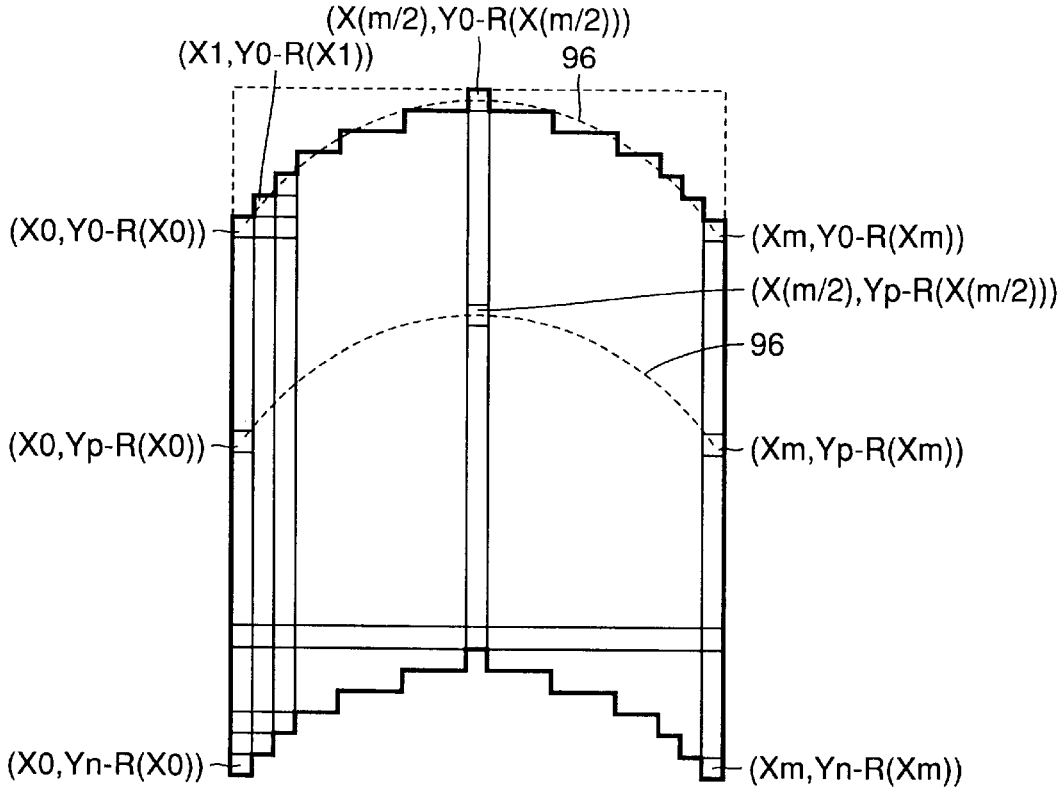

The method of producing print image data 84 will be described with reference to FIGS. 18A and 18B. Image data 80 received at the reception device corresponds to image data of a rectangle with (X0, Y0)–(Xm, Yn) as the diagonal. The coordinates on print image data 84 corresponding to coordinates (Xp, Yp) in image data 80 can be represented as (Xp, Yp–R(Xp)). In other words, the Y coordinates is altered by a value R(Xp) defined by the coordinate value Xp whereas there is no change in the X coordinates. The line passing through (X0, Y0), (X(m/2), Y0) and (Xm, Y0) on image data 80 is converted into a convex curved line passing through (X0, Yp–R(X0)), (X(m/2), Yp–(R (X(m/2)))) and (Xm, Yp–R(Xm)) on print image data 84. The curvature of this convex curved line is identical to the curvature of the convex curved line corresponding to the scanning trajectory of ink carriage 63.

By carrying out printing using print image data 84 obtained as described above, an image with no arc-like distortion can be formed similar to the received image data on recording sheet 62 conveyed in the direction from shaft 66 to ink carriage 63.

Figure 12:
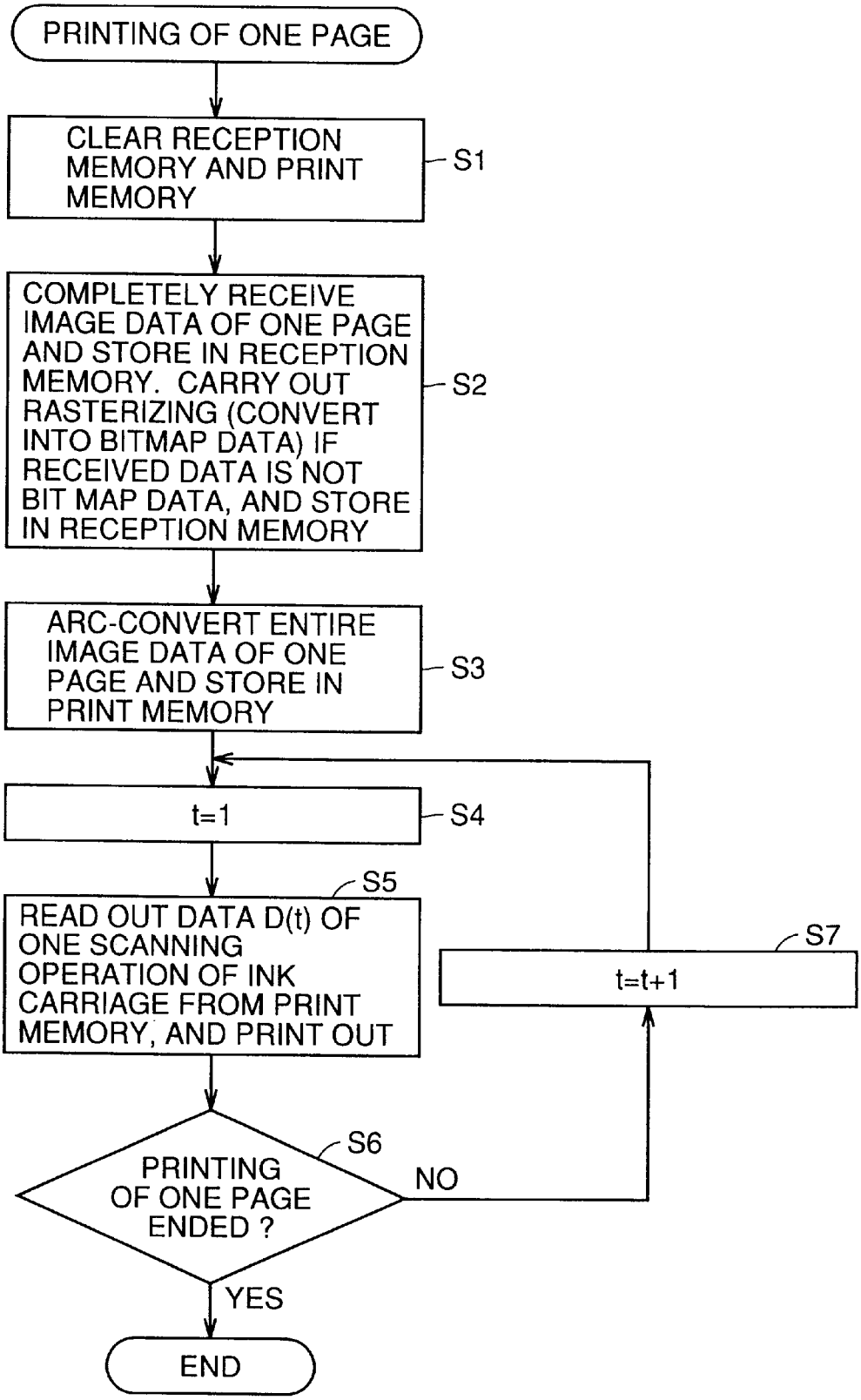
FIG. 12 is a flow chart of a printing operation of an ink jet printer.
Figure 13:
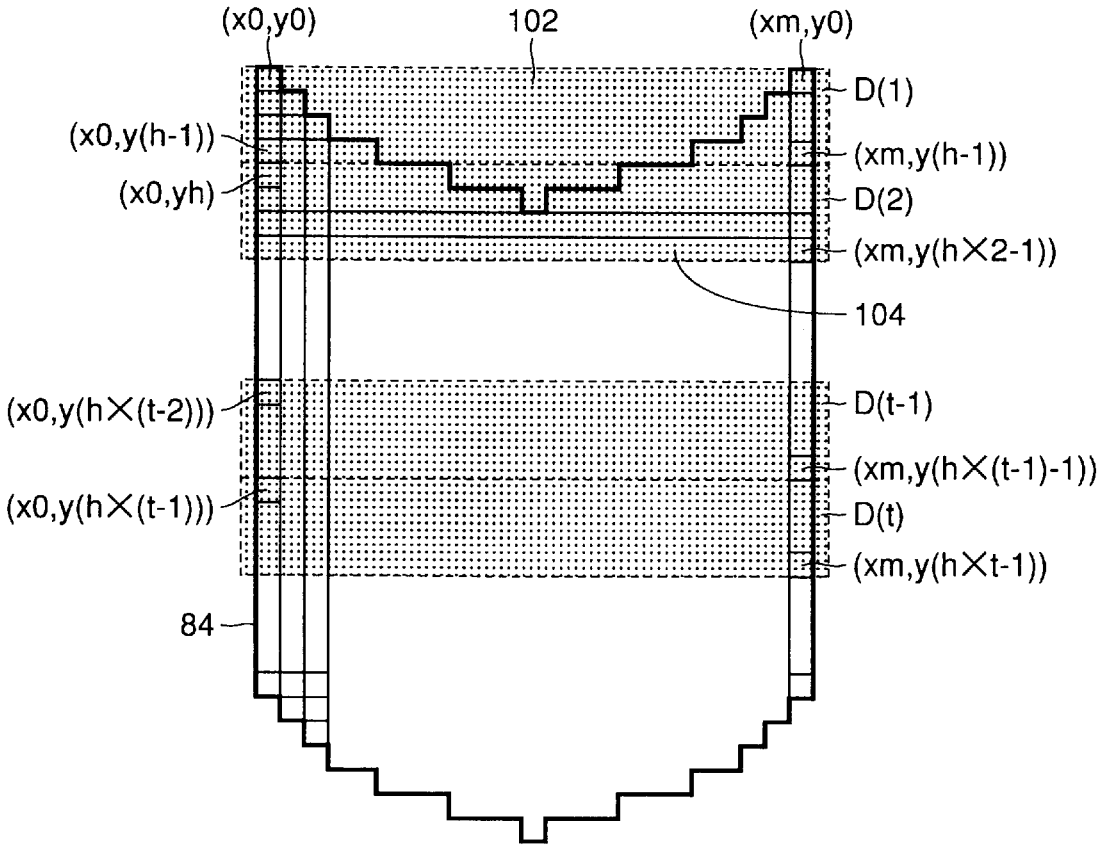
FIG. 13 is a diagram to describe print image data.
Figure 14:
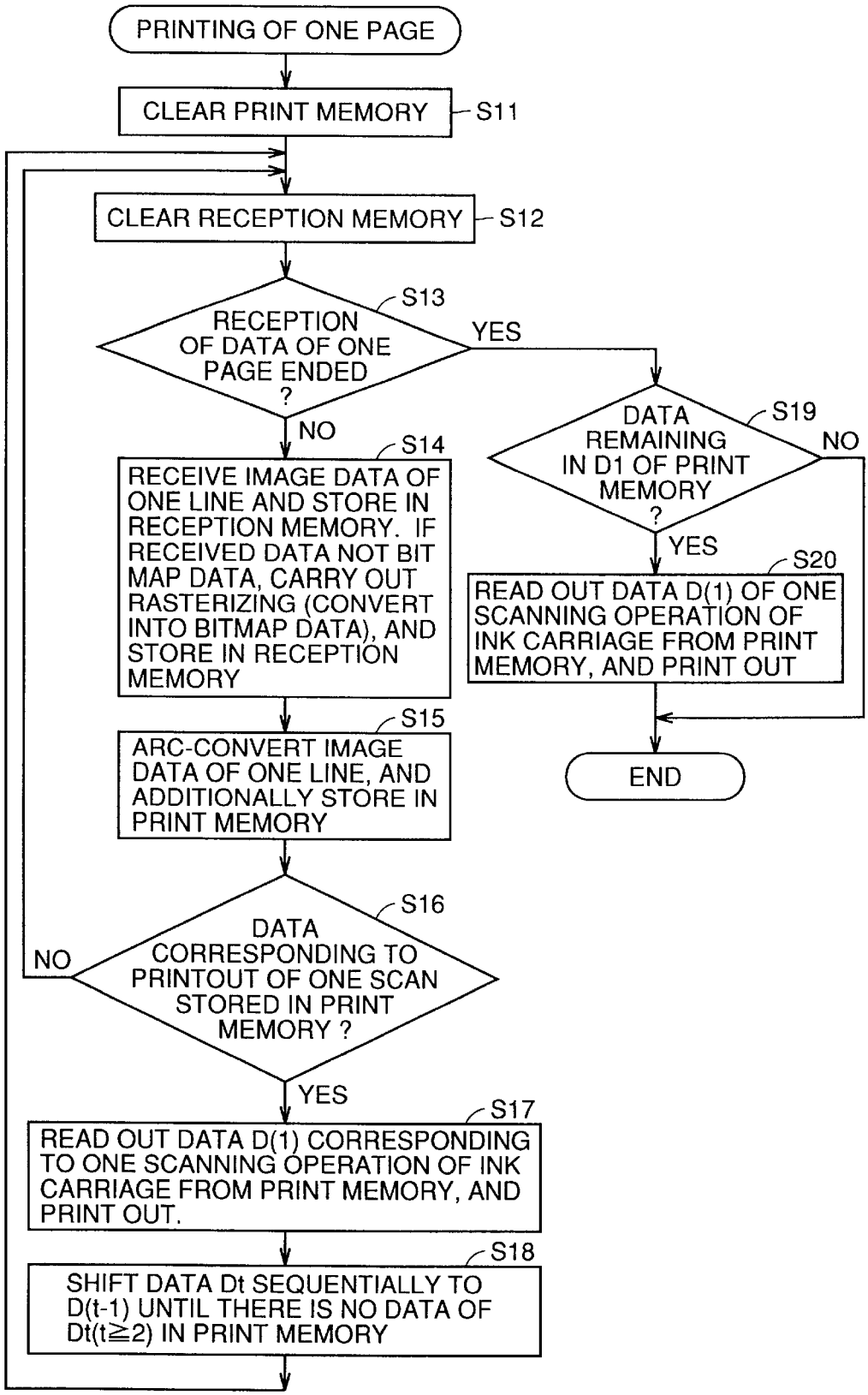
FIG. 14 is a flow chart of a printing operation while carrying out a reception operation of an ink jet printer.
Figure 19:
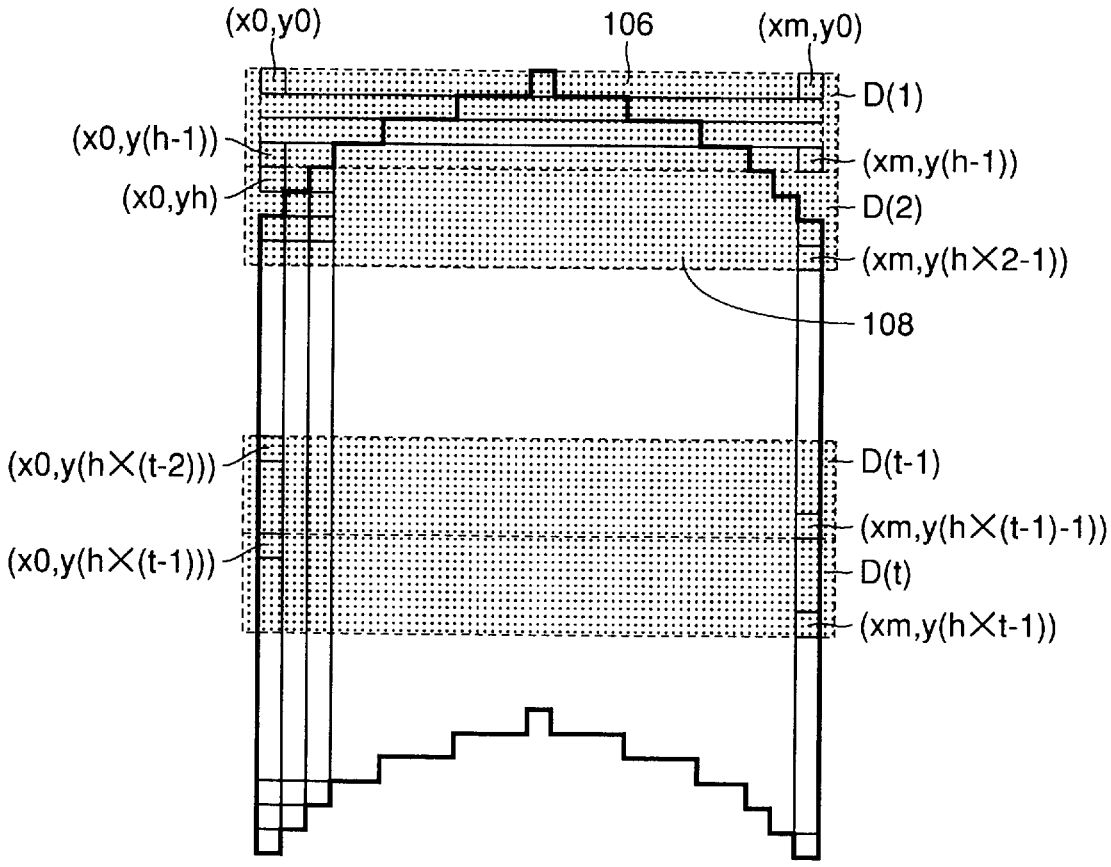
FIG. 19 is a diagram to describe print image data.

The printout operation by the ink jet printer of the present embodiment is similar to that of the second embodiment described with reference to FIGS. 12–14, provided that the method of generating print image data 84 is carried out as described above. Therefore, details of the printout operation will not be repeated. Print image data D(t) required in one scanning operation of ink carriage 63 for the process of S5 in FIG. 12 is shown in FIG. 19. More specifically, assuming that the number of pixels in the Y direction (the direction of transportation of recording sheet 62) required in one scanning operation of ink carriage 63 is h, print image data D(t) required in the t-th scanning operation of ink carriage 63 corresponds to data in a rectangular region with (x0, y(h×(t–1)))–(xm, y(h×(t–1))) of print image data 84 as the diagonal.

In the above-described ink jet printer, an arc motion is carried out with ink carriage 63 at the same posture. Therefore, even if the runway portion and the overrun portion of the same running distance as the conventional case are provided along the circular segment, the lateral widths of the runway portion and the overrun portion can be made smaller than those of the conventional ink jet printer. Thus, the ink jet printer can be reduced in size. Also, the running speed of all ink heads 67 is identical since ink carriage 63 is moved while maintaining the same posture. Therefore, the problem of deviation between dots during printing caused by difference in the scanning speed between ink heads 67 is eliminated.

The printout process is carried out after the image data is converted according to an arc on the basis of the curvature of the trajectory of the reciprocating arc motion of ink carriage 63. Therefore, printing with no arc-like distortion is allowed even if ink carriage 63 moves along an arc.

In the case where image data can be obtained only for every one line or every several lines such as image data obtained through facsimile and the like, the image data is received and subjected to conversion for every one line or every several lines, followed by a printing process. Accordingly, the capacity of the reception memory can be reduced.

Fourth Embodiment

Figure 20:
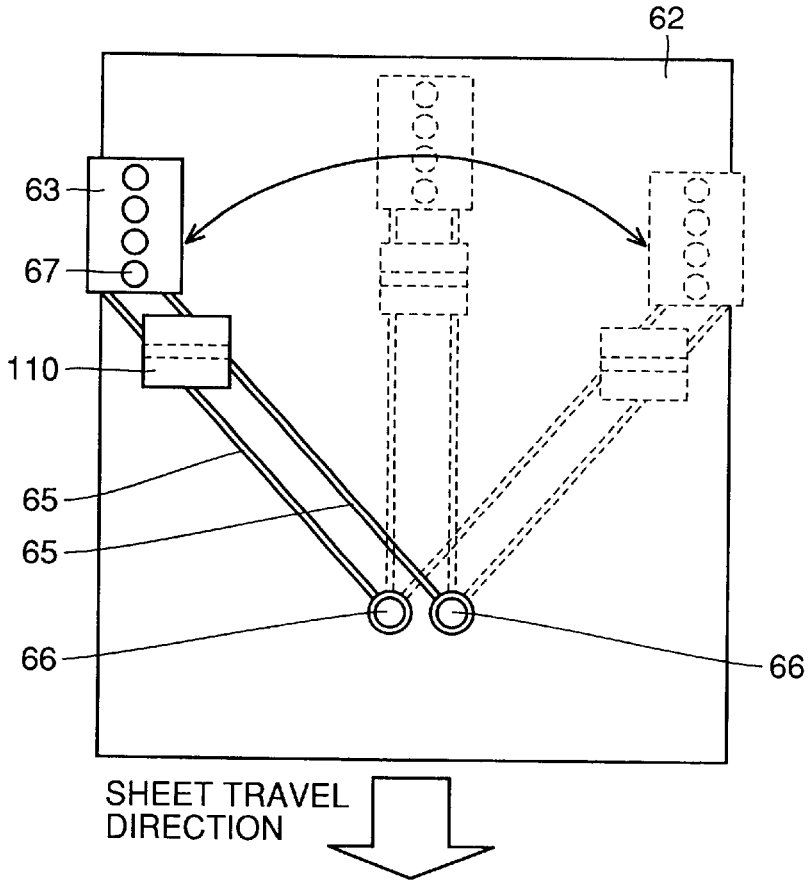
FIG. 20 is a top view of the interior of an ink jet printer according to a fourth embodiment of the present invention.
Figure 21:
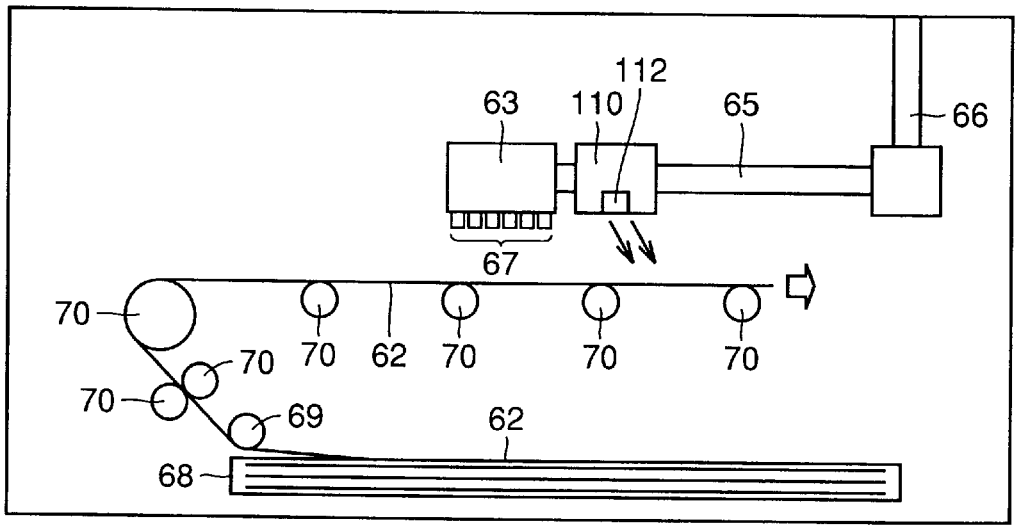
FIG. 21 is a side view of the interior of the ink jet printer of the fourth embodiment.

Referring to FIGS. 20 and 21, an ink jet printer according to a fourth embodiment of the present invention corresponds in structure to the ink jet printer of the third embodiment described with reference to FIGS. 15 and 16, further including a heat generator 110 provided at the two struts 65. Heat generator 110 generates hot air or infrared rays from a heat generation vent 112 to dry ink on recording sheet 62.

The method of producing print image data and the printout operation of the ink jet printer of the fourth embodiment are similar to those of the third embodiment. Therefore, description thereof will not be repeated.

Figure 22:
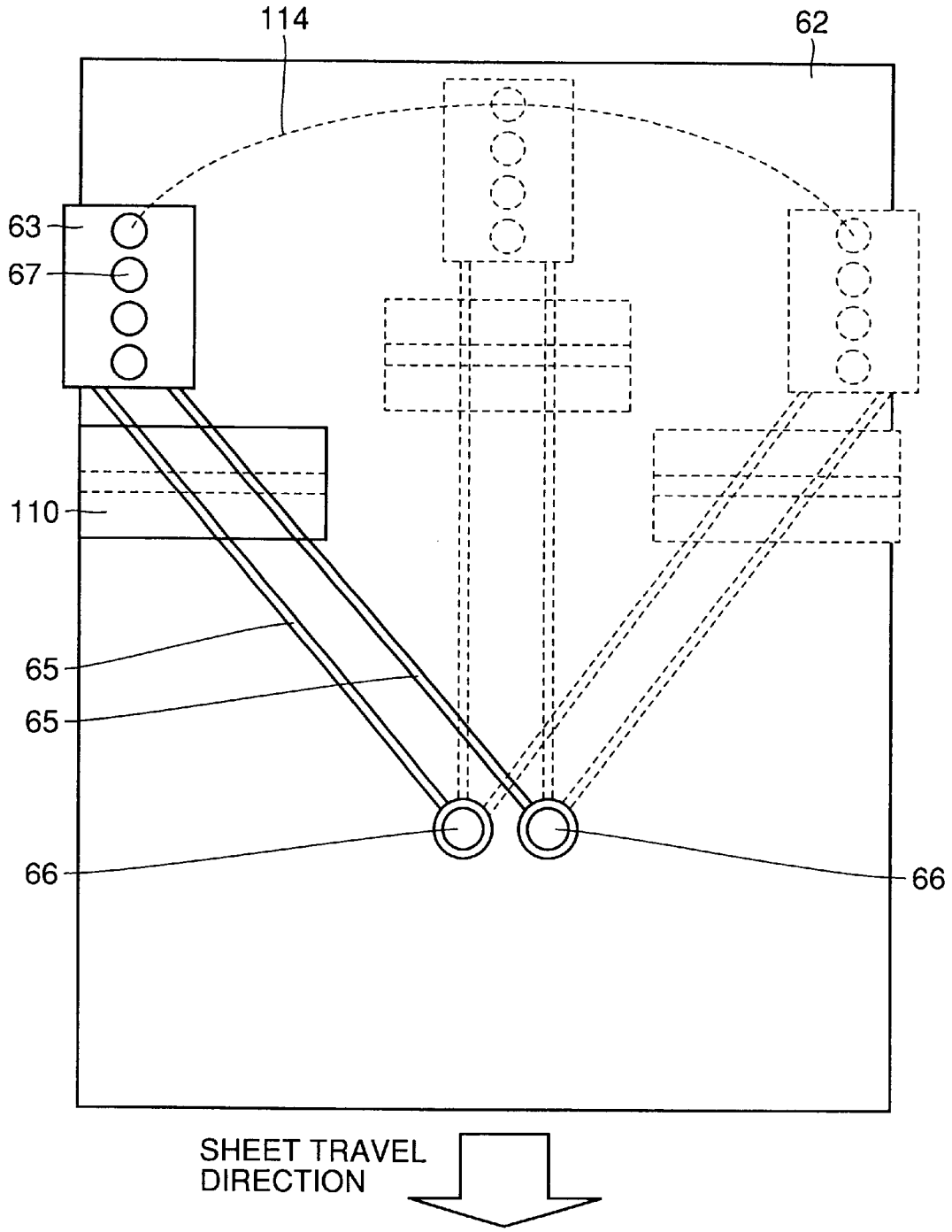
FIG. 22 is a diagram to describe the size of a heat generator.
Figure 23:
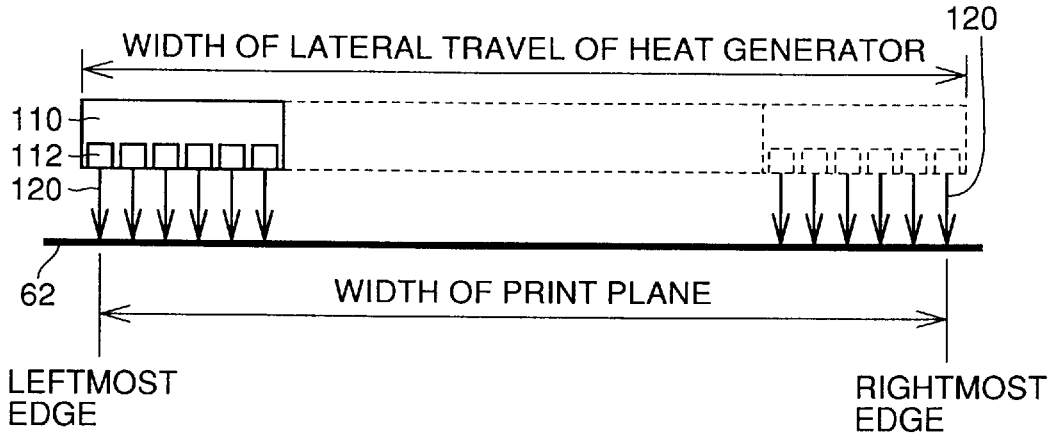
FIG. 23 is a diagram to describe the direction of heated air generated from the heat generator.

Referring to FIG. 22, print ink on recording sheet 62 output from ink carriage 63 is dried by the heat generated from heat generation vent 112 of heat generator 110 when located beneath heat generator 110 according to transportation of recording sheet 62. Referring to FIG. 23, the heated air is directed downwards as shown by arrow 120. Heat generator 110 dries ink on recording sheet 62 by moving back and forth along an arc similar to the motion of ink carriage 63. It is to be noted that the radius of the reciprocating arc motion of heat generator 110 is smaller than the radius of the reciprocating arc motion of ink carriage 63. The lateral width of heat generator 110 is defined so that heated air can be delivered up to the left and right corners of the print region of recording sheet 62 when ink carriage 63 is located at respective leftmost and rightmost ends of the print region.

Figure 24:
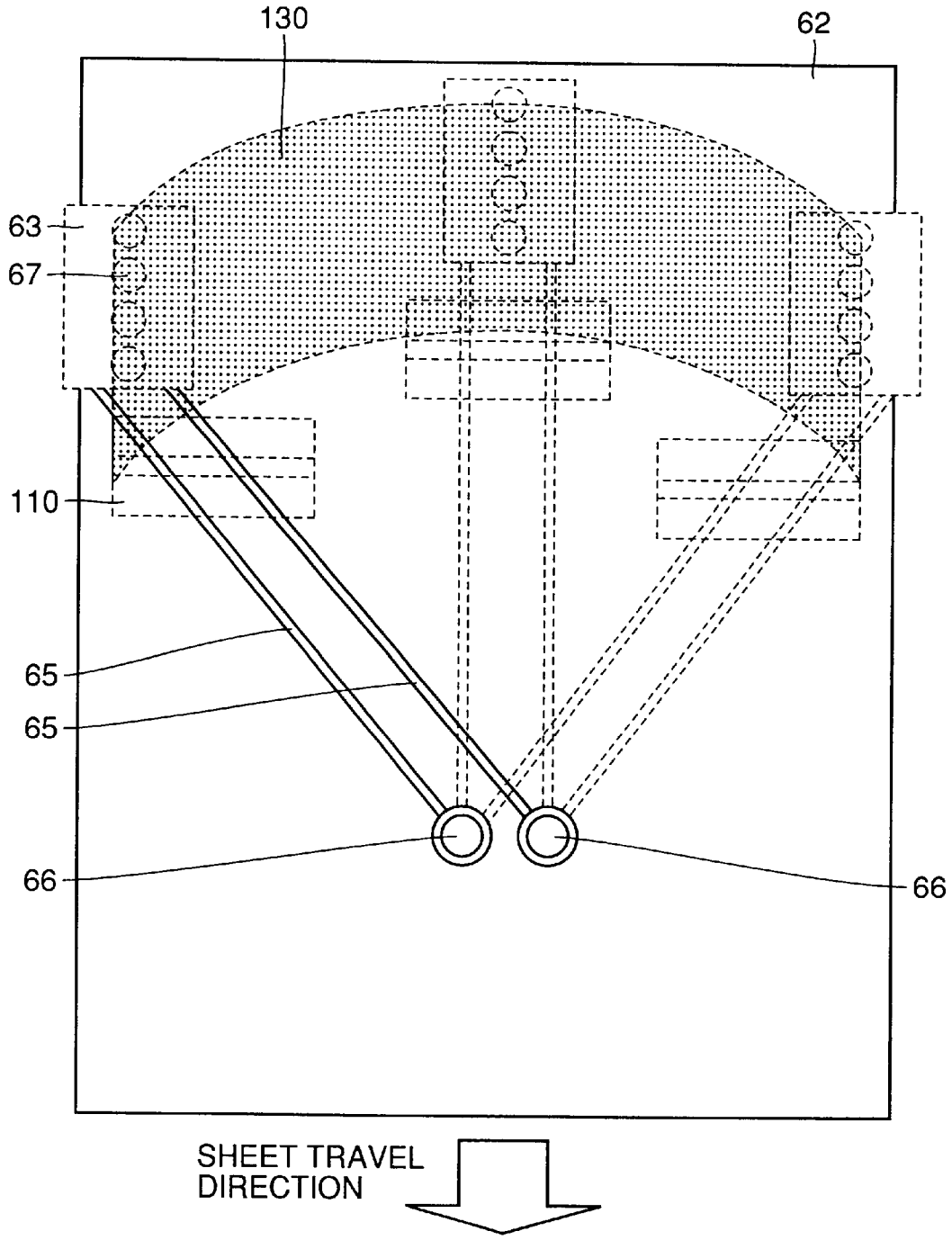
FIG. 24 is a diagram to describe an ink undried portion at completion of printing.

Referring to FIG. 24, recording sheet 62 moves in the direction from ink carriage 63 to heat generator 110. Therefore, an undried region 130 located between ink carriage 63 and heat generator 110 is present at the stage when printing by ink carriage 63 ends. The control device effects the reciprocating arc motion of heat generator 110 for a predetermined period of time even after printing by ink carriage 63 ends to dry this region 130.

In drying ink printed on recording sheet 62, the heat of the hot air or infrared rays from heat generator 110 is to be applied only to the area where there is ink. Therefore, the control device controls the operation of heat generator 110 so that heat is applied only to the portion where ink is present and not to the portion where there is no ink. The control device determines the presence of ink according to the print image data stored in the print memory. When the area printed out by ink carriage 63 arrives at the position beneath heat generator 110, the control device actuates heat generator 110 to provide heat to that area. When the area that has no print out by ink carriage 63 is located at the position below heat generator 110, the control device disables heat generator 110 to inhibit heat towards that area. It is to be noted that heat is not generated instantly. The control device controls the operation of heat generator 110 taking into consideration the time required for heat to be generated for drying ink subsequent to actuation of heat generator 110.

Figure 25:
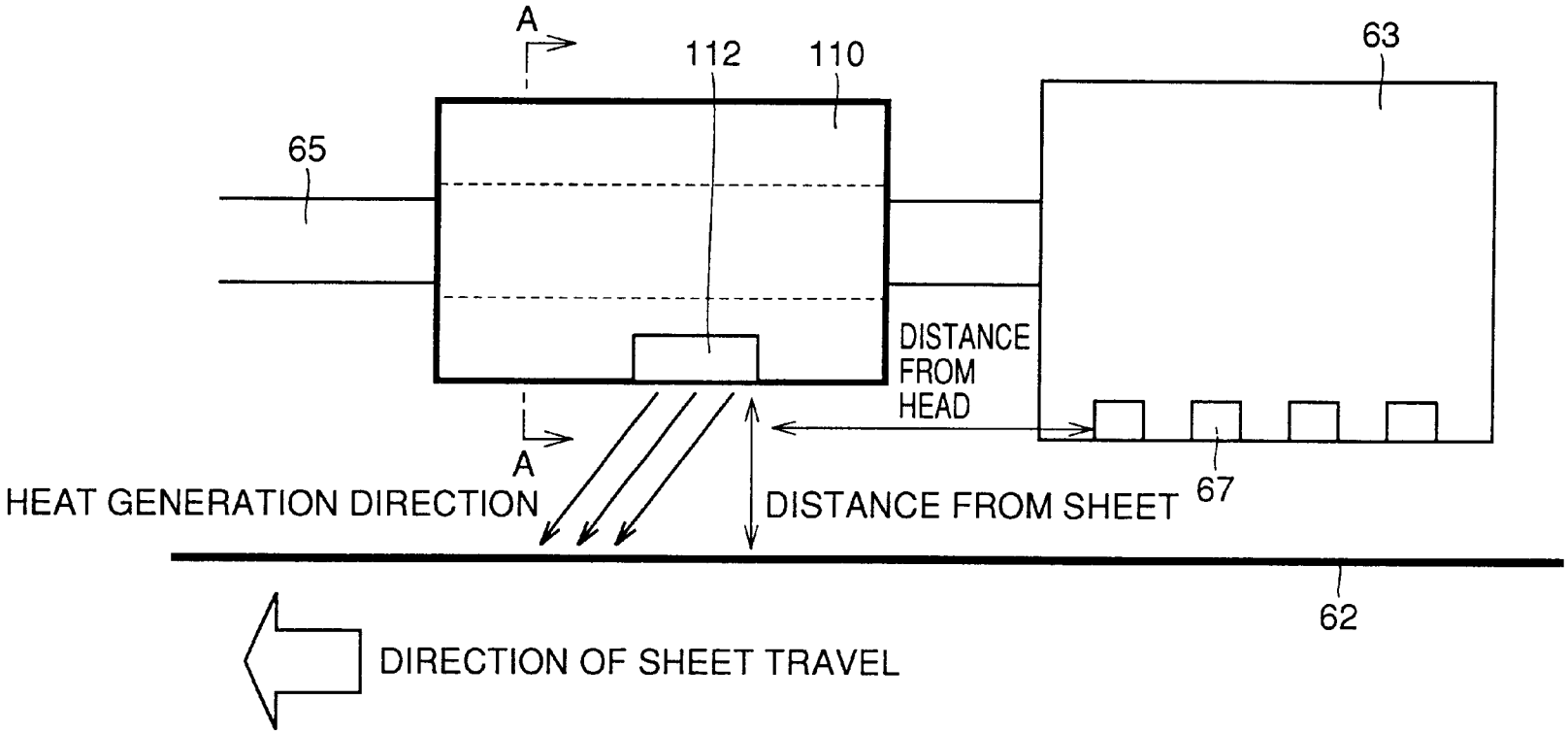
FIG. 25 is a diagram to describe the mounting position of a heat generator.
Figure 26:
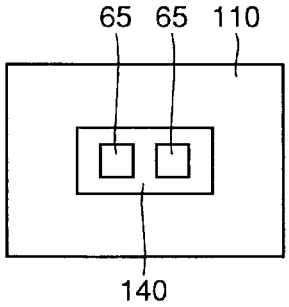
FIG. 26 is a sectional view taken along line A—A of the heat generator of FIG. 25.

The position of mounting heat generator 110 will be described with reference to FIG. 25. Heat generator 110 is provided at a position relatively close to ink carriage 63. The heat generated by heat generator 110 per se and the hot air or infrared rays generated from heat generator 110 may adversely affect the ink in the ink tank or ink head 67. Therefore, the distance between heat generator 110 or heat generation vent 112 and the ink tank or ink head 67 is defined to correspond to a temperature of a level at which the ink in the ink tank or ink head 67 is not modified in quality or not coagulated.

There is a possibility that the heat generated by heat generator 110 per se or the extra heat or infrared rays generated from heat generator 110 causes deformation of recording sheet 62 and modification in the quality of the ink on the recording sheet 62. Therefore, the distance between heat generator 110 or heat generation vent 112 and recording sheet 62 is defined so as to obviate deformation of recording sheet 62 and modification in the quality of the ink on recording sheet 62.

There is also the case where the ink in the ink tank or ink head 67 is modified in quality or coagulated depending upon the direction of the hot air or infrared rays generated from heat generator 110. This may distort the spray out trajectory of ink ejected from ink head 67 to result in disturbance in the image or text printed out. Therefore, the heat generation direction from heat generator 110 is set to a direction away from ink carriage 63, i.e., set to the travel direction of recording sheet 62.

A movable unit such as a fan is provided in heat generator 110 to generate hot air from heat generation vent 112. Heat generator 110 vibrates during operation. Therefore, this vibration is conveyed to ink carriage 63 and ink head 67 through strut 65 to which heat generator 110 is mounted. This may cause erroneous spray out of ink or disturbance in the text or image printed out. Therefore, a vibration absorption member 140 to absorb the vibration of heat generator 110 is attached between heat generator 110 and the two struts 65.

Figure 27:
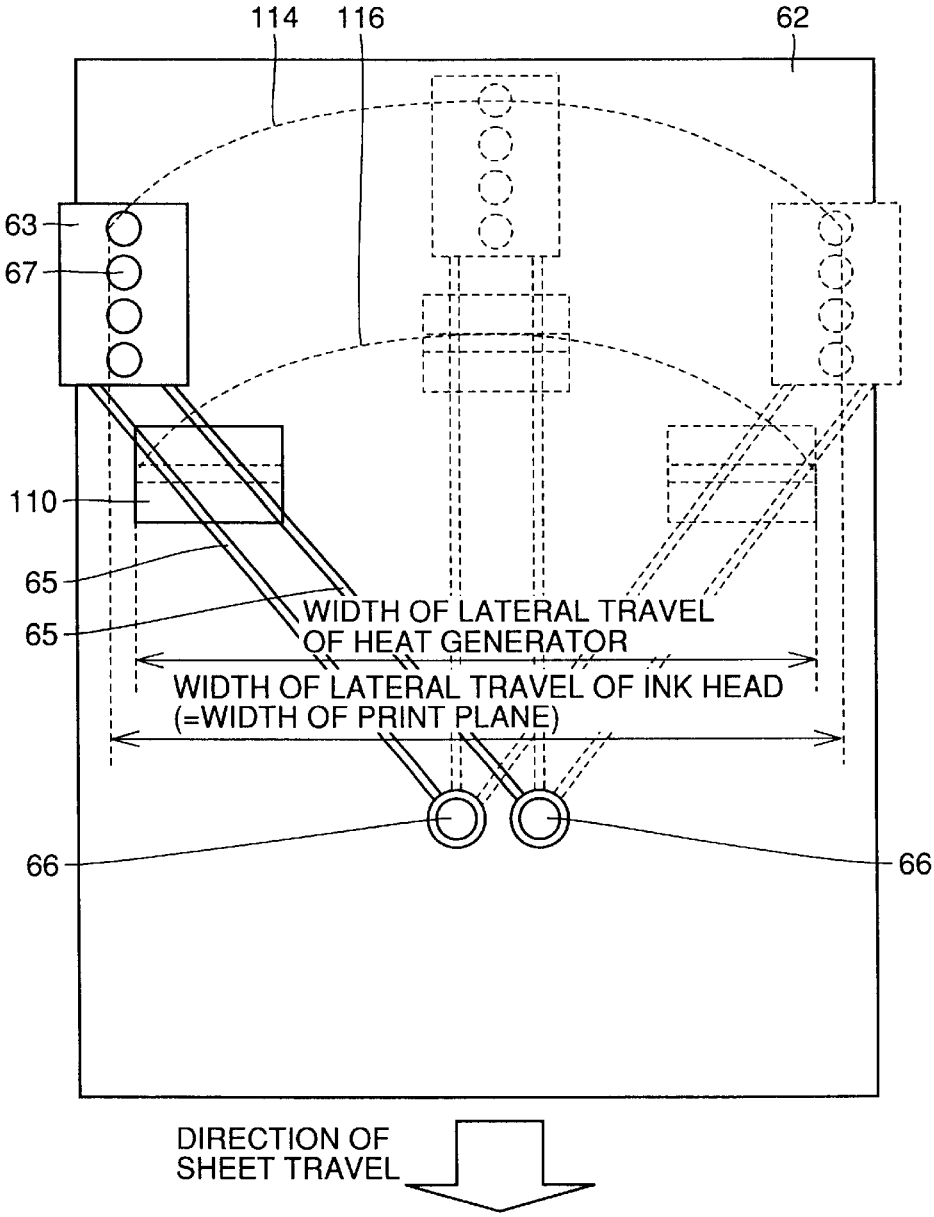
FIG. 27 is a diagram to describe the size of a heat generator.
Figure 28:
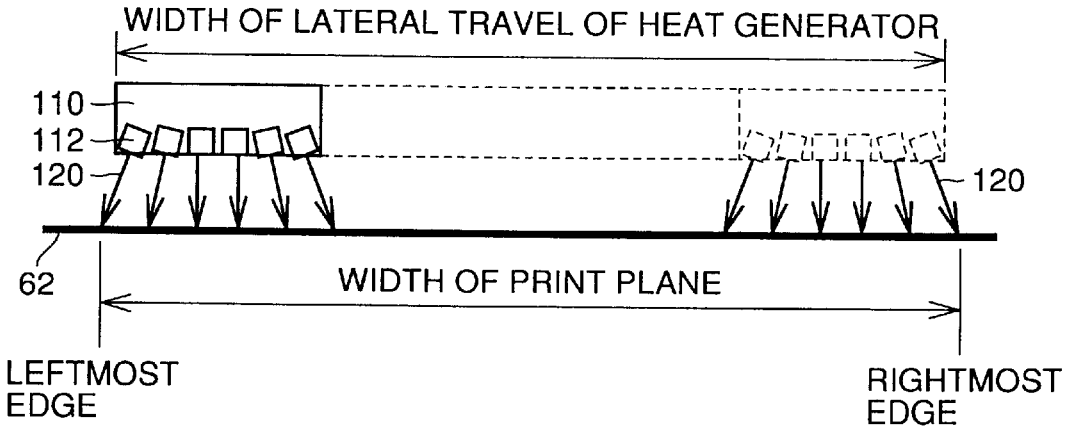
FIG. 28 is a diagram to describe the direction of heated air generated from a heat generator.

In the previous FIG. 22, the lateral width of heat generator 110 is defined so that the range of movement of heat generator 110 covers the print area. However, a heat generator 110 of a small lateral width as shown in FIG. 27 can be used to dry the entire recording sheet 62 instead of heat generator 110 of a large lateral width. Referring to FIG. 27, the width of the lateral movement of ink carriage 63 is set equal to the width of the printing plane of recording sheet 62. However, the width of the lateral movement of heat generator 110 becomes smaller than the width of the lateral movement of ink carriage 63. Therefore, the direction of hot air generated from heat generator 110 is set radially as shown by arrow 120 in FIG. 28. Therefore, hot air can be applied at a width greater than the width of the lateral movement of heat generator 110 to allow the entire recording sheet 62 to be dried.

The above-described ink jet printer provides the advantages set forth in the following in addition to the advantages of the ink jet printer of the third embodiment. Heat generator 110 provided between shaft 66 and ink carriage 63 carries out a reciprocating arc motion in synchronization with the reciprocating arc motion of ink carriage 63. Therefore, by virtue of the heat discharged from heat generator 110, the ink sprayed out on recording sheet 62 can be dried parallel to the printout operation. Since heat generator 110 per se moves, the entire recording sheet 62 can be dried even if heat generator 110 is reduced in size. Accordingly, power consumption and the amount of heat discharged from heat generator 110 can be reduced. Therefore, the exhaust fan to discharge heat outwards is dispensable to allow reduction in the size of the ink jet printer.

Also, heat generator 110 is increased in size and the direction of the heated air generated from heat generator 110 is set radially in order to provide hot air all over the print region of recording sheet 62. Also, heat generator 110 is operated for a predetermined period of time after printout ends. Accordingly, the ink on the entire printout plane can be dried before recording sheet 62 is output. Therefore, this can prevent the printout plane being smudged by the overlay of output recording sheets 62.

Furthermore the power consumed by heat generator 110 can be reduced than that of the case where the entire recording sheet 62 is dried by drying only the area where ink is output. Also, the amount of heat generated from heat generator 110 can be reduced. Therefore, heat generator 110 per se can be made smaller and the space for exhausting the heat from the ink jet printer can be reduced. Therefore, the entire size of the ink jet printer can be reduced.

By mounting heat generator 110 at an appropriate position, the problem of the ink in the ink tank or ink head 67 being modified in quality or coagulated is eliminated. Also, recording sheet 62 is not deformed and the quality of the ink printed on recording sheet 62 is not modified.

By setting the direction of the hot air or infrared rays generated from heat generator 110 farther away from ink carriage 63, the ink in the ink tank or ink head 67 will not be modified in quality or coagulated. Disturbance in the printed out image or text caused by distortion of the spray out trajectory of ink from ink head 67 is no longer seen.

By providing vibration absorption member 140 between heat generator 110 and strut 65, vibration of ink carriage 63 can be prevented to eliminate the problem of erroneous spray out of ink and disturbance in the printed text and image.

Fifth Embodiment

Figure 29:
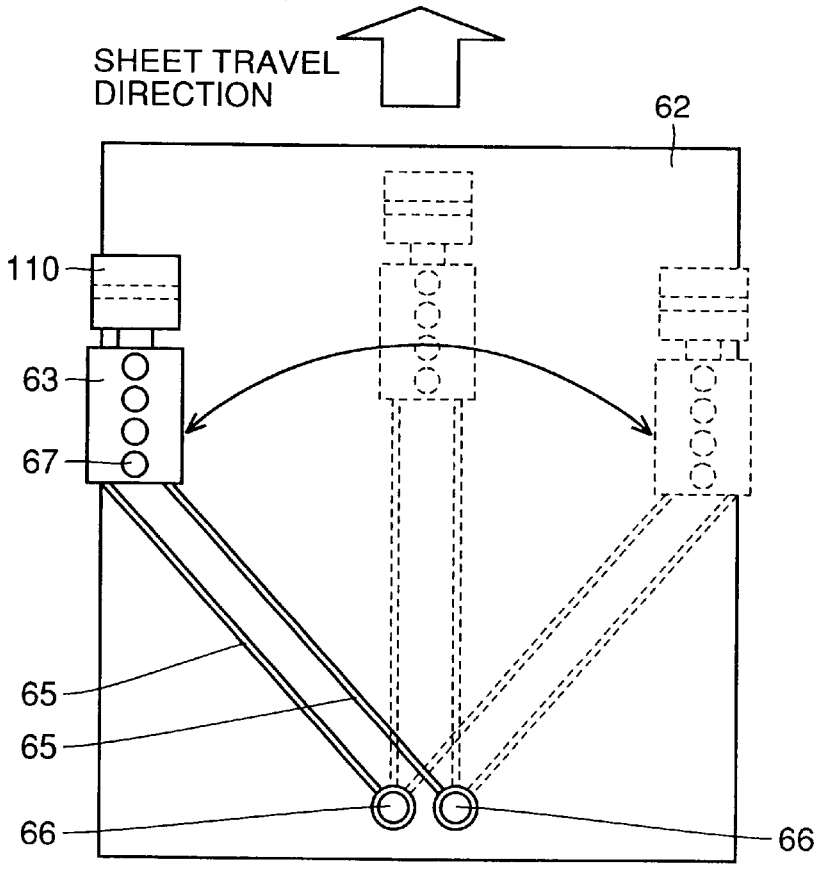
FIG. 29 is a top view of the interior of an ink jet printer according to a fifth embodiment of the present invention.
Figure 30:
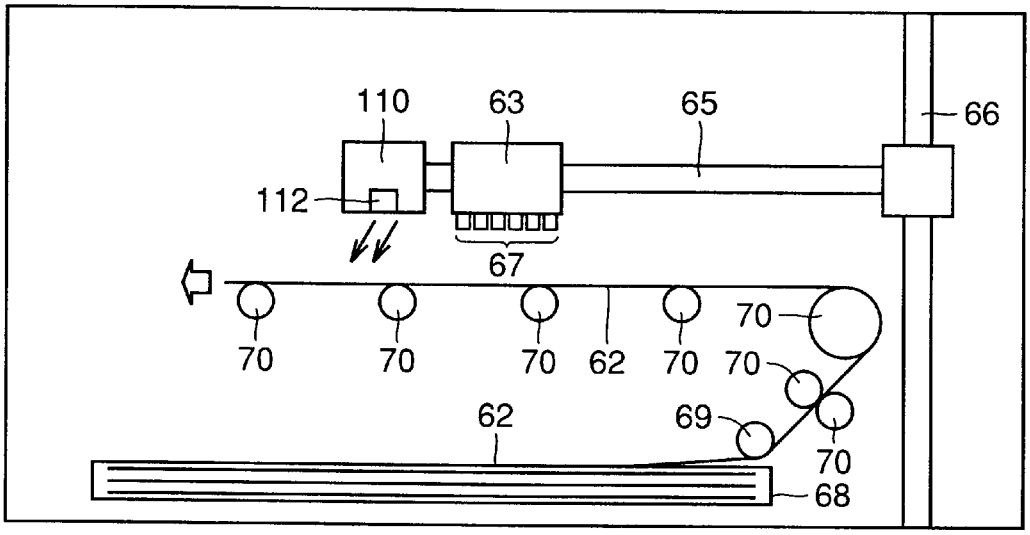
FIG. 30 is a side view of the interior of the ink jet printer of the fifth embodiment.

Referring to FIGS. 29 and 30, an ink jet printer according to a fifth embodiment of the present invention corresponds to the structure of the ink jet printer of the second embodiment described with reference to FIGS. 7 and 8, further including a heat generator 110 at the leading end of ink carriage 63. Heat generator 110 generates hot air or infrared rays from heat generation vent 112 to dry the ink on recording sheet 62.

The print image data generation method and printout operation of the ink jet printer are similar to those of the second embodiment. Therefore, description thereof will not be repeated.

The lateral width of heat generator 110 is defined so that hot air or infrared rays can be emitted in the printing range when ink carriage 63 carries out printing in the printing range of recording sheet 62.

Figure 31:
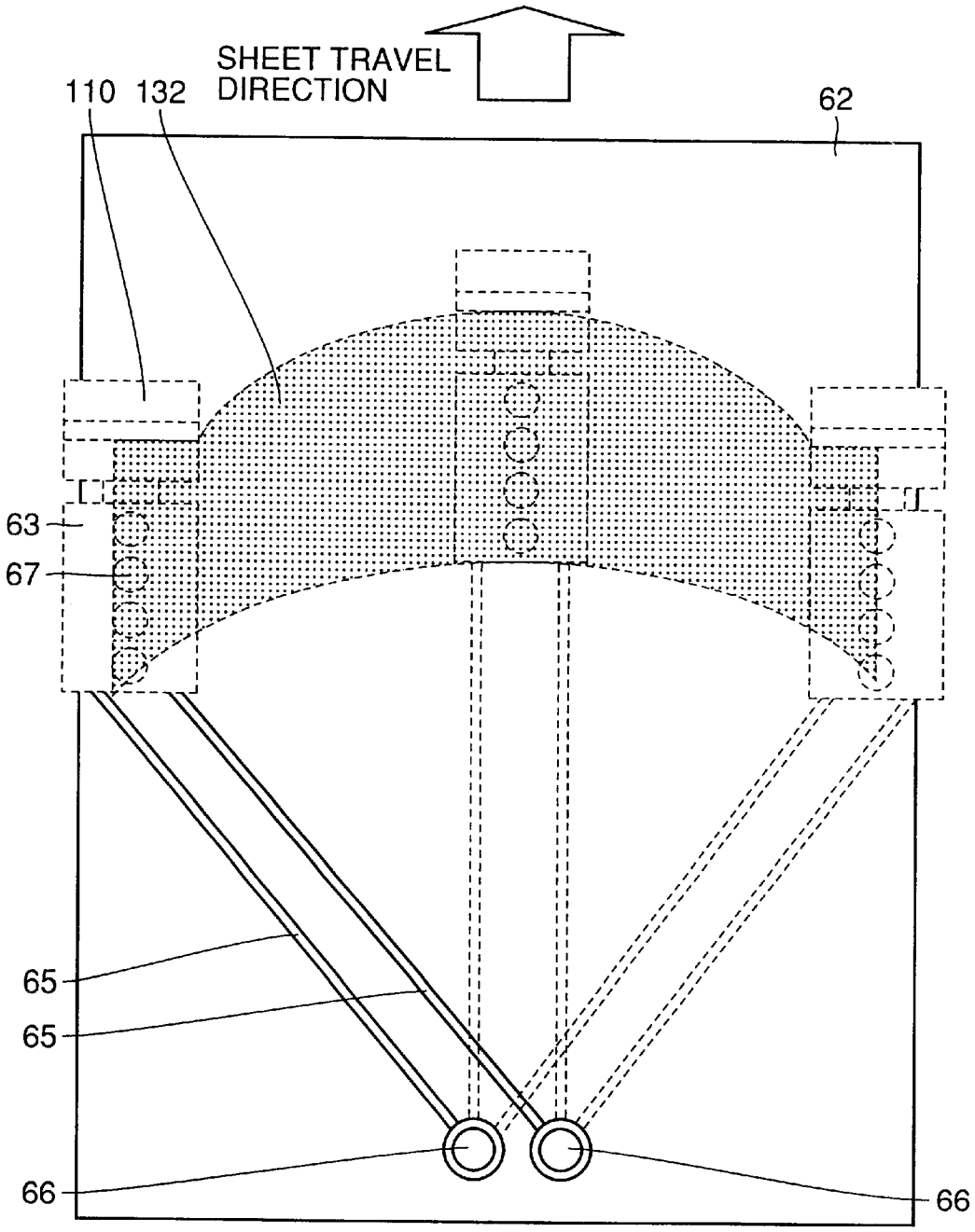
FIG. 31 is a diagram to describe an ink undried portion when printing is completed.

Referring to FIG. 31, recording sheet 62 is transferred in the direction from ink carriage 63 to heat generator 110. When printing by ink carriage 63 ends, an undried region 132 located between ink carriage 63 and heat generator 110 remains. Therefore, the control device causes heat generator 110 to continue the reciprocating arc motion for a predetermined period of time even after printing by ink carriage 63 ends in order to dry region 132.

The control device of the fifth embodiment controls heat generator 110 to apply heat or infrared rays only to the area with ink on recording sheet 62, similar to the control device of the fourth embodiment.

Figure 32:
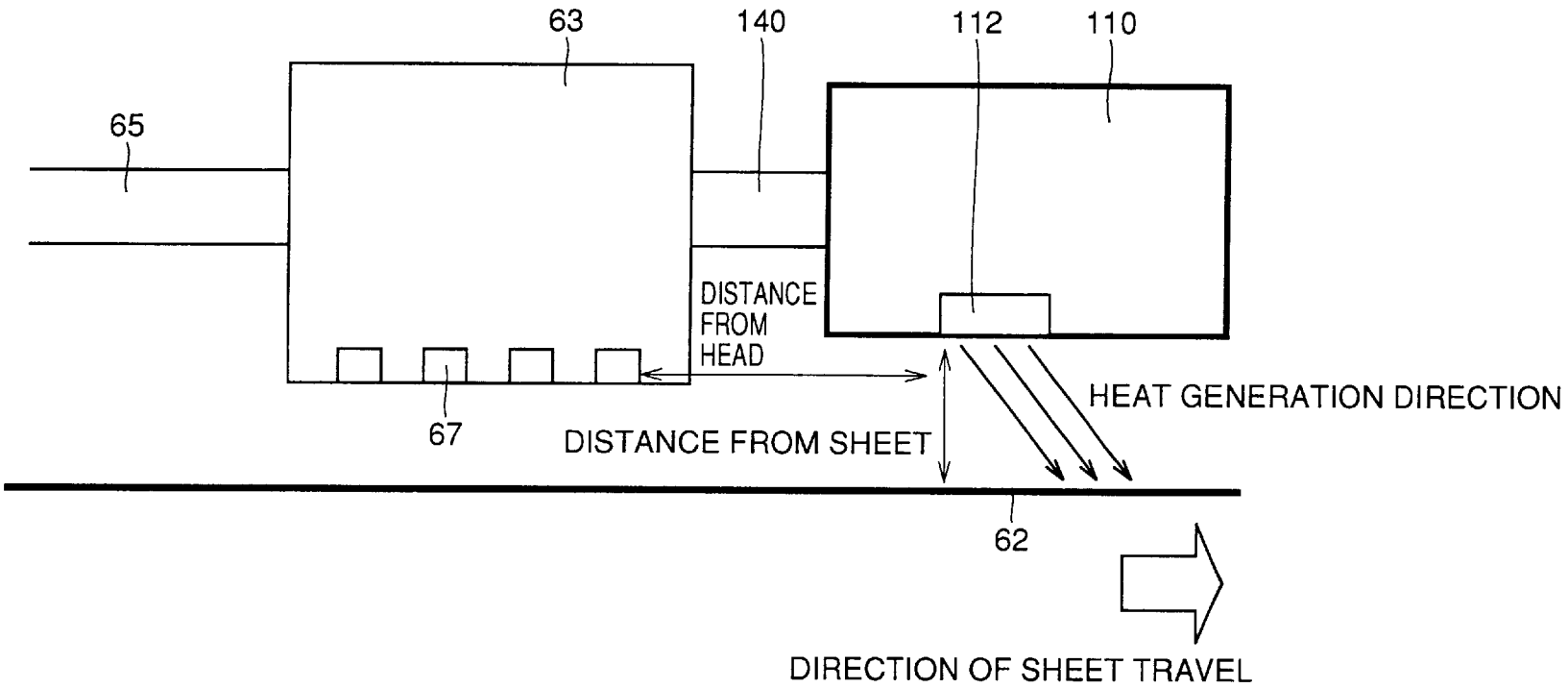
FIG. 32 is a diagram to describe the mounting position of a heat generator.

The position of mounting heat generator 110 will be described with reference to FIG. 32. Similar to the mounted position of heat generator 110 described with reference to FIG. 25, the distance between heat generator 110 and ink carriage 63 is defined to avoid modification of the quality or coagulation of the ink in the ink tank or ink head 67. Also, the distance between heat generator 110 and recording sheet 62 is defined to prevent deformation of recording sheet 62 and to prevent modification of the quality of the ink on recording sheet 62. Furthermore, the heat generation direction from heat generator 110 is set to become farther away from ink carriage 63, i.e., set in the direction of the transfer of recording sheet 62, to prevent ink quality modification or ink coagulation in the ink tank or ink head 67 and to prevent distortion of the spray out trajectory of the ink output from ink head 67.

In order to prevent erroneous spray out of ink from ink head 67 or disturbance of the printed out text or image due to vibration of the movable unit in heat generator 110 such as a fan, a vibration absorption member 140 is connected between ink carriage 63 and heat generator 110.

The above-described ink jet printer can provide advantages similar to those of the ink jet printer of the fourth embodiment.

Sixth Embodiment

Figure 33:
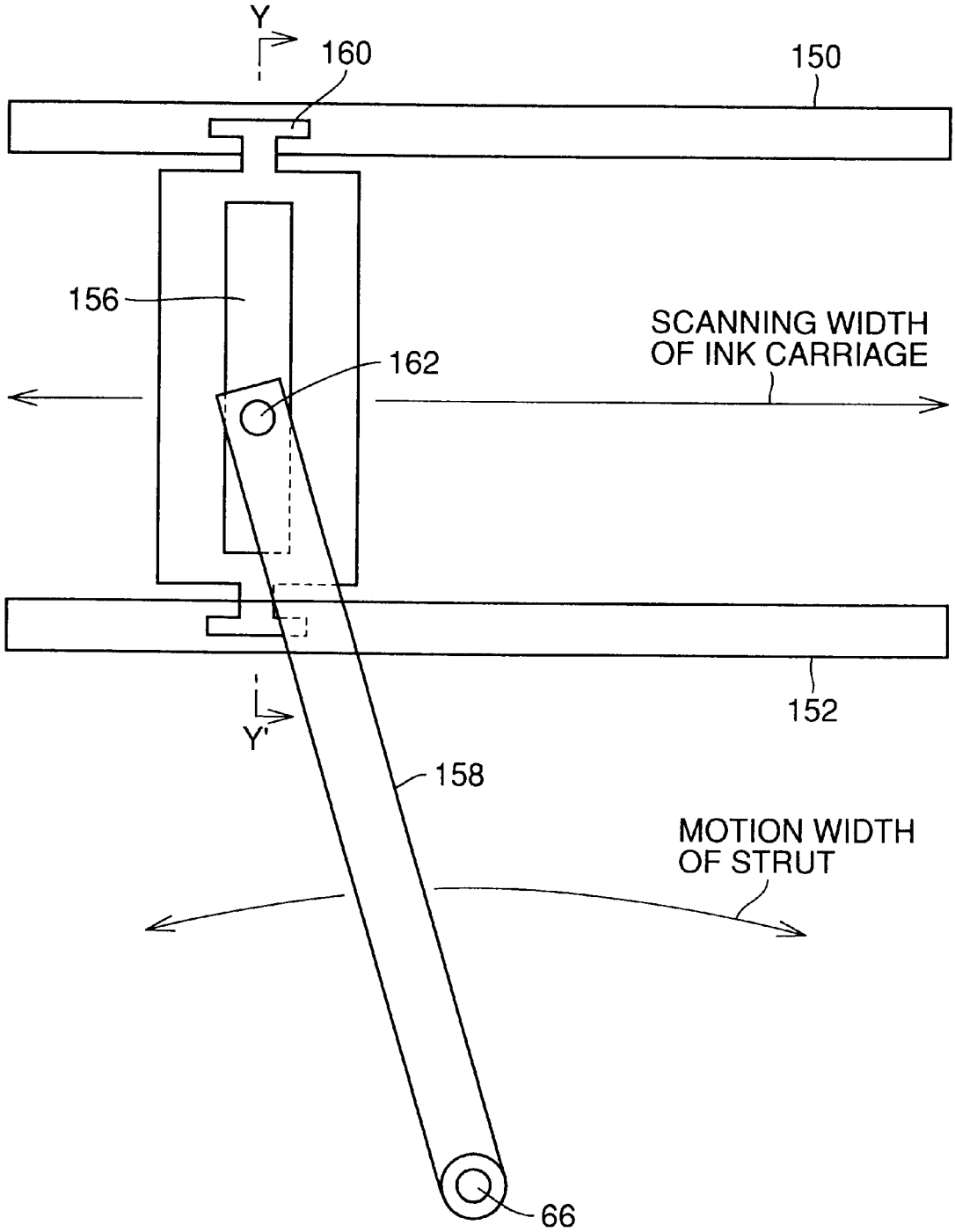
FIG. 33 is a top view of the interior of an ink jet printer according to a sixth embodiment of the present invention.
Figure 34:
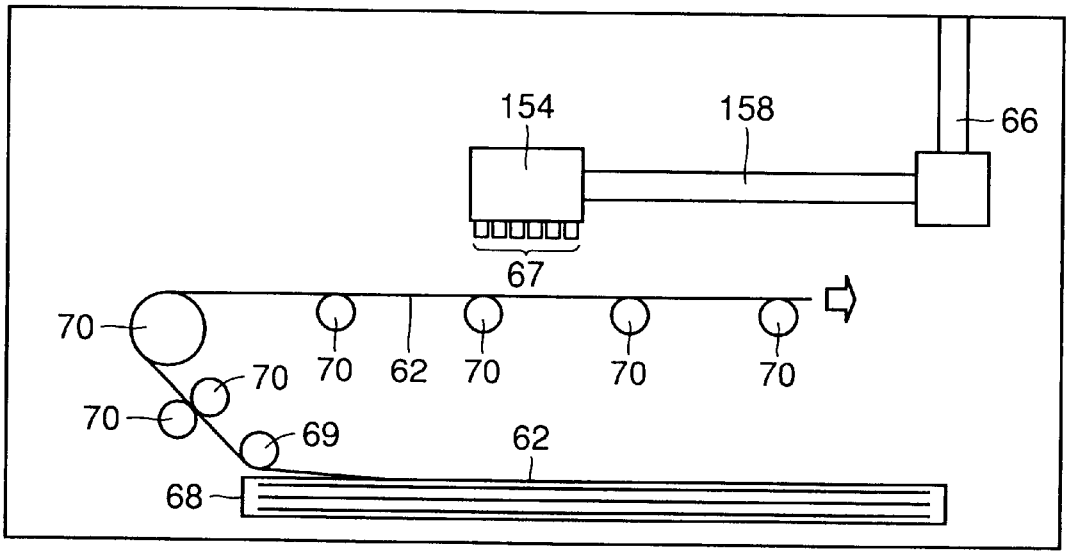
FIG. 34 is a side view of the interior of the ink jet printer of the sixth embodiment.

Referring to FIGS. 33 and 34, an ink jet printer according to a sixth embodiment of the present invention includes a shaft 66, two parallel guide rails 150 and 152, an ink carriage 154 that can run along two guide rails 150 and 152 having a plurality of ink heads 67 and an opening 156 with the direction orthogonal to the running direction as the longitudinal direction, a strut 158 having one end coupled rotatably to shaft 66 and the other end fitted with opening 156 in a movable manner, a sheet tray 68 to store recording sheets 62, a pickup roller 69 to take out a recording sheet 62 from sheet tray 68 one by one, a transportation roller 70 to sequentially transfer a recording sheet 62 taken out by pickup roller 69, a control device (not shown) to control forwarding of recording sheet 62, the motion of ink carriage 63, and ink jetting from ink head 67, and a reception device (not shown) to receive image data.

Figure 35:
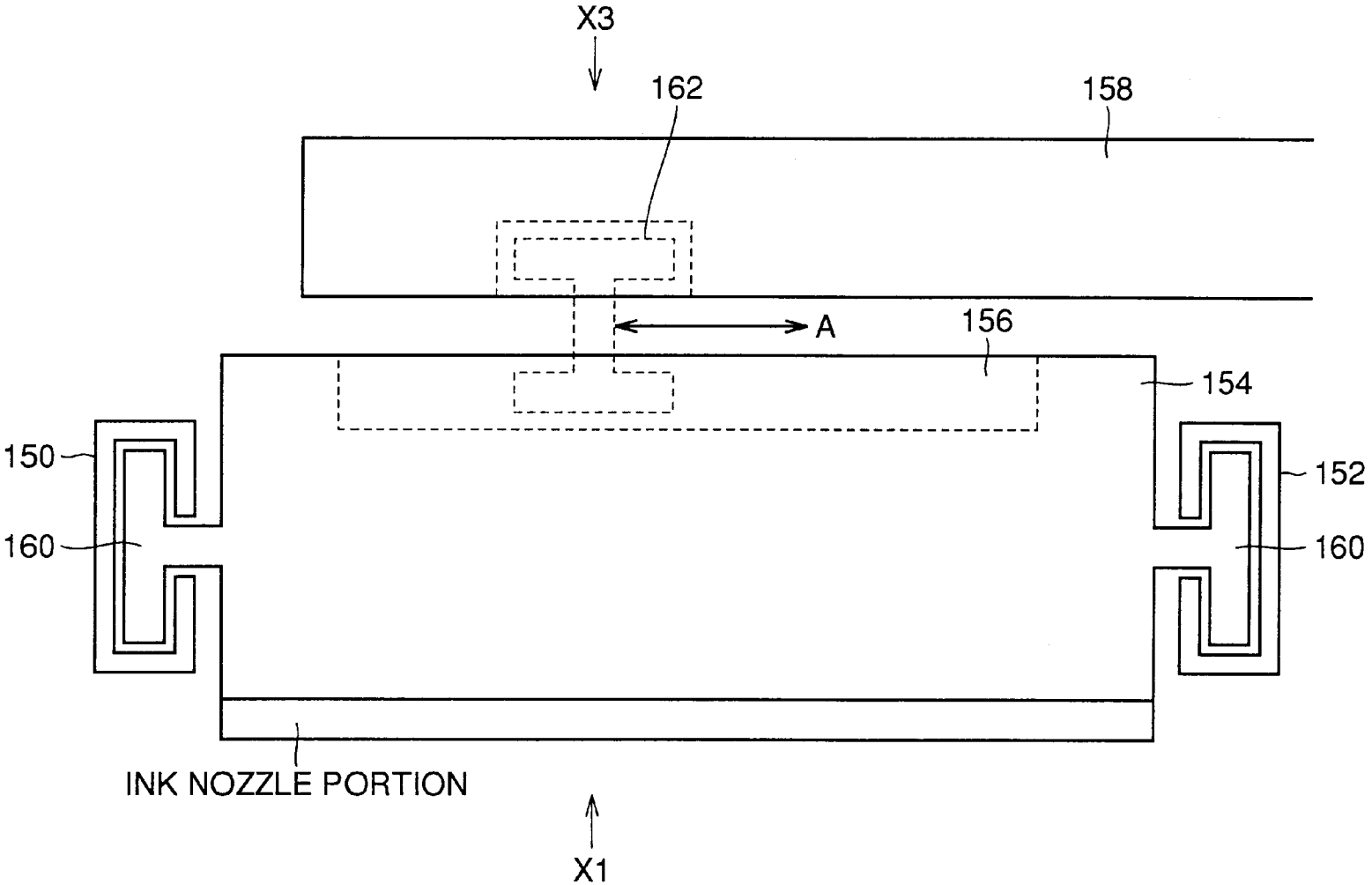
FIG. 35 is a sectional view of a strut and an ink carriage.
Figure 36:
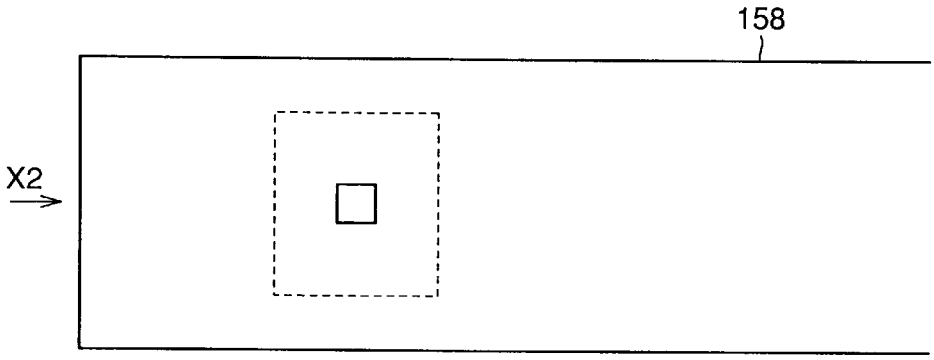
FIG. 36 shows the strut viewed from the direction of X1 of FIG. 35.
Figure 37:
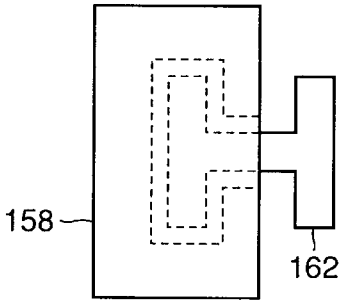
FIG. 37 shows the strut viewed from the direction of X2 of FIG. 36.
Figure 38:
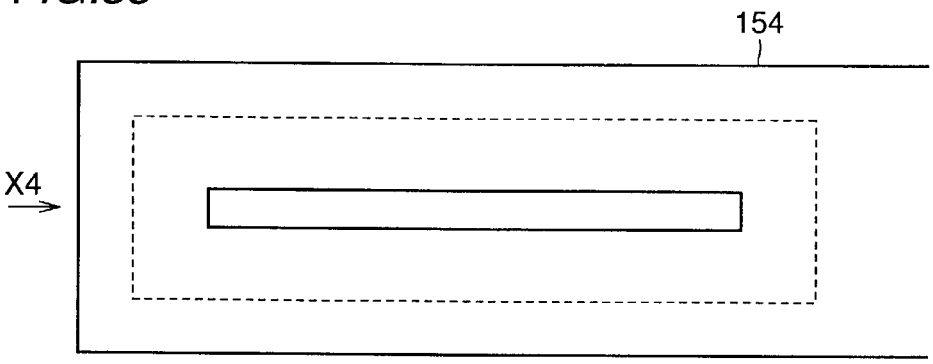
FIG. 38 shows the ink carriage viewed from the direction of X3 of FIG. 35.
Figure 39:
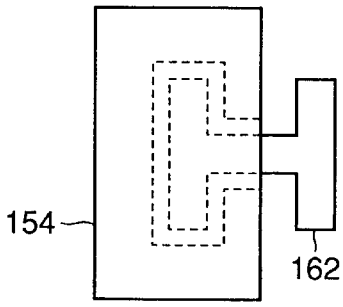
FIG. 39 shows ink carriage 154 viewed from the direction of X4 of FIG. 38.

The portion of the two guide rails 150 and 152 coupled with ink carriage 154 is formed of a ball bearing. The portion of strut 158 coupled with ink carriage 154 is formed of a ball bearing. FIG. 35 is a sectional view of strut 158 and ink carriage 154 of FIG. 33 taken along line Y–Y'. FIG. 36 is a diagram of strut 158 viewed from the direction of X1 of FIG. 35. FIG. 37 is a diagram of strut 158 viewed from the direction of X2 of FIG. 36. FIG. 38 is a diagram of ink carriage 154 viewed from the direction of X3 of FIG. 35. FIG. 39 is a diagram of ink carriage 154 viewed from the direction of X4 of FIG. 38.

Strut 158 and opening 156 of ink carriage 154 are fitted together by a fit member 162. Ink carriage 154 includes an ink bottle to store ink in addition to ink head 67.

The ink jet printer of the first to fifth embodiments carry out printing while moving along an arc in order to narrow the lateral widths of the runway portion and the overrun portion. However, printing cannot be carried out using the intact image data due to the arc motion. A particular image process such as that described in the second embodiment is required. The ink jet printer of the present embodiment is directed to carry out printing using the intact image data while reducing the lateral widths of the runway portion and the overrun portion by converting the arc motion into linear motion.

Ink carriage 154 moves along guide rails 150 and 152. The arc motion of strut 158 is divided into the vertical motion of fitting member 162 and the lateral motion of ink carriage 154.

Figure 40:
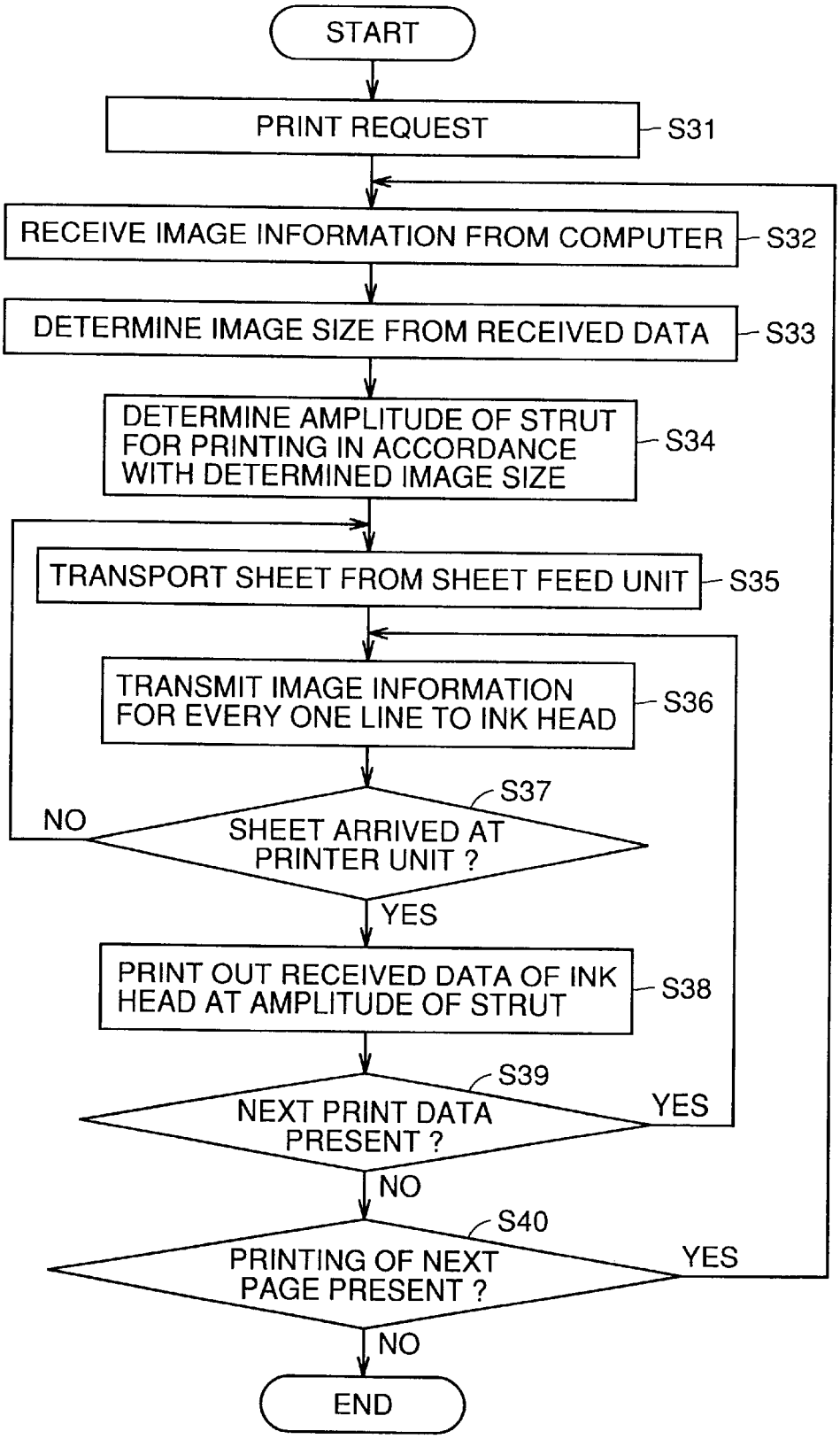
FIGS. 40–42 are flow charts of a printing operation of an ink jet printer.

The printing operation of the ink jet printer of the present embodiment will be described with reference to FIG. 40. The control device receives a print request by a computer and the like connected to the ink jet printer (S31). Following reception of the print request, the reception device receives image information from the computer and the like (S32). The control device determines the image size on the basis of the received data (S33). The control device determines the amplitude of strut 158 according to the image size (S34). The control device conveys recording sheet 62 from sheet tray 68 (S35). The control device selects data for every one line from the image information to prepare data to be printed out by ink head 67 (S36). The reception device determines whether recording sheet 62 has arrived at the printout portion or not (S37). When recording sheet 62 has not arrived at the printout portion (NO at S37), the process of S35 onward is repeated.

When recording sheet 62 has arrived at the printing portion (YES at S37), the control device drives strut 158 to carry out a reciprocating arc motion. Printing of one page is effected on recording sheet 62 according to the prepared data (S38). The control device determines whether there is data left to be printed out (S39). When there is data to be printed out (YES at S39), the process of S36 onward is repeated. When there is no data to be printed out (NO at S39), the control device determines whether to print out the next page (S40). When the next page is to be printed out (YES at S40), the process of S32 onward is repeated. When there is no next page to be printed out (NO at S40), the control device ends the process.

Figure 41:
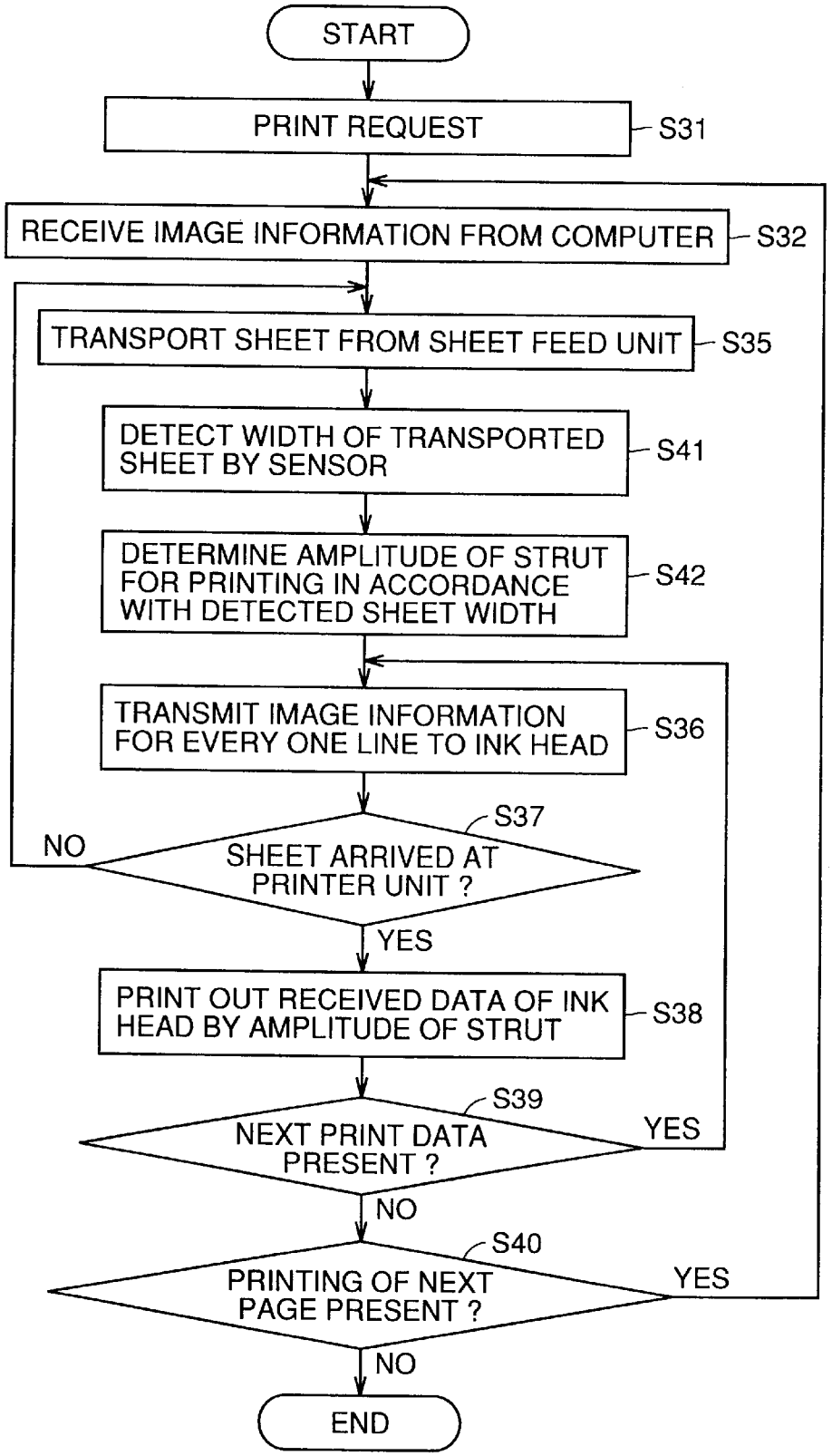

Another embodiment of the printing operation by the ink jet printer will be described with reference to FIG. 41. The process of S31–S32 and the process of S35 are similar to those of FIG. 40. Therefore, description thereof will not be repeated. Following the process of S35, the control device detects the sheet width of recording sheet 62 that is currently transported by a sensor not shown (S41). The control device determines the amplitude of strut 158 corresponding to the detected sheet width (S42). Then, the process of S36–S40 is carried out. Since the process of S36–S40 is similar to that of FIG. 40, details thereof will not be repeated.

Figure 42:
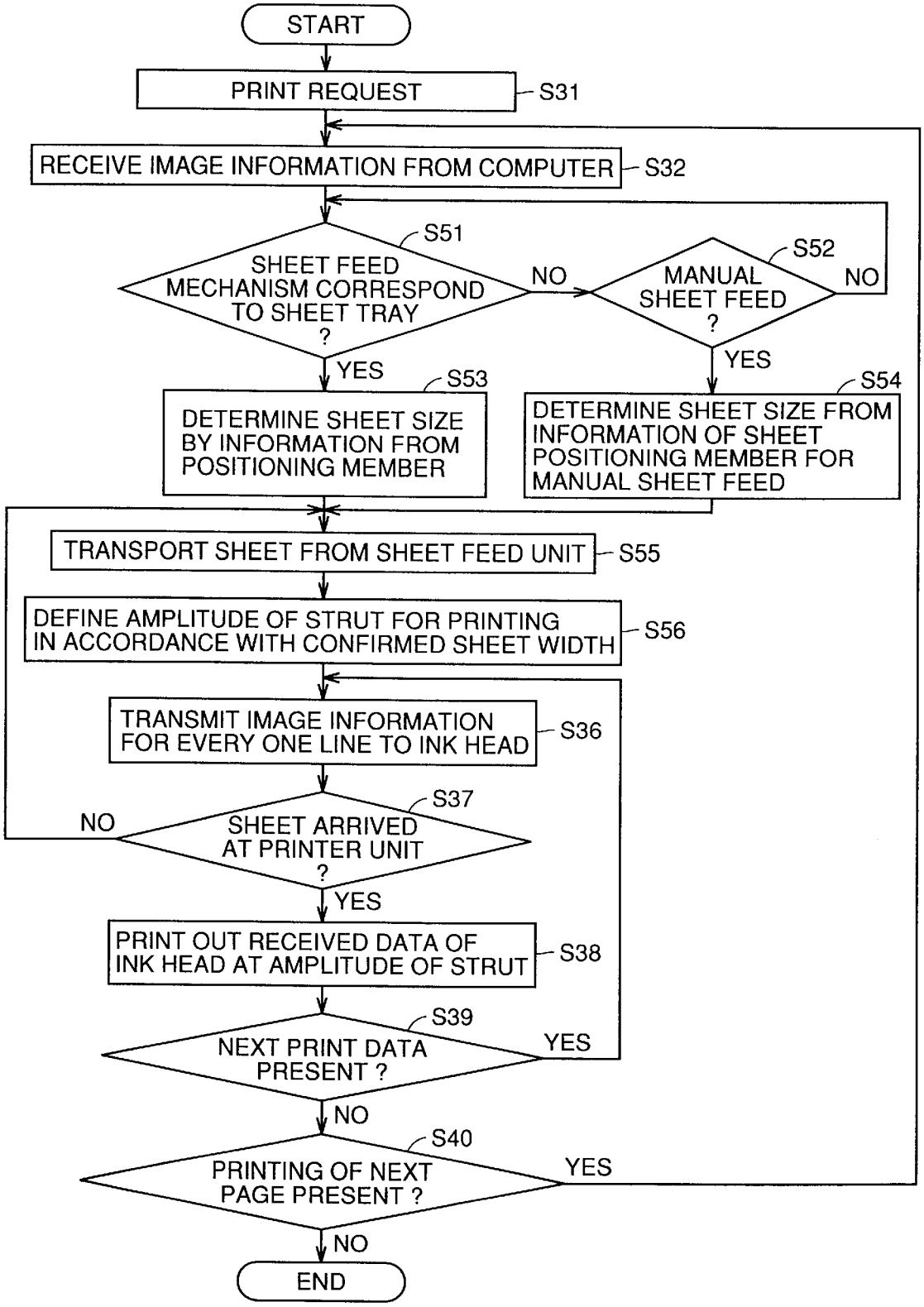
Figure 43:
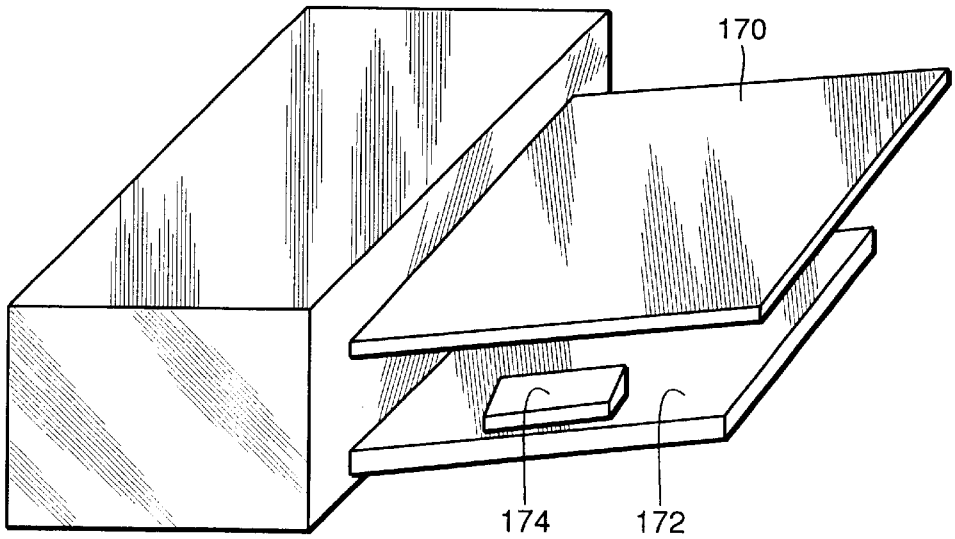
FIG. 43 is a diagram to describe a manual feed sheet positioning member.

A still further embodiment of the printing operation of the ink jet printer will be described with reference to FIG. 42. The process of S31–S32 is similar to that of FIG. 40. Therefore, description thereof will not be repeated. Following the process of S32, the control device determines whether a sheet is fed out from sheet tray 68(S51). When a sheet is fed out from sheet tray 68 (YES at S51), the control device determines the size of recording sheet 62 according to the information from a positioning member (not shown) to measure the size of recording sheet 62 stored in sheet tray 68. When a sheet is not fed out from sheet tray 68 (NO at S51), the control device determines whether a sheet is fed manually (S52). When a sheet is fed manually (YES at S52), the size of recording sheet 62 is determined according to the information of the fixed position from a manual feed sheet positioning member 174 provided in sheet tray 172 as shown in FIG. 43 to hold recording sheet 62 (S54). When a sheet is not fed from sheet tray 68 or from sheet tray 172 (NO at S52), the control device repeats the process of S51.

Upon determination of the size of recording sheet 62 by the process of S53 or S54, the control device conveys recording sheet 62 from sheet tray 68 or sheet tray 172 (S55). The control device determines the amplitude of strut 158 according to the sheet size (S56). Then, the process of S36–S40 is carried out. The process of S36–S40 is similar to that of FIG. 38, and details thereof will not be repeated.

As mentioned before, ink carriage 154 moves along two guide rails 150 and 152 to carry out printing while moving linearly. The scanning operation of ink carriage 154 is effected by the reciprocating arc motion of strut 158. The reciprocating arc motion of strut 158 is divided into the vertical linear motion of strut 158 moving in opening 156 of ink carriage 154 and the lateral linear motion of ink carriage 154 running along guide rails 150 and 152. Therefore, even if the runway portion and the overrun portion of the same running distance as the conventional case are provided along the circular segment, the lateral widths of the runway portion and the overrun portion can be made smaller than those of the conventional ink jet printer. Thus, the width of the lateral movement of ink carriage 154 can be reduced to allow reduction in the size of the ink jet printer.

The portion of the two guide rails 150 and 152 coupled with ink carriage 154 is formed of a ball bearing. The portion of strut 158 coupled with ink carriage 154 is formed of a ball bearing. Therefore, the movement of ink carriage 154 is carried out smoothly.

Since the control device determines the amplitude of strut 158 according to the image size, high speed print out is allowed without any extra reciprocating motion of ink carriage 154.

Furthermore, the movement of ink carriage 154 is controlled according to the size of recording sheet 62. Therefore, the range of movement of ink carriage 154 in the printing operation can be limited to that within recording sheet 62. Therefore, extra motion of ink carriage 154 is eliminated. Thus, printing can be carried out at high speed.

Seventh Embodiment

Figure 44:
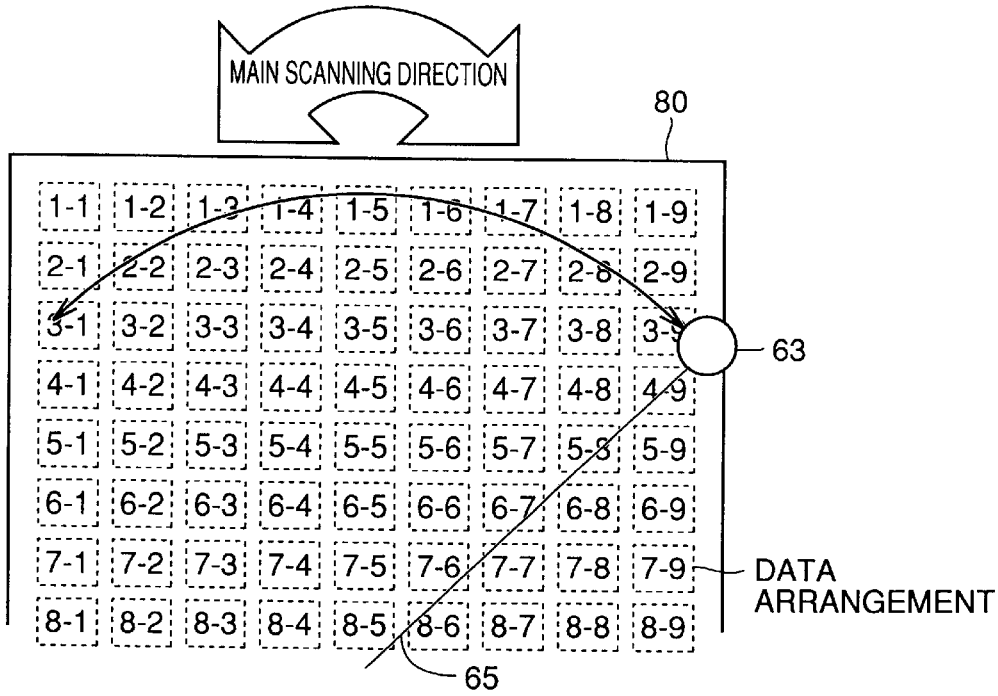
FIG. 44 is a diagram to describe the readout sequence of pixel values of image data by the ink jet printer of the first to fifth embodiments.

The ink jet printer of the first to fifth embodiments must read out the pixel value according to the scanning direction of ink carriage 63 as shown in FIG. 44. For example, the pixel value must be read out in a particular sequence such as pixels 3–9, 2–8, 1–7, 1–6, 1–5, 1–4, 1–3, 2–2, 3–1. Therefore, complicated readout must be carried out in producing print data. For the purpose of printing out at high speed, print data must be generated in advance and stored in a region differing from the memory region of the image data.

The ink jet printer of the seventh embodiment is directed to a compact ink jet printer that does not have to read out the pixel values in a particular sequence.

Figure 45:
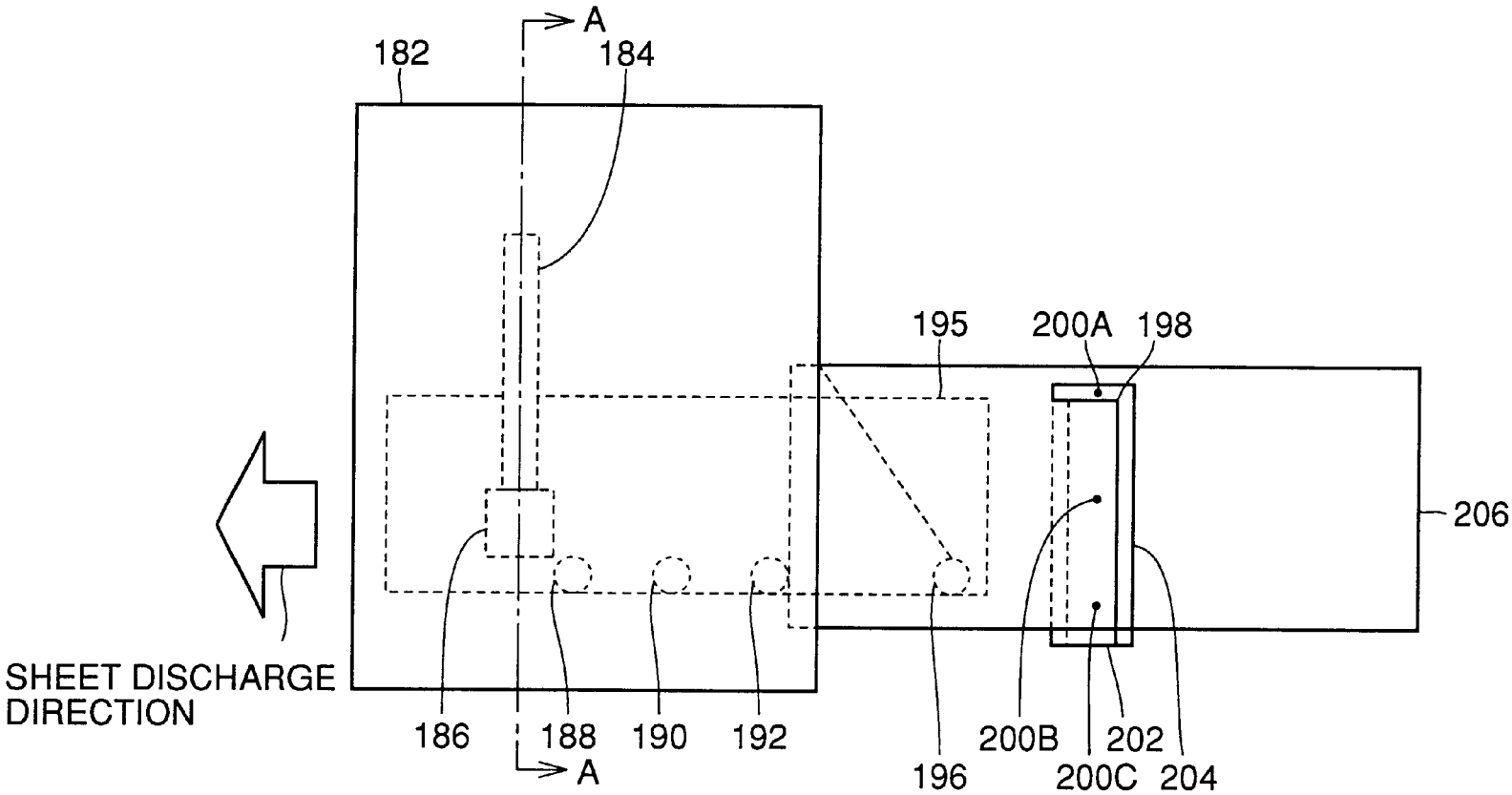
FIG. 45 is a side sectional view of an ink jet printer according to a seventh embodiment of the present invention.
Figure 46:
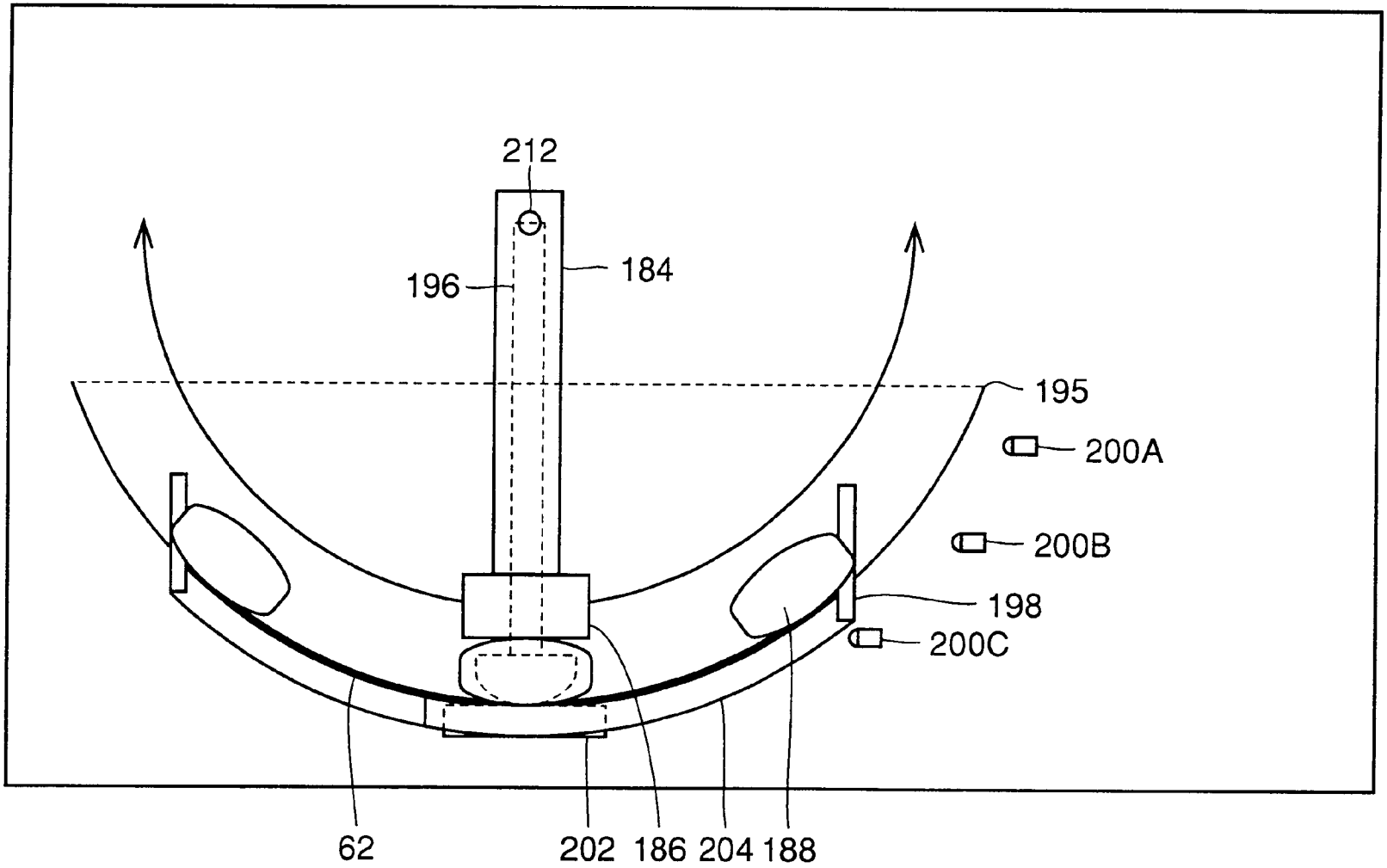
FIG. 46 is a sectional view of the ink jet printer of FIG. 45 taken along line A—A.

Referring to FIGS. 45 and 46, an ink jet printer according to the seventh embodiment includes a sheet cassette 206 storing recording sheets 62, a printer unit 182 to print out on recording sheet 62, and a control device (not shown) to control the motion of ink carriage 186 and the ink ejected from ink carriage 86.

Sheet cassette 206 includes a side guide 198 to hold recording sheet 62 in an arc manner, a rack 204 and a pinion 202, and sheet size sensors 200A, 200B and 200C to detect whether the size of recording sheet 62 is B4, A4, or B5.

Printer unit 182 includes a transportation guide 195 partially intruding into sheet cassette 206, and formed of a portion of a cylinder to hold recording sheet 62 in an arc manner, a sheet bail 196 for pressing recording sheet 62 placed on transportation guide 195, a pickup roller 192 to take out recording sheet 62 held by sheet bail 196 one by one, a transportation roller 190 and a guide roller 188 sandwiching recording sheet 62 with transportation guide 195 to guide recording sheet 62 to a position facing ink carriage 186 while maintaining the same curvature with transportation guide 195, a shaft 212 provided rotatably about a predetermined axis, a strut 184 fixed to shaft 212 to move along an arc about the axis with the rotation of shaft 212, and an ink carriage 186 provided at a predetermined position from shaft 212 of strut 184.

Ink carriage 186 carries out an arc motion about shaft 212 to eject ink onto recording sheet 62 bent in an arc manner.

Figure 47A:
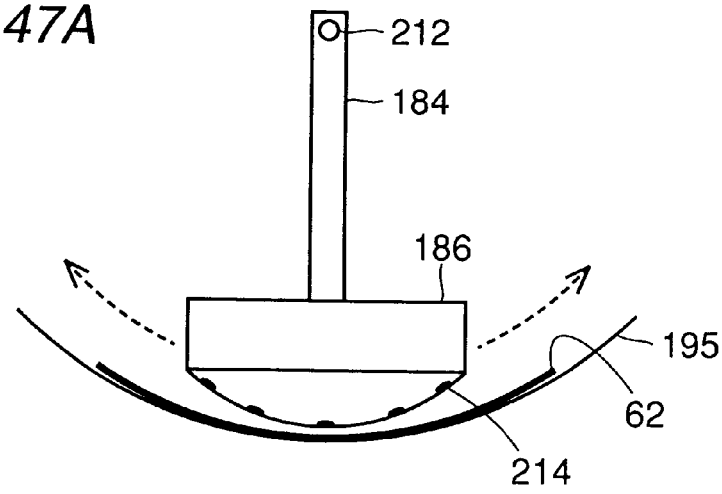
FIGS. 47A–47C are diagrams to describe the relationship between the shape of the ink carriage and the shape of the transportation guide.
Figure 47B:
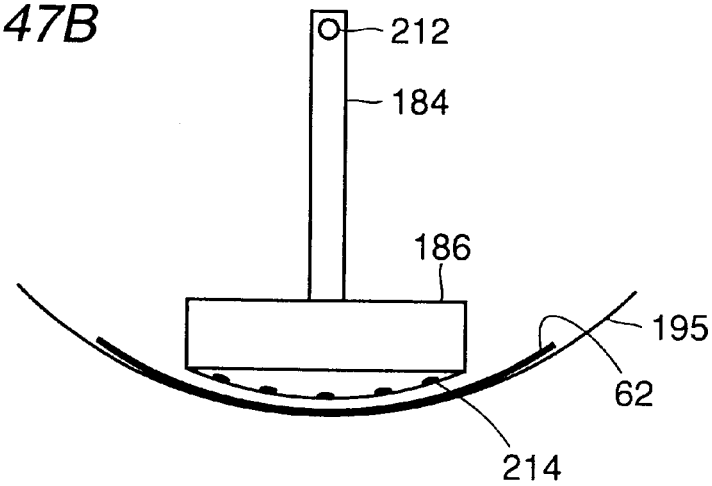
Figure 47C:
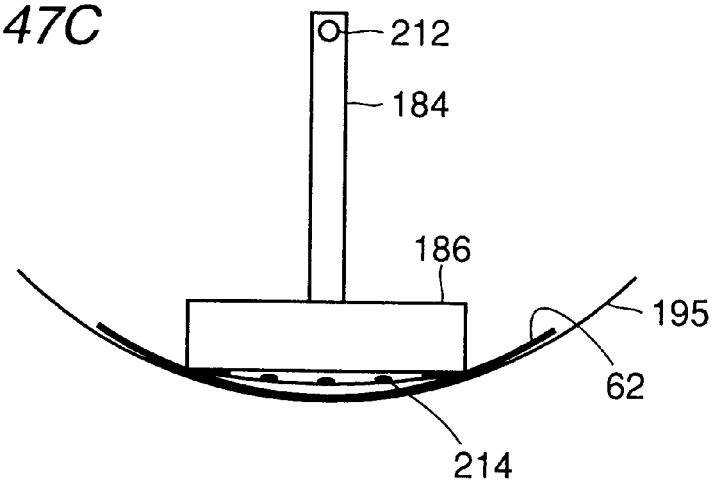

The relationship between the shape of ink carriage 186 and the shape of transportation guide 195 will be described with reference to FIGS. 47A–47C. As mentioned above, the cross section of transportation guide 195 corresponds to an arc segment. Therefore, the shape of the ink eject plane of ink carriage 186 corresponds to an arc having a curvature smaller than the curvature of transportation guide 195 as shown in FIG. 47A, or a curvature identical to that of transportation guide 195 as shown in FIG. 47B. If the configuration of the ink eject plane of ink carriage 186 is set to a curve that has a curvature greater than the curvature of transportation guide 195, the end of ink carriage 186 will easily come into contact with recording sheet 62 to cause sheet jam. A structure with the less possibility of sheet jamming is provided by setting the curvature of the ink eject plane smaller than the curvature of transportation guide 195.

Figure 48:
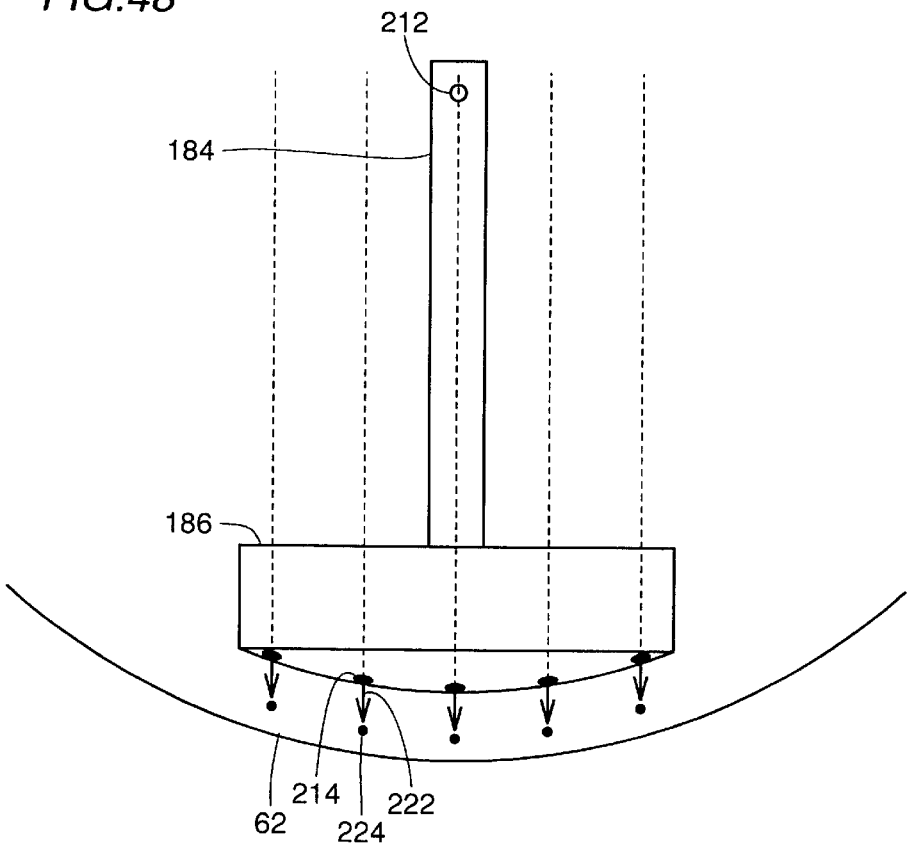
FIG. 48 is a diagram corresponding to the case where ink is ejected from an ink nozzle towards the major axis of the strut.
Figure 49:
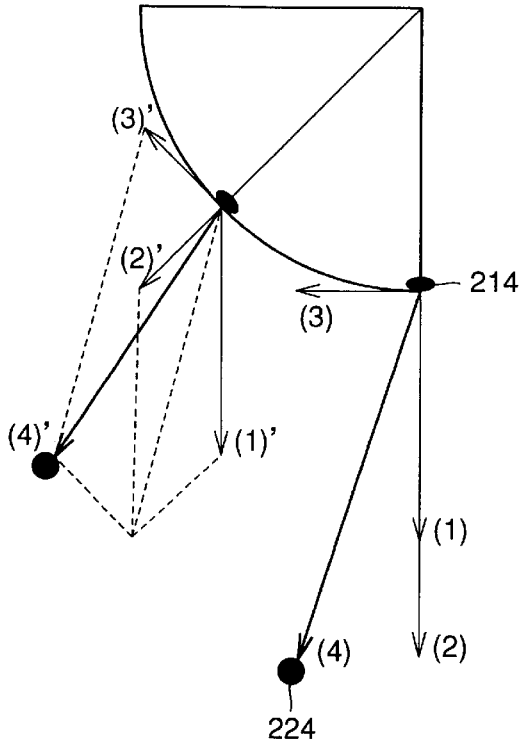
FIG. 49 is a diagram showing the relationship between the force acting on ink and the ink ejection direction.
Figure 50:
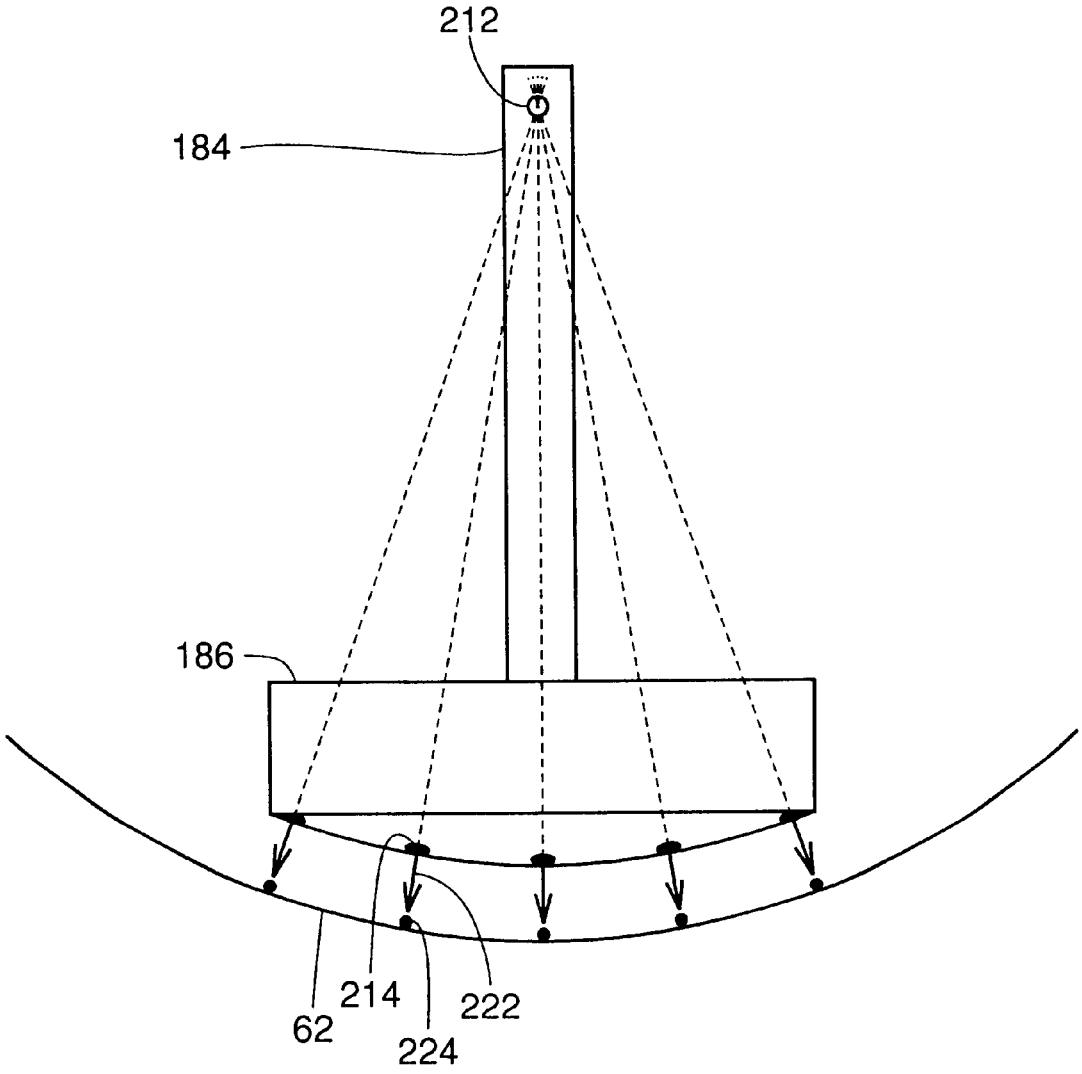
FIG. 50 is a diagram corresponding to the case where ink is ejected in a direction of a line connecting the center of the shaft and an ink nozzle.

The direction of ink ejection from the plurality of ink nozzles 214 of ink carriage 186 will be described. Consider the case where ink is ejected from each ink nozzle 214 in a direction 222 parallel to the major side of strut 184 as shown in FIG. 48. Referring to FIG. 49, the centrifugal force (2) and inertia force (3) are applied in addition to the ink ejecting force (1) when ink is output from ink nozzle 214. Therefore, ink 224 is sprayed out in the direction of the resultant force (4) of ejection force (1), centrifugal force (2), and inertia force (3). The direction of centrifugal force (2) and inertia force (3) differs depending upon the position of ink nozzle 214. However, ink ejection force (1) always acts in a constant direction irrespective of the position of ink nozzle 214. Therefore, control of the ink hit position of ink 224 is difficult since the level of resultant force (4) differs from each of ink nozzles 214. Therefore, the direction of ink ejection force (1) is defined in the direction of the line connecting the center of shaft 212 and ink nozzle 214, as shown in FIG. 50. Accordingly, the direction of ink ejection force (1) matches the direction of centrifugal force (2), so that the magnitude of resultant force (4) is always constant. This facilitates the control of the hit position of ink 224. In addition to ejection force (1) of ink 224, centrifugal force (2) can be used for ink 224 ejection. Thus, the ejection speed of ink 224 can be improved.

Ink carriage 186 sprays out ink while moving back and forth along an arc. By moving ink carriage 186 in a reciprocating manner on the same line on recording sheet 62 and ejecting ink according to the same image data, the resolution can be doubled than the case where ink is ejected in either the forward drive or the backward drive of ink carriage 186.

Figure 51:
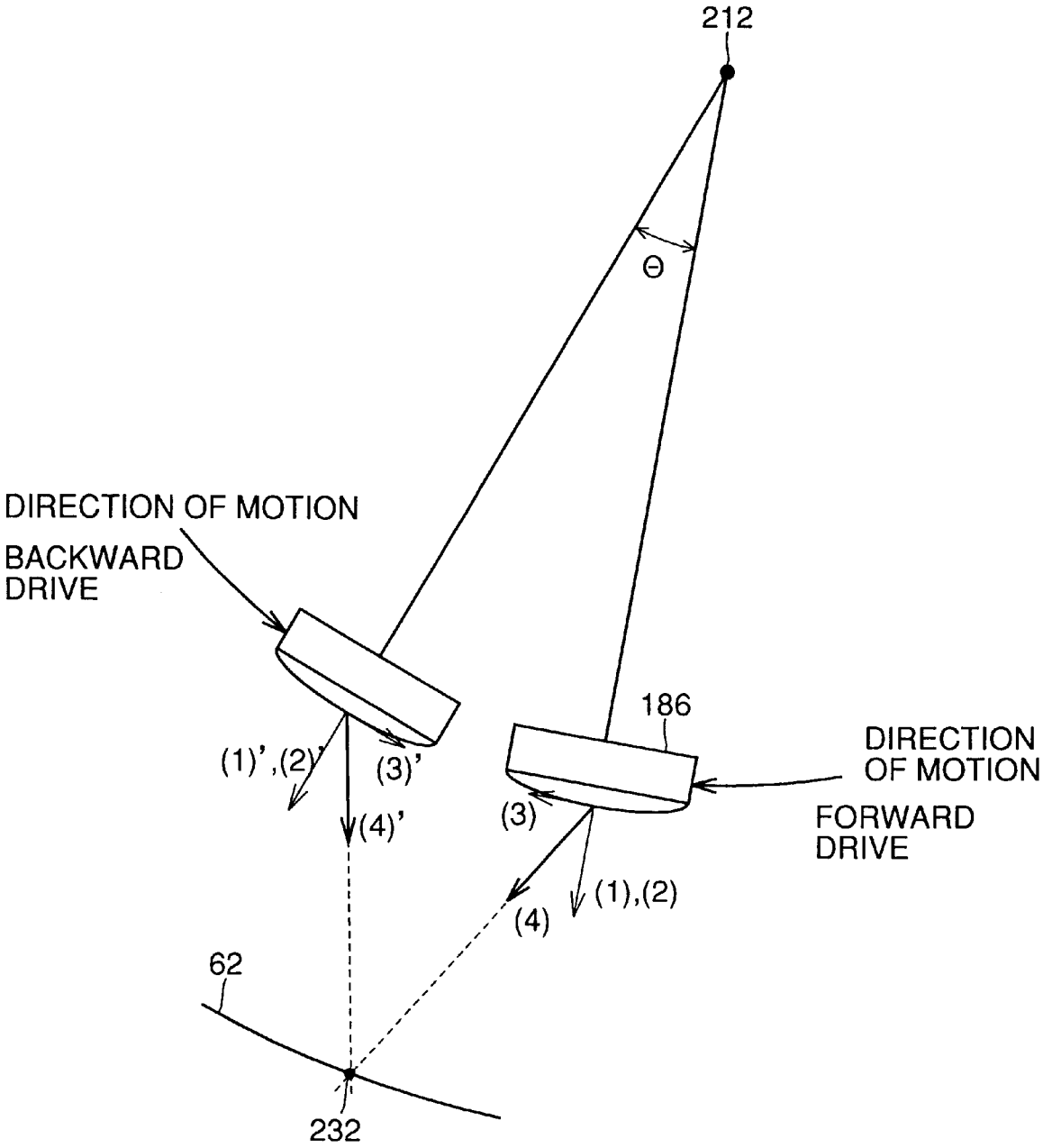
FIG. 51 is a diagram showing the relationship of the ink ejected position between the forward drive and the backward drive.

The ink ejection direction is affected by the inertia force (3) of ink carriage 186. Therefore, the ink hit position will differ between the forward drive and the backward drive even with respect to ink ejected at the same position. Therefore, ink is ejected by shifting the angle by just $\theta$ between the ink ejection position of the forward drive and the ink ejection position of the backward drive to obtain the same ink hit position 232, as shown in FIG. 51.

Figure 52:
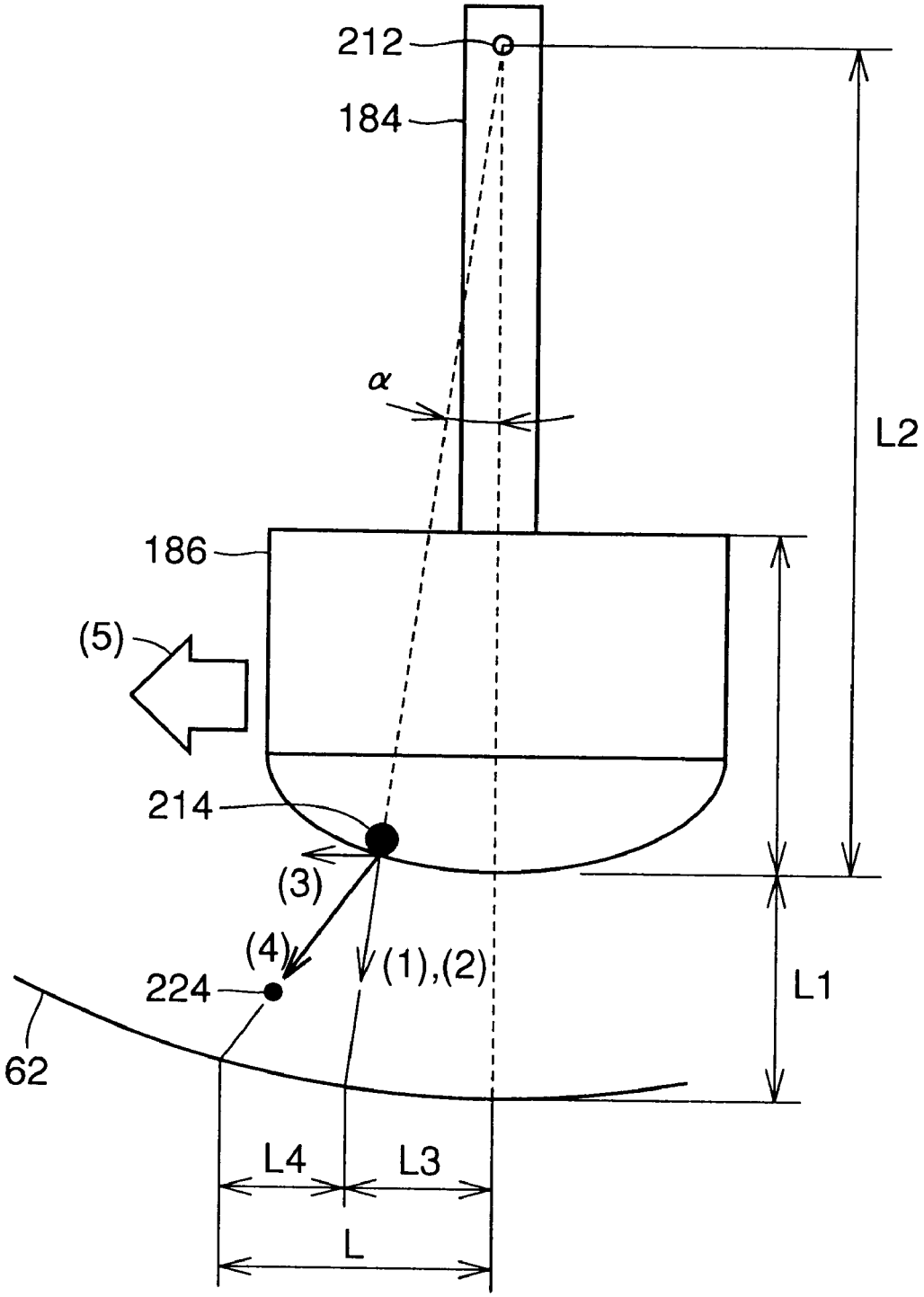
FIG. 52 is a diagram to describe the method of calculating an ink hit position.

The method of calculating the hit position of ink 224 will be described with reference to FIG. 52. It is assumed that the curvature of the ink ejection plane of ink carriage 186 is equal to the curvature of recording sheet 62. The distance from ink nozzle 214 to recording sheet 62 is a constant value L1 irrespective of the position of ink nozzle 214. When the angle of the line connecting shaft 212 and ink nozzle 214 with respect to strut 184 is a, it is considered that a takes a sufficient small value. Therefore, the distance from shaft 212 to ink nozzle 214 can be considered to correspond to a constant value L2. When it is assumed that ink 224 is hit on recording sheet 62 by means of only ink ejection force (1) and centrifugal force (2) neglecting inertia force (3), the distance L3 from the crossing of the line of extension of the axis of strut 184 and recording sheet 62 to the hit position of ink 224 is represented by:

$$L3=(L1+L2)\times\sin\alpha$$

The ink spray out time T is represented as:

$$T=L1/V1$$

neglecting the friction of air and gravity. Here, V1 is the speed of ink 224 applied by ink ejection force (1) and centrifugal force (2).

Assuming that the speed of ink 224 by inertia force (3) is V2, the distance L4 of ink 224 proceeding within time T affected by inertia force (3) is represented as:

$$L4=V2\times T$$

Therefore, the distance L from the crossing position of the line of extension of shaft 212 and recording sheet 62 to the hit position of ink 224 can be represented as:

$$L=L3+L4=(L1+L2)\times\sin\alpha+L1\times V2/V1$$

in approximation. Therefore, the ink ejection timing can be calculated taking into consideration distance L.

Figure 53A:
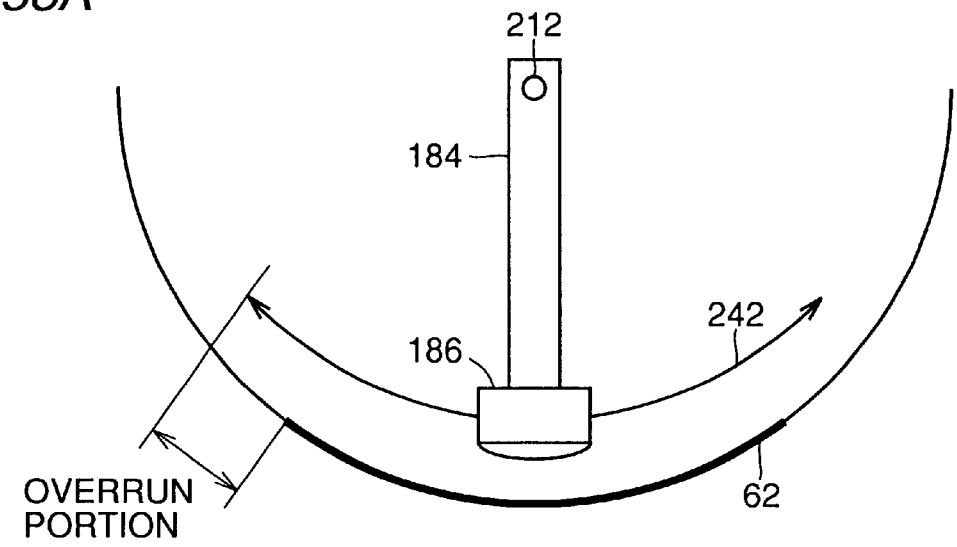
FIGS. 53A and 53B are diagrams to show the relationship between sheet size and swing angle of the strut.
Figure 53B:
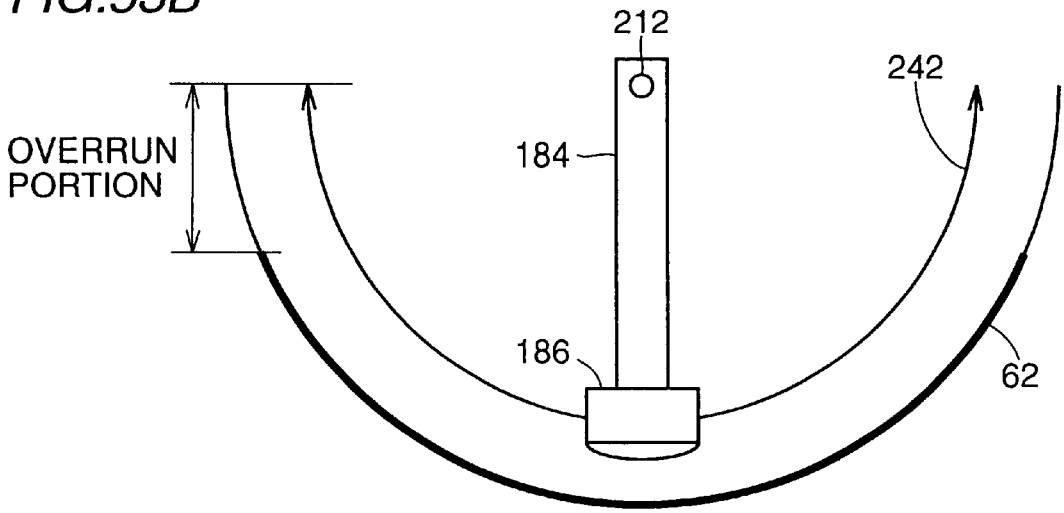

Referring to FIGS. 45 and 46 again, sheet size sensors 200A–200C detect the presence of light reflected from the light emitted from itself. The control device determines that the size of recording sheet 62 set at sheet cassette 206 is B4 when all the sheet size sensors 200A–200C receive reflected light. When sheet size sensor 200A does not receive reflected light and sheet size sensors 200B and 200C receive reflected light, determination is made that the size of recording sheet 62 is A4. When only sheet size sensor 200C receives reflected light, determination is made that the size of recording sheet 62 is B5. The control device determines the swing angle of strut 184 according to the size of recording sheet 62. Referring to FIG. 53A, the swing angle of strut 184 is set small when recording sheet 62 is of a small size such as B5. Referring to FIG. 53B, the swing angle of strut 184 is set to a large value when the size of recording sheet 62 is of a large size such as B4. By adjusting the swinging width of strut 184 depending upon the size of recording sheet 62, extra overrun of ink carriage 186 can be prevented to allow print out to be carried out efficiently.

Figure 54:
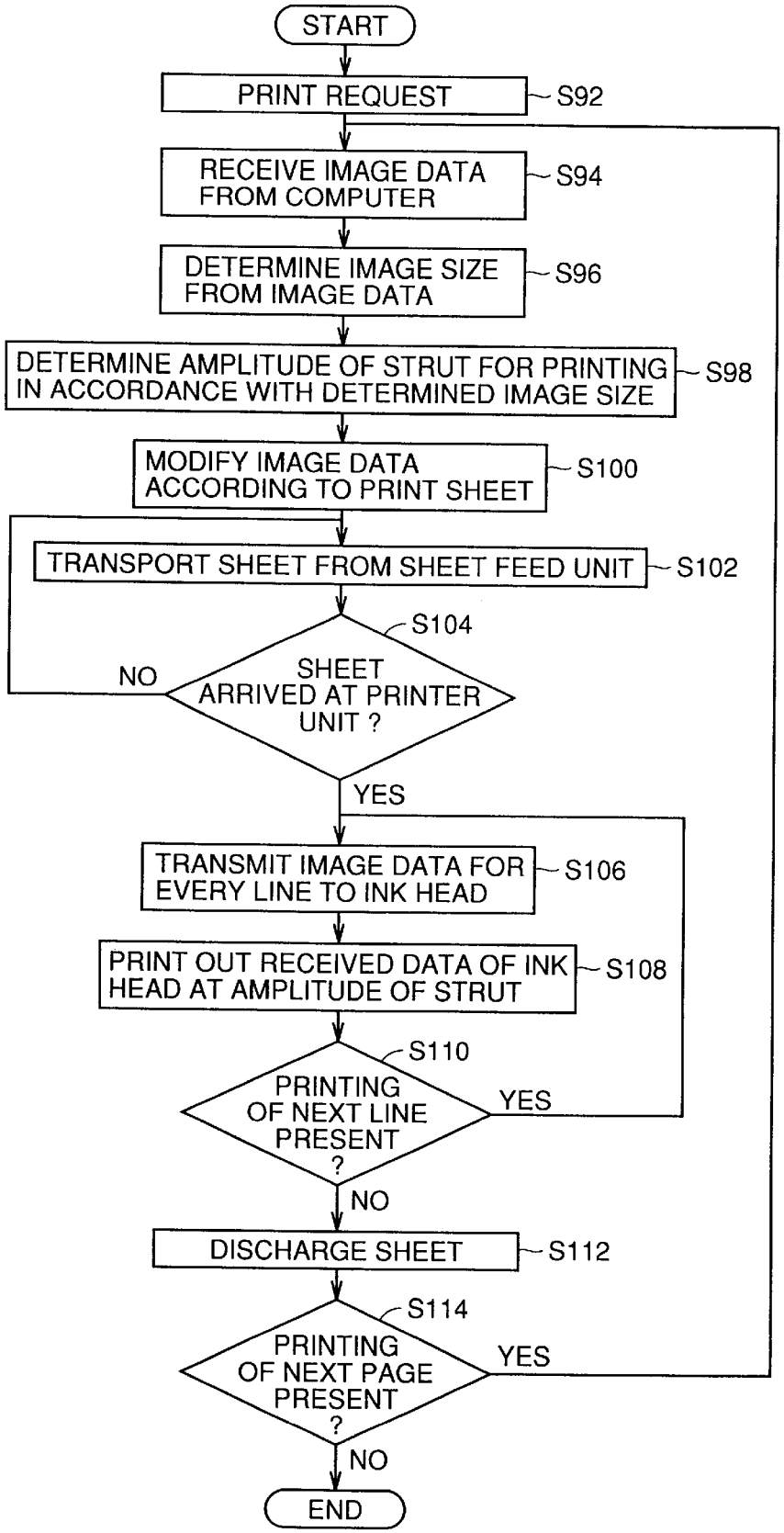
FIG. 54 is a flow chart of the printing process by an ink jet printer.

The operation of the ink jet printer will be described with the reference to FIG. 54. When a print request is transmitted to the control device (S92), the control device receives image data of one page from a computer connected to the ink jet printer (S94). The control device determines the size of recording sheet 62 by the received image data (S96). The amplitude of strut 184 is defined according to the size of recording sheet 62 (S98). The orientation of image data is modified according to recording sheet 62 (S100). A recording sheet 62 is conveyed from sheet cassette 206 (S102). If recording sheet 62 arrives at the printer unit (YES at S104), image data is transmitted to ink carriage 186 for every one line (S106). Ink is ejected for printing according to the image data while ink carriage 186 moves along an arc (S108). The process of S106–S108 is repeated until there is no more image data of the next line (S110). When printing of one page ends (NO at S110), recording sheet 62 is discharged (S112). Then, determination is made whether there is image data to be printed out (S114). If there is image data to be printed out (YES at S114), the process of S94 onward is repeated. If there is no image data to be printed out (NO at S114), the process ends.

Figure 55:
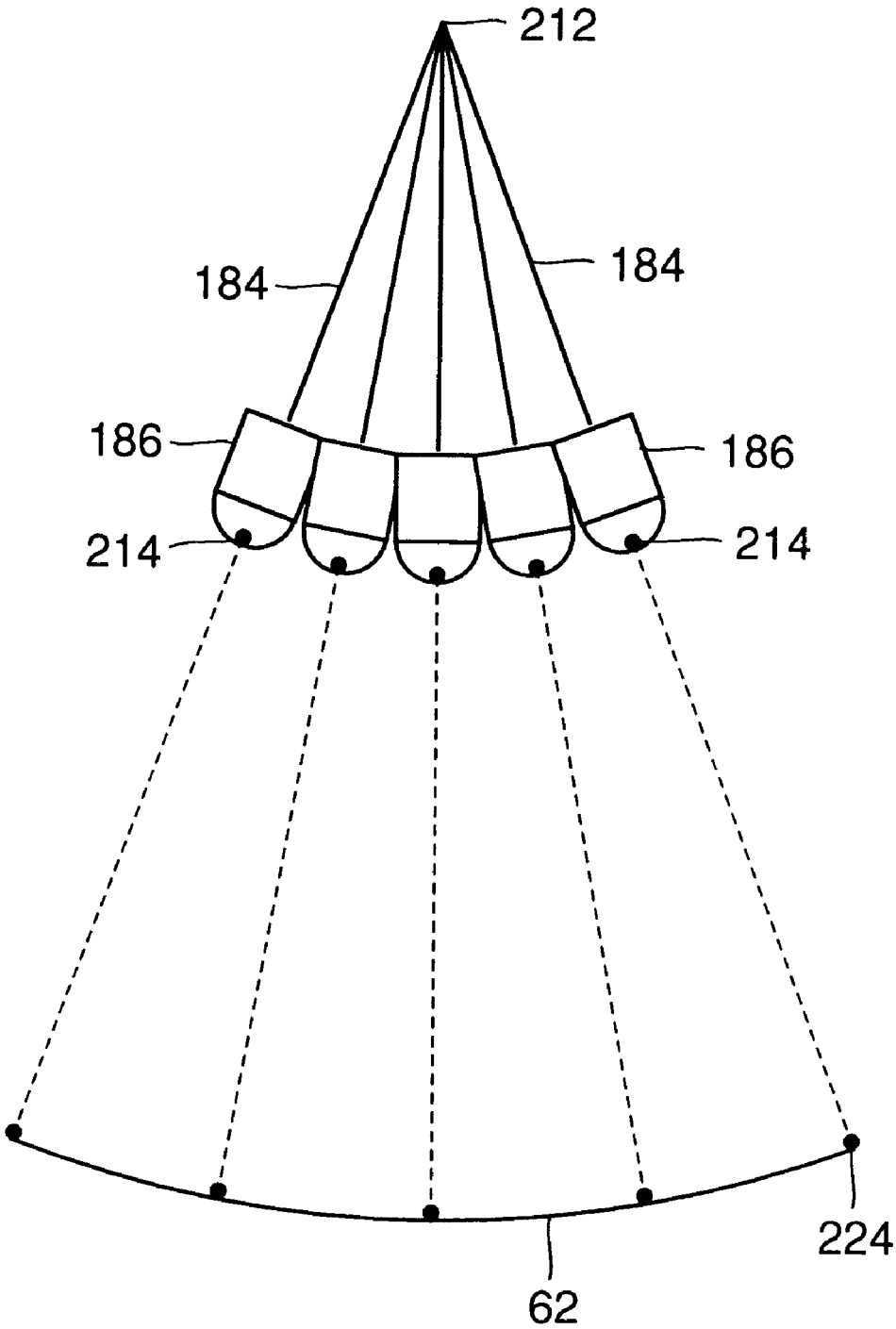
FIG. 55 shows ink nozzles arranged in one row in a direction orthogonal to the main scanning direction.

As shown in FIG. 55, ink nozzles 214 can be arranged in one row in a direction orthogonal to the main scanning direction. In this case, the printing resolution is defined exclusively by the movement angle of the ink head. The main scanning direction is the direction of motion of ink carriage 186.

According to the ink jet printer of the present invention, printing is carried out by ink carriage 186 moving along an arc. Therefore, the length in the lateral direction required for printing can be reduced to allow a compact ink jet printer to be provided. Complicated readout of data as in the ink jet printer of the first to fifth embodiments in which the ink carriage moves along an arc is not required. High speed printing is allowed.

Eighth Embodiment

Figure 56:
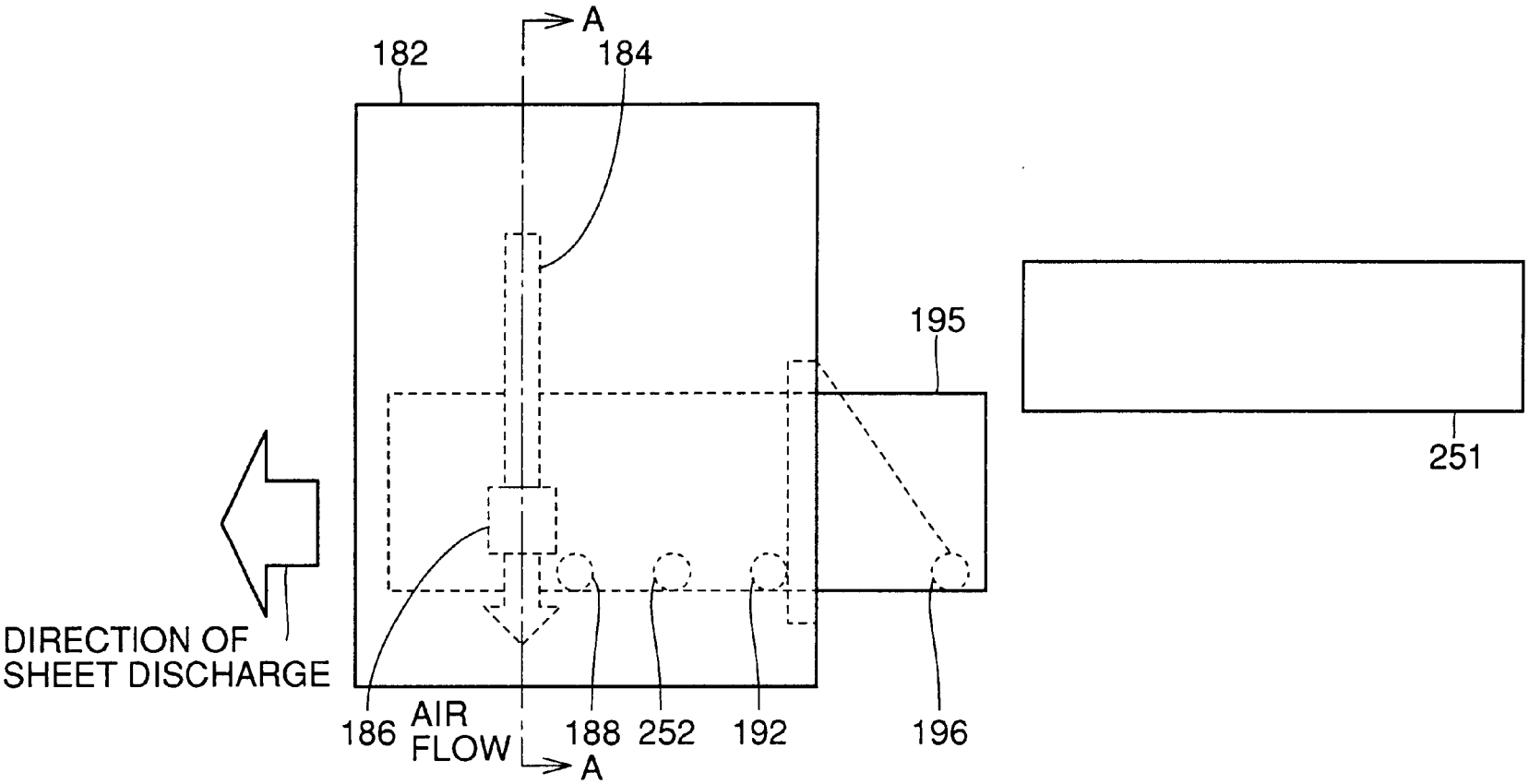
FIG. 56 is a cross sectional view of an ink jet printer according to an eighth embodiment of the present invention.
Figure 57:
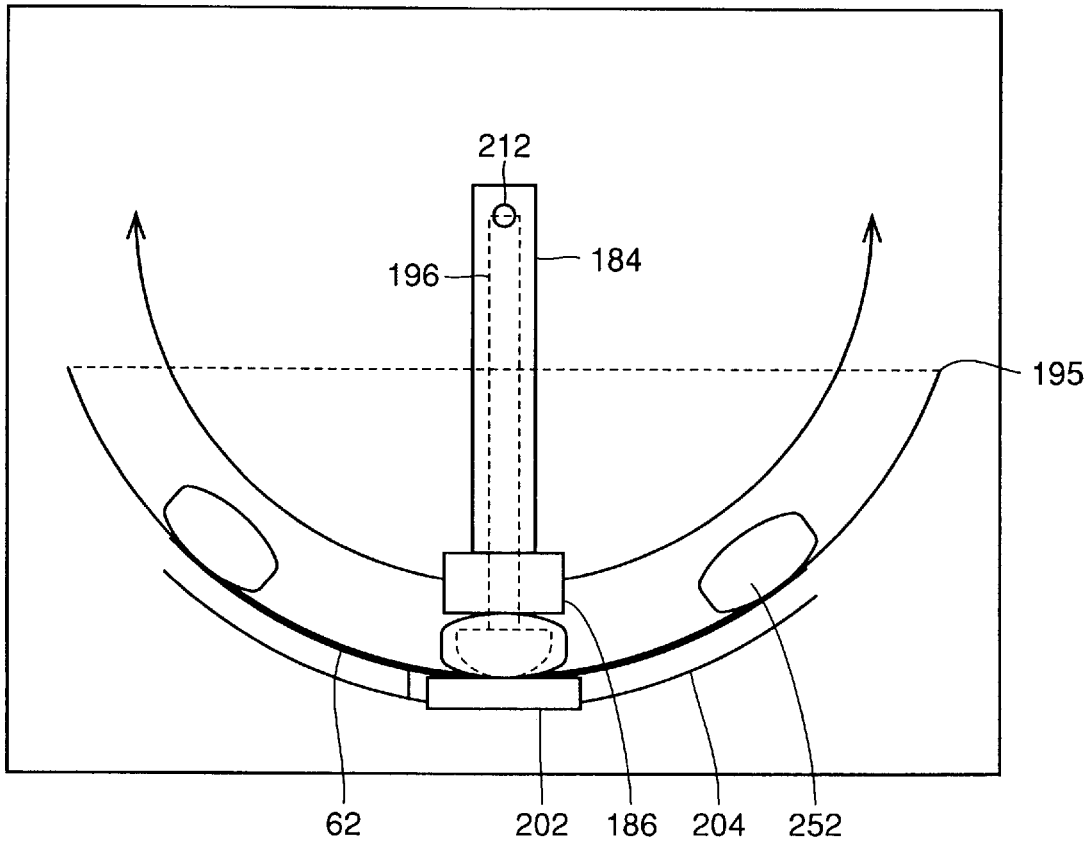
FIG. 57 is a sectional view of the ink jet printer of FIG. 56 taken along line A—A.

Referring to FIGS. 56 and 57, an ink jet printer according to an eighth embodiment of the present invention includes a sheet cassette 251 storing recording sheets 62, a transportation guide 195 formed of a portion of a cylinder for holding recording sheet 62 output from sheet cassette 251 in an arc manner, a sheet bail 196 for recording sheet 62 placed on transportation guide 195, a pickup roller 192 taking out recording sheet 62 one by one held by sheet bail 196, a transportation roller 252 and a guide roller 188 sandwiching recording sheet 62 with transportation guide 195 to guide recording sheet 62 to a position facing ink carriage 186 while maintaining a curvature identical to that of transportation guide 195, a shaft 212 provided rotatably about a predetermined axis, a strut 184 fixed to shaft 212 to move along an arc about the axis together with the rotation of shaft 212, and an ink carriage 186 provided at a predetermined position from shaft 212 of strut 184.

Ink carriage 186 moves along an arc about shaft 212 to spray out ink on a recording sheet 62 that is bent in an arc manner.

Figure 58A:
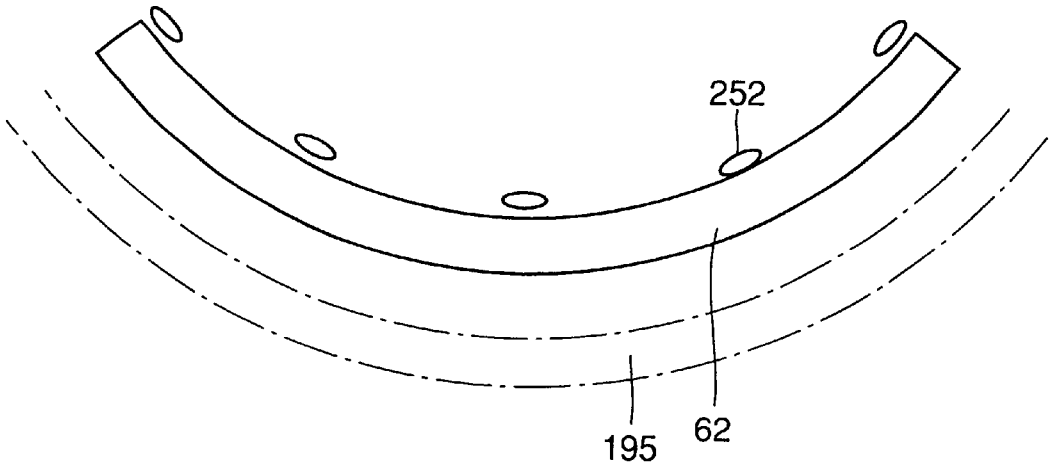
FIGS. 58A and 58B are diagrams to describe the arranged position of transportation rollers.
Figure 58B:
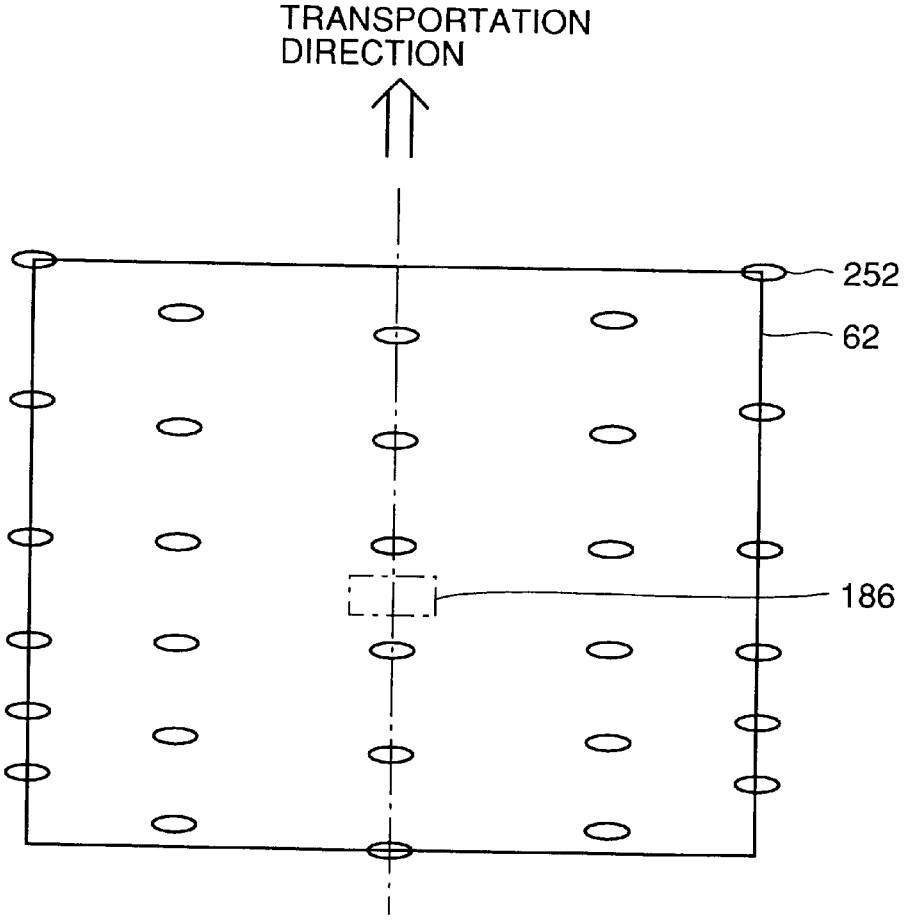

Referring to FIGS. 58A and 58B, transportation rollers 252 are arranged on a straight line parallel to the transportation direction of recording sheet 62 to be sequentially in contact with recording sheet 62 from the center portion to the periphery in accordance with transportation of recording sheet 62. Transportation rollers 252 in the proximity of the scanning trajectory of ink carriage 186 are arranged on a straight line parallel to the main scanning direction. Transportation rollers 252 are arranged to release the contact with recording sheet 62 from the periphery to the center portion after printing is carried out. Transportation rollers 252 located at the discharge sheet side than the scanning trajectory of ink carriage 186 out of the plurality of transportation rollers 252 are arranged in a star wheel manner.

Figure 59:
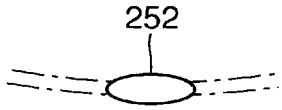
FIG. 59 is a diagram to describe the shape of a transportation roller.
Figure 60:
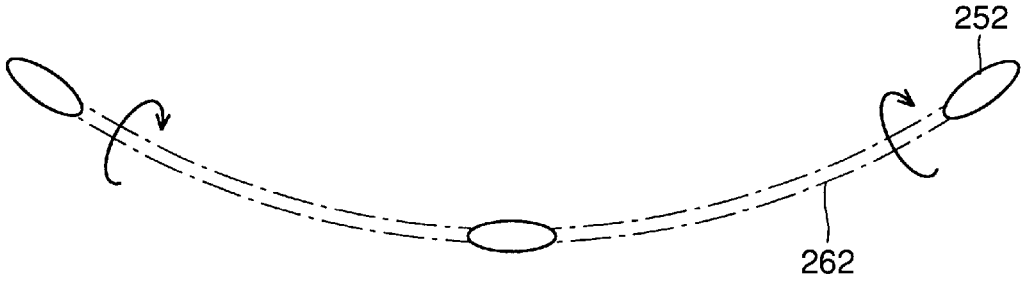
FIG. 60 is a diagram showing the connection of transportation rollers by the same axis.
Figure 61:
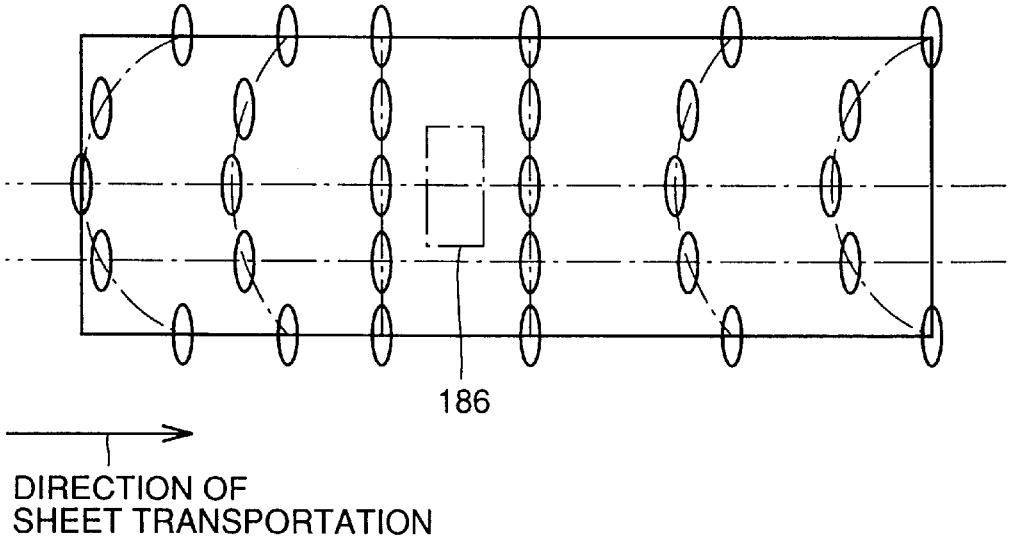
FIG. 61 is a diagram to describe arrangement of transportation rollers connected by the same axis.

Referring to FIG. 59, transportation roller 252 has a fusiform shape of a curvature smaller than the curvature of recording sheet 62. Referring to FIGS. 60 and 61, a plurality of transportation rollers 252 of each line are connected by the same axis in the direction of width of recording sheet 62. Transportation rollers 252 are driven symmetrically left and right on recording sheet 62. By transportation roller 252 of a fusiform shape having a curvature smaller than the curvature of recording sheet 62, the buckling of recording sheet 62 caused by contact with the end of transportation roller 252 can be prevented.

Figure 62A:
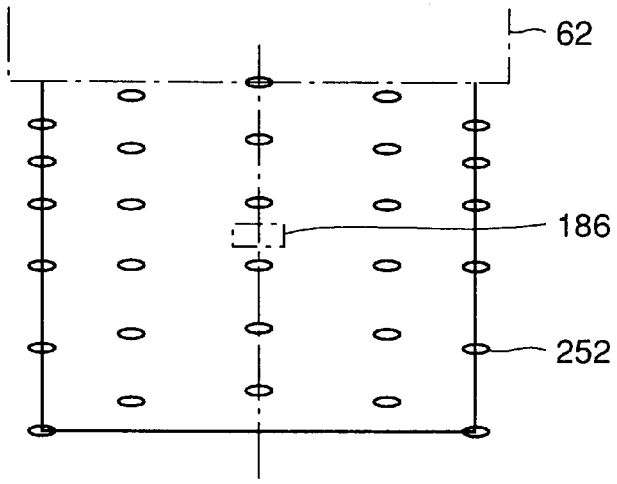
FIGS. 62A–62C are diagrams to describe the contact position relationship between transportation rollers and a recording sheet delivered by the transportation rollers.
Figure 62B:
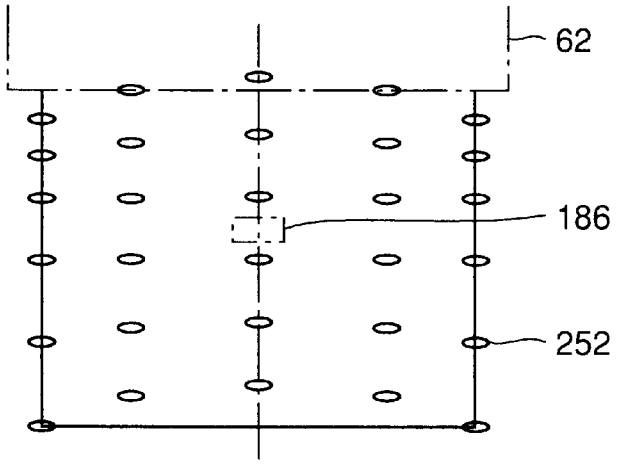
Figure 62C:
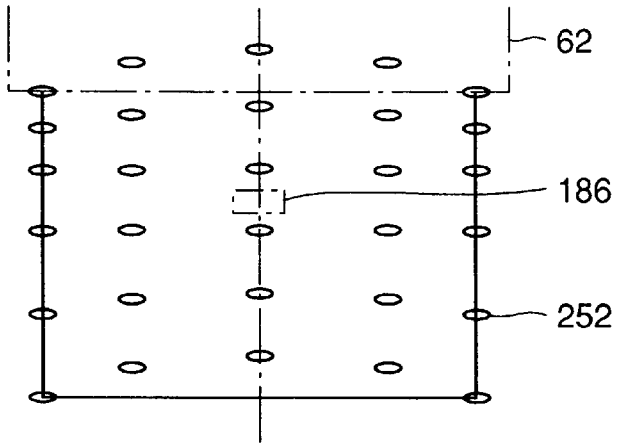

Transportation of recording sheet 62 will be described with reference to FIGS. 62A–62C. As shown in FIG. 62A, the center portion of recording sheet 62 in the width direction is fastened between transportation roller 252 and transportation guide 195. Accordingly, the center of recording sheet 62 is positioned, and the relationship in position with ink carriage 186 is fixed. Upon transportation of recording sheet 62, recording sheet 62 passes through transportation rollers 252 located symmetrically and transportation guide 195, as shown in FIG. 62B. Here, recording sheet 62 is bent in a configuration of a curvature identical to that of transportation guide 195. Then, recording sheet 62 passes through symmetrically located transportation rollers 252 and transportation guide 195, as shown in FIG. 62C. Thus, recording sheet 62 is conveyed without meander along the inner side of transportation guide 195.

Figure 63:
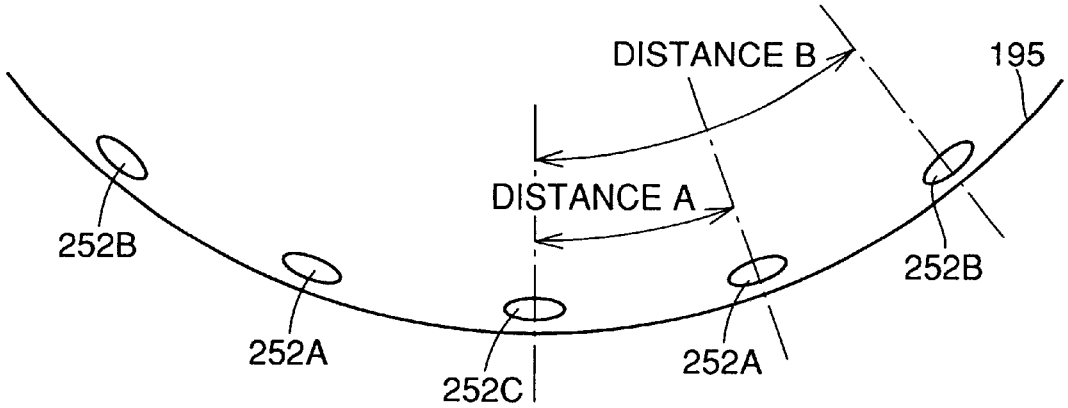
FIG. 63 is a diagram to describe the relationship between sheet size and transportation roller position.

The position of arranging transportation rollers 252 is determined by the smallest size and largest size of recording sheet 62 that can be printed by the ink jet printer. More specifically, when ½ the smallest width is A and ½ the largest width is B in the main scanning direction of recording sheet 62 as shown in FIG. 63, transportation roller 112A is arranged at a position of distance A from transportation roller 112C located at the center, and transportation roller 112B is located at distance B. Accordingly, a recording sheet 62 of all sizes can be transported by a minimum number of transportation rollers 112.

Figure 64:
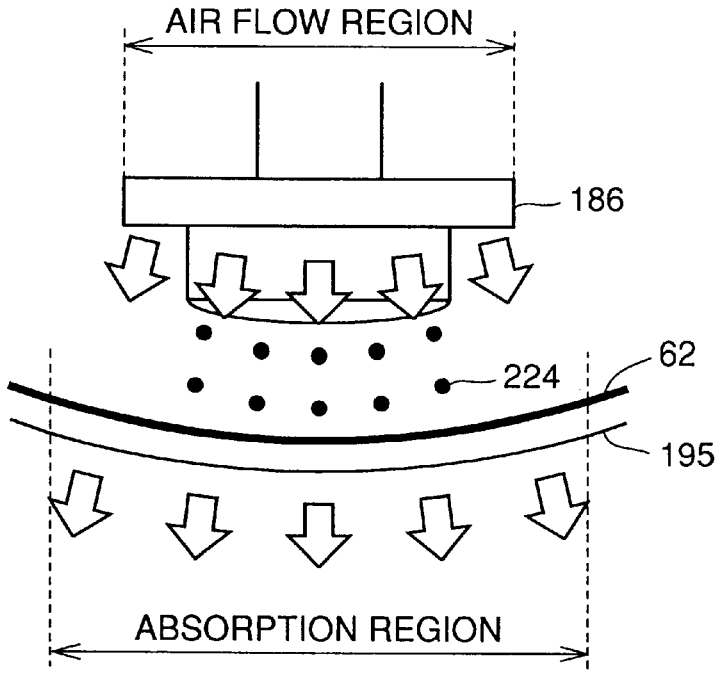
FIG. 64 is a diagram representing air flow formed above and below a recording sheet.

Referring to FIG. 64, an air flow is formed at the upper plane or bottom plane, or at both planes of recording sheet 62, whereby recording sheet 62 is secured to transportation guide 195. By using air flow for the securement of recording sheet 62, the drying operation of ink 224 can be facilitated to increase the number of printouts per unit time.

The current position of ink carriage 186 can be detected directly or indirectly by using a motor that can control the rotation angle such as a stepping motor for the motor (not shown) that drives strut 184.

According to the ink jet printer of the present embodiment, recording sheet 62 is conveyed by a plurality of transportation rollers 252 arranged in an arc manner along the inner side of transportation guide 195. Therefore, recording sheet 62 can be conveyed properly without meander.

Transportation rollers 252 are arranged so that recording sheet 62 comes into contact with a transportation roller 252 sequentially from the center portion towards the periphery when transferred by transportation guide 195. Accordingly, recording sheet 62 can be gradually bent as being transported to prevent buckling caused by bending of recording sheet 62.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An ink jet printer comprising:

a shaft provided rotatably about a predetermined axis, a strut fixed to said shaft so as to move along an arc about said axis with rotation of said shaft, an ink carriage including a plurality of ink heads provided at a predetermined position from said shaft of said strut, and a control device controlling forwarding of a recording sheet, rotational motion of said shaft, and ink jetting from said plurality of ink heads.

2. The ink jet printer according to claim 1, wherein said control device defines width of a reciprocation motion of said ink carriage in a printing operation by the relationship between width of a reciprocating motion of an ink head out of said plurality of ink heads located farthest away from said shaft and width of said recording sheet to control forwarding of said recording sheet, rotational motion of said shaft, and ink jetting from said plurality of ink heads.

3. The ink jet printer according to claim 1, further comprising a maintenance mechanism of the ink carriage provided at a position outside a motion range of said ink carriage in a printing operation and at a position facing said ink carriage.

4. The ink jet printer according to claim 1, wherein said ink carriage includes a plurality of ink heads fixed to another end of said strut and in radial arrangement.

5. The ink jet printer according to claim 1, wherein said control device determines ink jet timing of each of said plurality of ink heads according to distance between said shaft and said plurality of ink heads to control forwarding of said recording sheet, rotational motion of said shaft and ink jetting from said plurality of ink heads.

6. An ink jet printer comprising:

two shafts provided rotatably about two predetermined axes arranged at a predetermined distance, two struts connected to said two axes, respectively, so as to move along an arc about said two axes with rotation of said two axes, an ink carriage including a plurality of ink heads provided at a predetermined position from said shaft of said two struts, and a control device controlling forwarding of a recording sheet, rotational motion of said two shafts, and ink jetting from said plurality of ink heads.

7. The ink jet printer according to claim 6, wherein said control device converts image data according to a curvature of a trajectory of said ink carriage in a reciprocating arc motion to control forwarding of said recording sheet, rotational motion of said two shafts, and ink jetting from said plurality of ink heads according to the converted image data.

8. The ink jet printer according to claim 6, wherein said control device comprises means for preparing image data of one page, and means to convert said prepared image data of one page according to a curvature of a trajectory of said ink carriage in a reciprocating arc motion for controlling forwarding of said recording sheet, rotational motion of said two shafts, and ink jetting from said plurality of ink heads according to the converted image data.

9. The ink jet printer according to claim 6, wherein said control device comprises means for sequentially preparing data of a predetermined number of lines corresponding to division of image data of one page, and means to convert said prepared data of a predetermined number of lines according to a curvature of a trajectory of said ink carriage in a reciprocating arc motion for controlling forwarding of said recording sheet, rotational motion of said two shafts and ink jetting from said plurality of ink heads according to the converted data.

10. The ink jet printer according to claim 6, further comprising a heat generator provided at said two struts.

11. The ink jet printer according to claim 10, wherein a lateral width of said heat generator is defined by the relationship between width of a reciprocating motion of said heat generator and width of said recording sheet.

12. The ink jet printer according to claim 10, wherein a heat generation direction of said heat generator is the direction expanding from the center of said heat generator.

13. The ink jet printer according to claim 10, wherein said heat generator is provided at a position where ink in said ink carriage is not modified in quality or not coagulated by heat generated from said heat generator.

14. The ink jet printer according to claim 10, wherein said heat generator is provided at a position that does not cause modification in quality of ink ejected on said recording sheet or deformation of said recording sheet by heat generated from said heat generator.

15. The ink jet printer according to claim 10, wherein direction of hot air generated from said heat generator is the direction that does not cause modification in quality or coagulation of ink in said ink carriage by heat and that does not cause distortion in spray out of ink droplets ejected from said ink carriage by wind pressure.

16. The ink jet printer according to claim 10, further comprising a vibration absorption member provided between said heat generator and said two struts.

17. The ink jet printer according to claim 10, wherein said control device comprises means for controlling rotational motion of said two shafts and ink jetting from said plurality of ink heads, and means for forwarding said recording sheet and generating heat from said heat generator until drying of a printer unit of said recording sheet ends.

18. The ink jet printer according to claim 10, wherein said control device comprises means for controlling forwarding of said recording sheet, rotational motion of said two struts and ink jetting from said plurality of ink heads, and means for controlling heat generation from said heat generator according to image data.

19. The ink jet printer according to claim 6, further comprising a heat generator provided at a leading end of said ink carriage.

20. An ink jet printer comprising:

a shaft provided rotatably about a predetermined axis, a strut fixed to said shaft so as to move along an arc about said axis with rotation of said shaft, two parallel guide rails, an ink carriage including a plurality of ink heads, and that can run along said two guide rails, and including an opening with a direction orthogonal to the running direction as a longitudinal direction, and having an end of said strut fitted to be movable in said opening, and a control device to control forwarding of a recording sheet, an arc motion of said strut, and ink jetting from said plurality of ink heads.

21. The ink jet printer according to claim 20, wherein said control device controls forwarding of said recording sheet, arc motion of said strut, and ink jetting from said plurality of ink heads according to image data.

22. The ink jet printer according to claim 20, wherein said control device includes a first device to control forwarding of said recording sheet, arc motion of said strut, and ink jetting from said plurality of ink heads according to size of said recording sheet.

23. The ink jet printer according to claim 22, further comprising a sensor to detect the size of said recording sheet, wherein said first device determines the size of said recording sheet according to output of said sensor to control forwarding of said recording sheet, arc motion of said strut, and ink jetting from said plurality of ink heads according to the size of said recording sheet.

24. The ink jet printer according to claim 22, further comprising a fixture member to fix said recording sheet, wherein said first device determines the size of said recording sheet according to a fixed position of said fixture member to control forwarding of said recording sheet, arc motion of said strut and ink jetting from said plurality of ink heads according to the size of said recording sheet.

25. The ink jet printer according to claim 20, wherein a portion of said two guide rails coupled with said ink carriage is formed of a ball bearing, and wherein a portion of said strut coupled with said ink carriage is formed of a ball bearing.

26. An ink jet printer comprising:

a shaft provided rotatably about a predetermined axis, a strut fixed to said shaft so as to move along an arc about said axis with rotation of said shaft, an ink carriage including a plurality of ink nozzles, provided at a predetermined position from said shaft of said strut, ejecting ink in a direction parallel to a plane including said strut, and a sheet holding unit holding a sheet at a curvature defined by the relationship between a curvature of motion of said ink carriage at a position opposite to said ink carriage.

27. The ink jet printer according to claim 26, wherein an axial direction of said axis and a transportation direction of said sheet are in parallel.

28. The ink jet printer according to claim 26, wherein said ink carriage has an ink eject plane where said plurality of ink nozzles are formed, said ink eject plane having a curvature not more than the curvature of said sheet held by said sheet holding unit.

29. The ink jet printer according to claim 26, wherein each of said plurality of ink nozzles eject ink in a direction of a line connecting the center of said shaft and each ink nozzle.

30. The ink jet printer according to claim 26, wherein said ink carriage ejects ink by moving back and forth the same line on said sheet.

31. The ink jet printer according to claim 30, wherein said ink carriage has ink ejection timing of a forward drive deviated from the ink eject timing of a backward drive in ejecting ink in moving back and forth on the same line of said sheet.

32. The ink jet printer according to claim 31, wherein said ink carriage has ink ejection timing of a backward drive set earlier than the ink jet timing of a forward drive in ejecting ink in moving back and forth on the same line of said sheet.

33. The ink jet printer according to claim 26, wherein ink ejection timing of each of said plurality of ink nozzles is defined according to distance from the center of said shaft to the ink nozzle, distance between said ink carriage and said sheet, position of the ink nozzle, and ink speed.

34. The ink jet printer according to claim 26, wherein said plurality of ink nozzles are arranged on a crossing line between a plane orthogonal to a direction of motion of said ink carriage and said ink eject plane.

35. The ink jet printer according to claim 26, further comprising a sheet size sensor sensing size of said sheet, wherein said strut has a swing angle defined according to an output of said sheet size sensor.

36. The ink jet printer according to claim 35, wherein said swing angle of said strut is defined so that said ink carriage covers said recording sheet in a direction of motion of said ink carriage.

37. The ink jet printer according to claim 26, wherein said sheet holding unit comprises a transportation guide having an arc cross section with a concave plane opposite to said ink carriage, and a plurality of transportation rollers arranged to sandwich said sheet with a plane of said transportation guide opposite to said ink carriage.

38. The ink jet printer according to claim 37, wherein said plurality of transportation rollers are arranged so that a transportation roller is sequentially in contact with said sheet from a center portion to a periphery when said sheet is transported by said transportation guide.

39. The ink jet printer according to claim 37, wherein said plurality of transportation rollers are arranged at least at an intermediate point between an end portion and the center portion of said sheet of the largest size in a direction of motion of said ink carriage and at an intermediate point between an end portion and the center portion of said sheet of the smallest size in a direction of motion of said ink carriage.

40. The ink jet printer according to claim 26, wherein said plurality of transportation rollers are jointly driven in a direction of motion of said ink carriage.

41. The ink jet printer according to claim 26, wherein each of said plurality of transportation rollers is of a fusiform shape having a curvature smaller than the curvature of said sheet.

* * * * *